US005552769A

United States Patent [19]

Riordan

[11] Patent Number: 5,552,769

[45] **Date of Patent: * Sep. 3, 1996**

[54] COMBINED ALARM SYSTEM AND WINDOW COVERING ASSEMBLY

[76] Inventor: Dennis E. Riordan, 759 Zena Highwoods Rd., Kingston (Woodstock), N.Y. 12401

[ * ] Notice: The portion of the term of this patent subsequent to Dec. 28, 2010, has been disclaimed.

[21] Appl. No.: 33,205

[22] Filed: Mar. 15, 1993

Related U.S. Application Data

[63] Continuation-in-part of Ser. No. 920,837, Jul. 28, 1992, Pat. No. 5,440,289, which is a continuation-in-part of Ser. No. 831,861, Feb. 5, 1992, Pat. No. 5,274,357.

[51] Int. Cl.[6] ..... G08B 13/08; G08B 13/12

[52] U.S. Cl. ..... 340/550; 160/374; 206/407; 229/126; 340/545; 340/547; 340/600

[58] Field of Search ..... 340/550, 545, 340/547, 600; 160/374; 206/407; 229/126

[56] References Cited

U.S. PATENT DOCUMENTS

| | | | |
|---|---|---|---|
| 4,232,310 | 11/1980 | Wilson | 340/550 |
| 4,281,320 | 7/1981 | Rosenberg | 340/550 |
| 4,293,778 | 10/1981 | Williams | 340/550 |
| 4,577,184 | 3/1986 | Hodara et al. | 340/600 |
| 5,049,855 | 9/1991 | Slemon et al. | 250/227.28 |
| 5,274,357 | 12/1993 | Riordan | 340/550 |

*Primary Examiner*—Glen Swann
*Attorney, Agent, or Firm*—W. Edward Johansen

[57] ABSTRACT

A combined alarm system and window covering assembly includes a top housing, a bottom rail having two ends, a covering, a conductive wire and two resiliently biased reed relay switches. The covering is mechanically coupled to the top housing and the bottom rail. The conductive wire has a first end and a second end and extends from the top housing down to the bottom rail and up from the bottom rail to the top housing. The conductive wire functions as a pull cord for raising and lowering the bottom rail and the covering. Each resiliently biased reed relay switch is mechanically coupled to one of the two ends of the bottom rail and electrically coupled to the conductive wire.

20 Claims, 37 Drawing Sheets

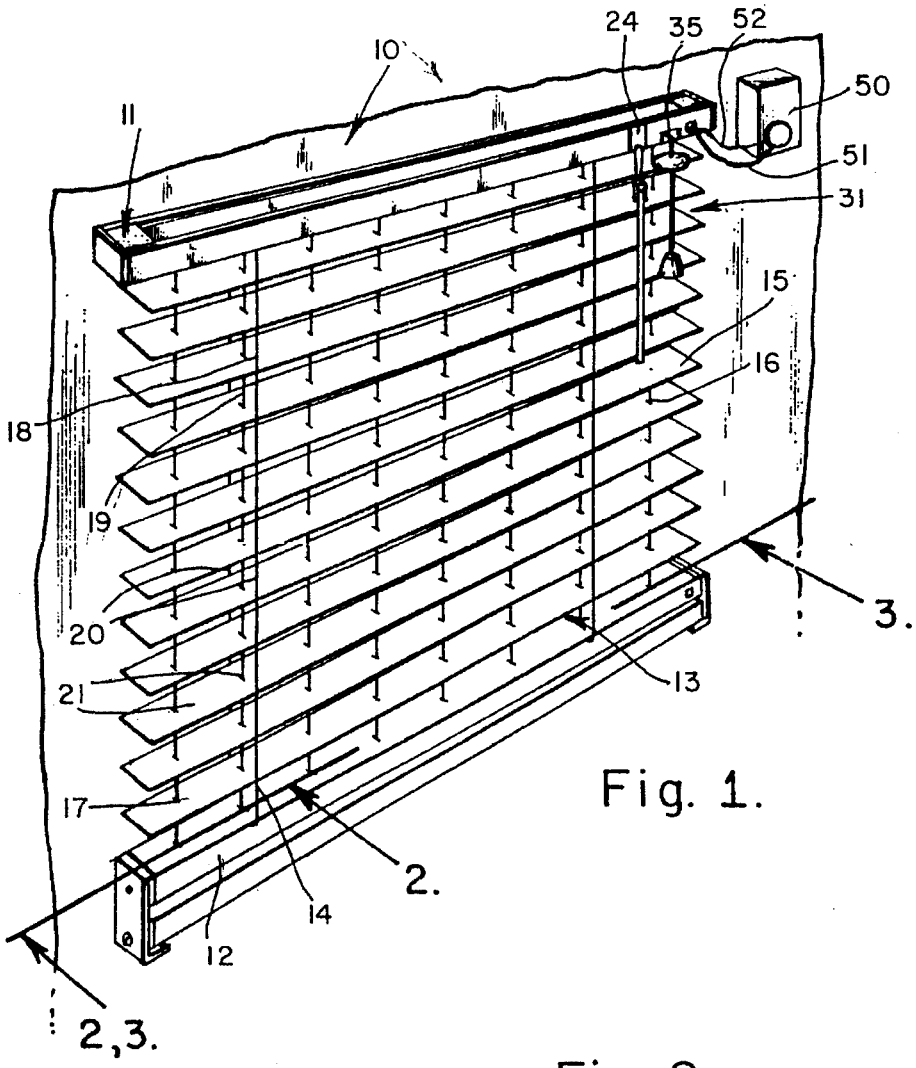
Fig. 1.
Fig. 2.
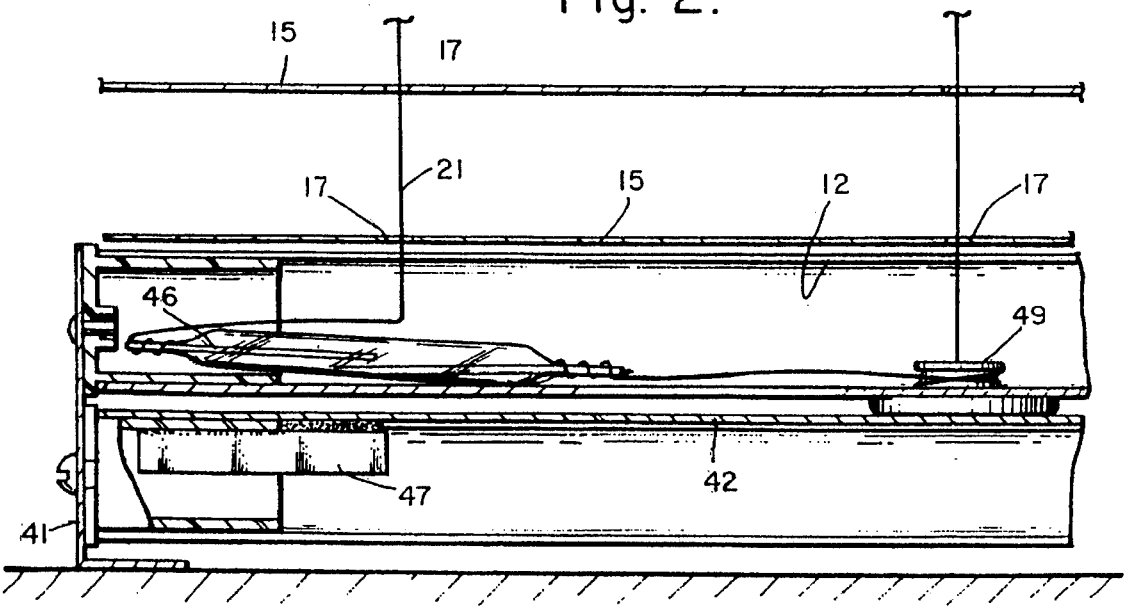

to Spool
to Alarm
11
12
13
14
15
16
17
21
22
23
24
25
31
32
33
34
36
37
38
41
42
43
46
47
48
49
50
1
2
3
4
5
6
7
8

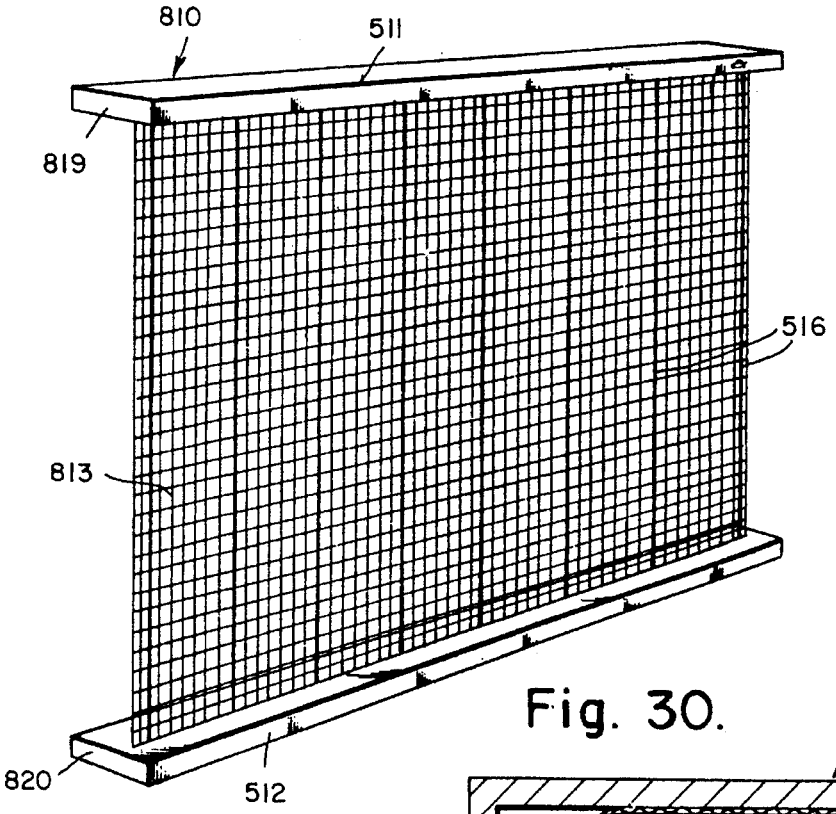
Fig. 30.
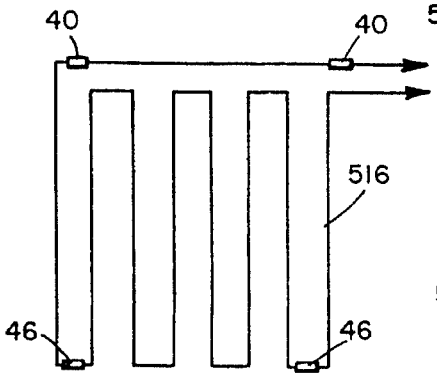
Fig. 32.
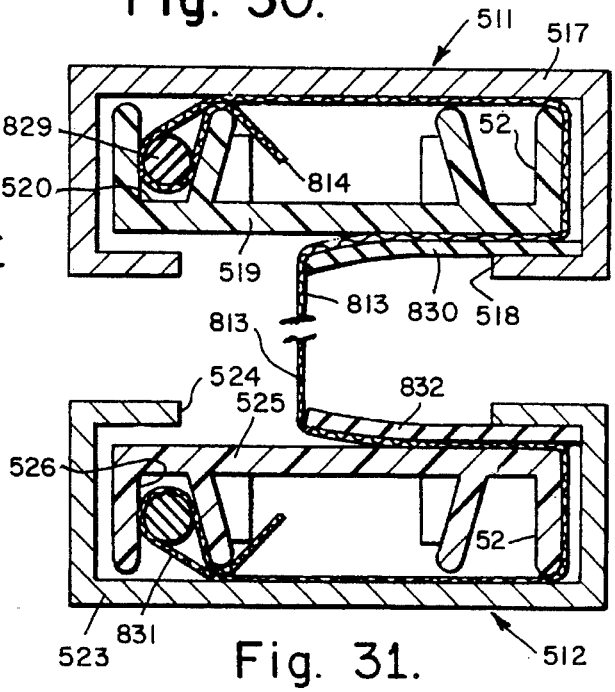
Fig. 31.
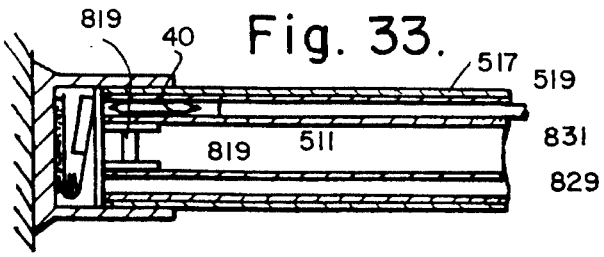
Fig. 33.
Fig. 34.
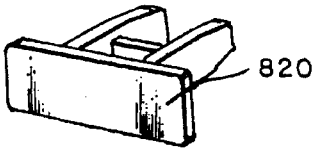

Fig. 35.
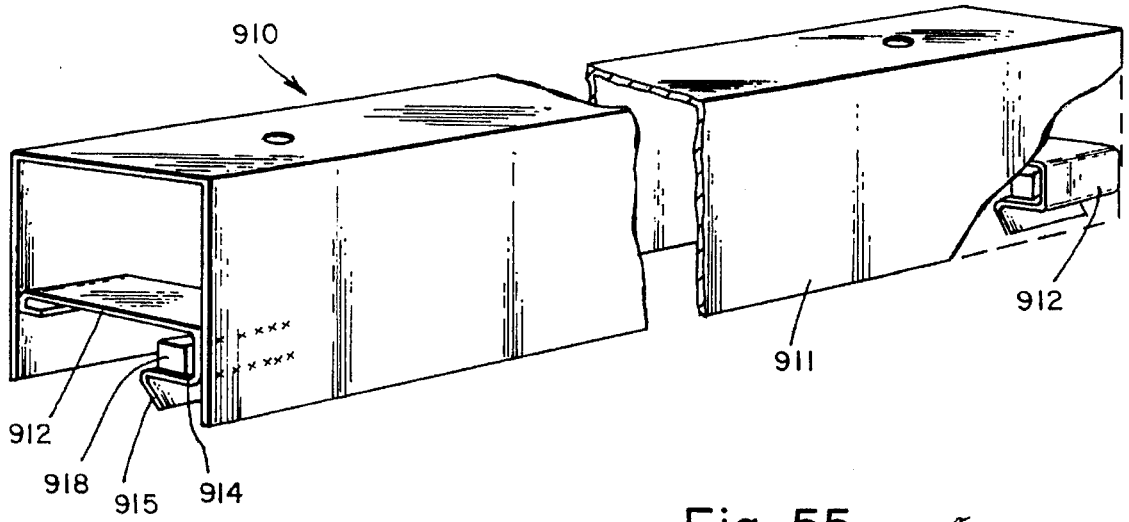
Fig. 55.
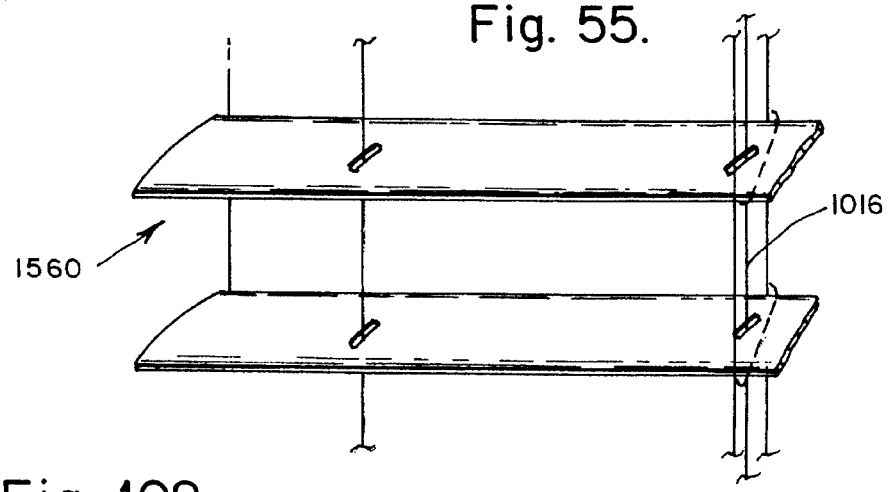
Fig. 102.
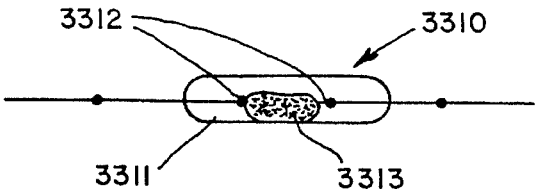
Fig. 103.
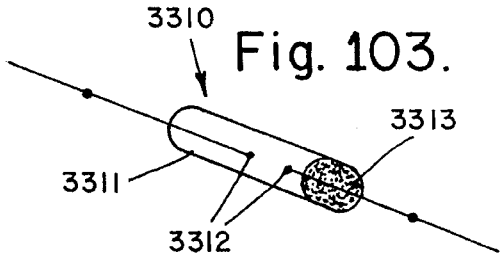
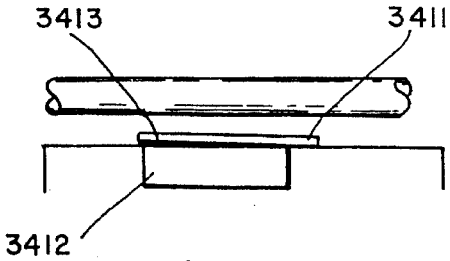
Fig. 104.
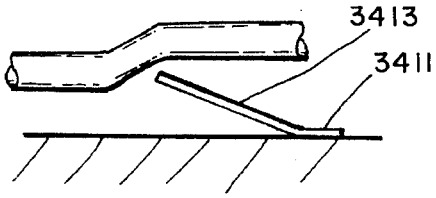
Fig. 105.

Fig. 39.
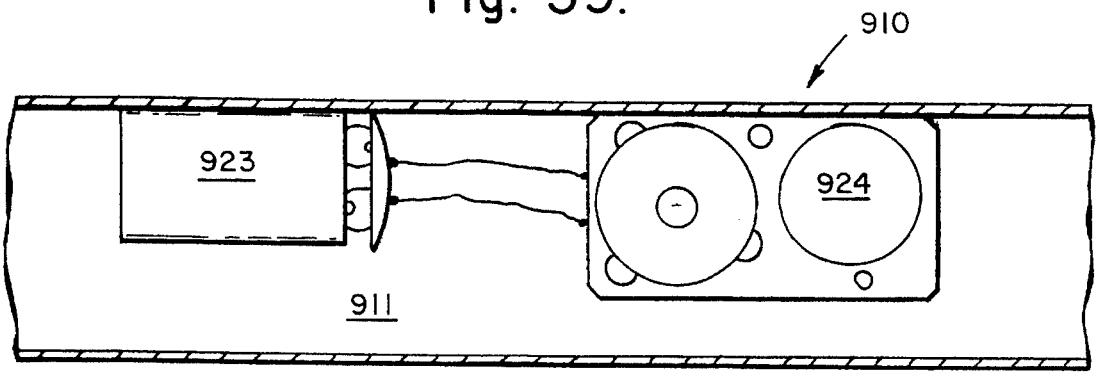
Fig. 40.
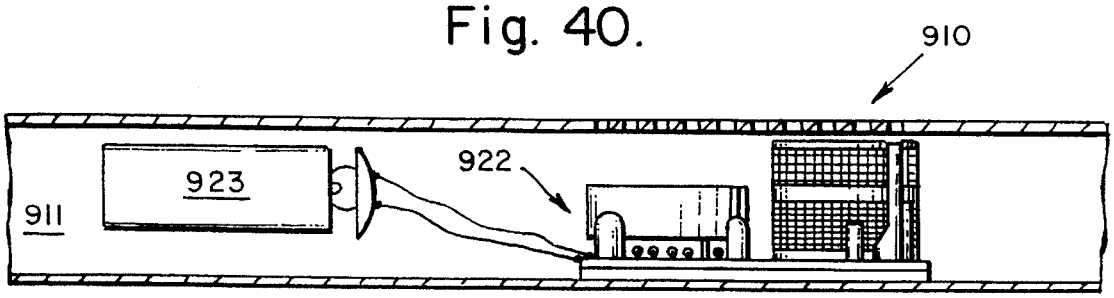
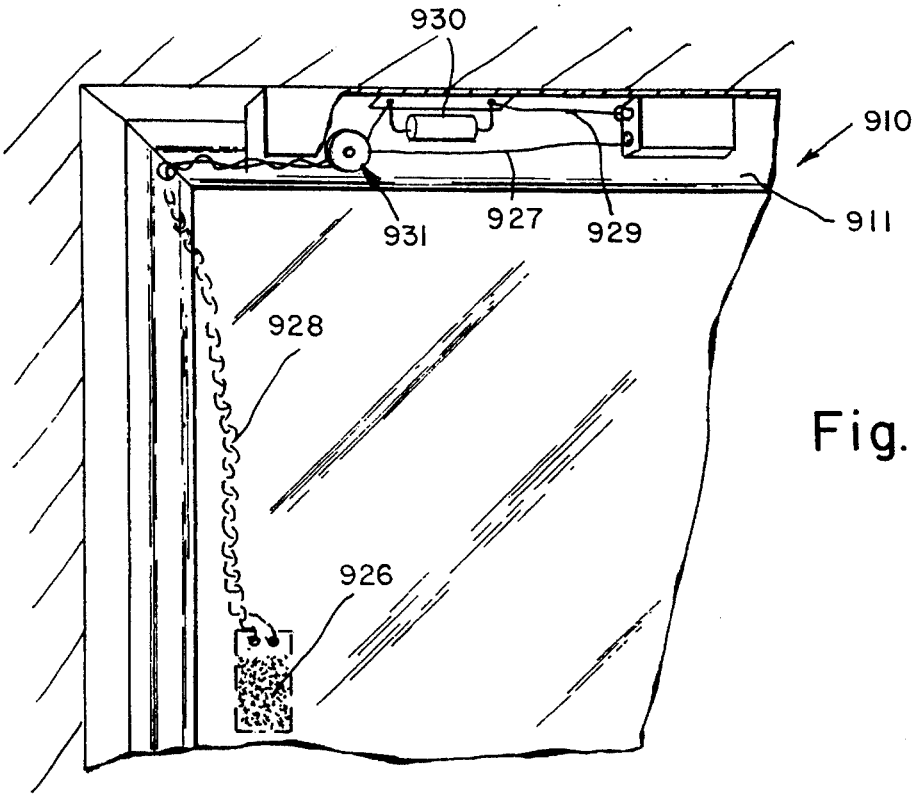
Fig. 41.

Fig. 50.
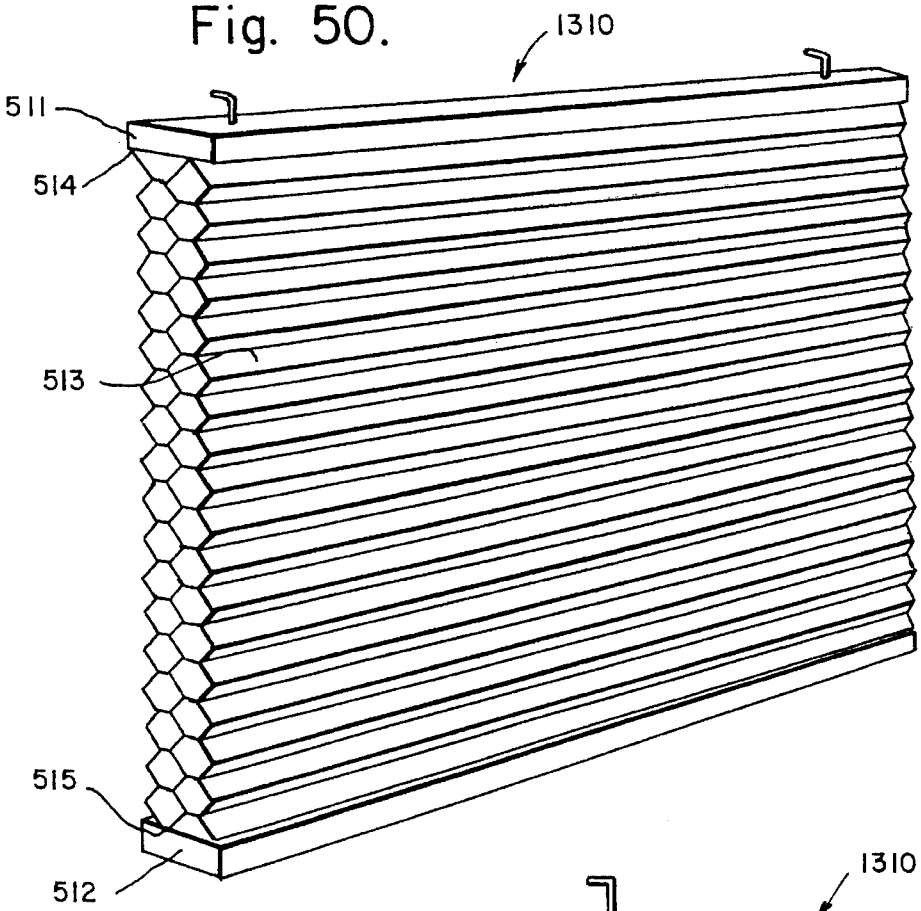
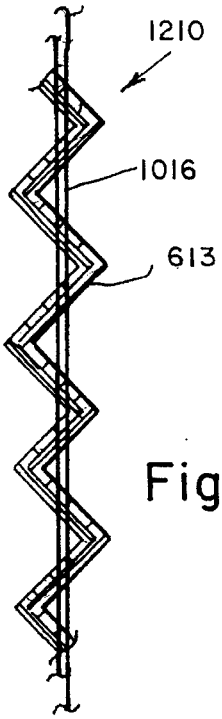
Fig. 49.
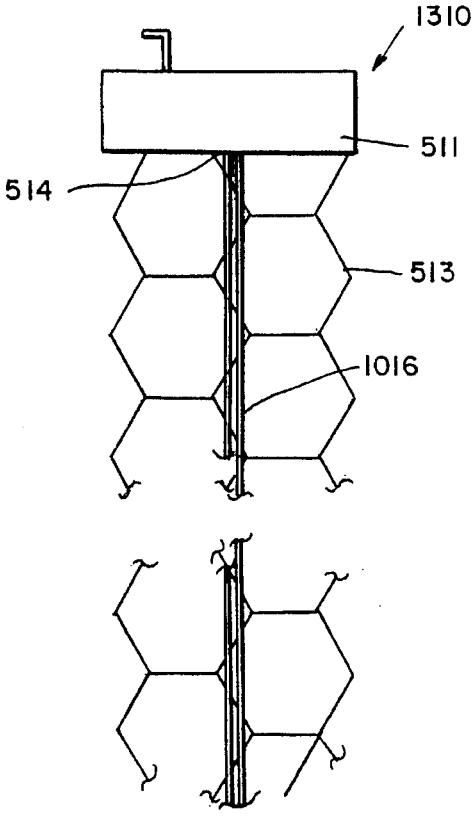
Fig. 51.

Fig. 56.
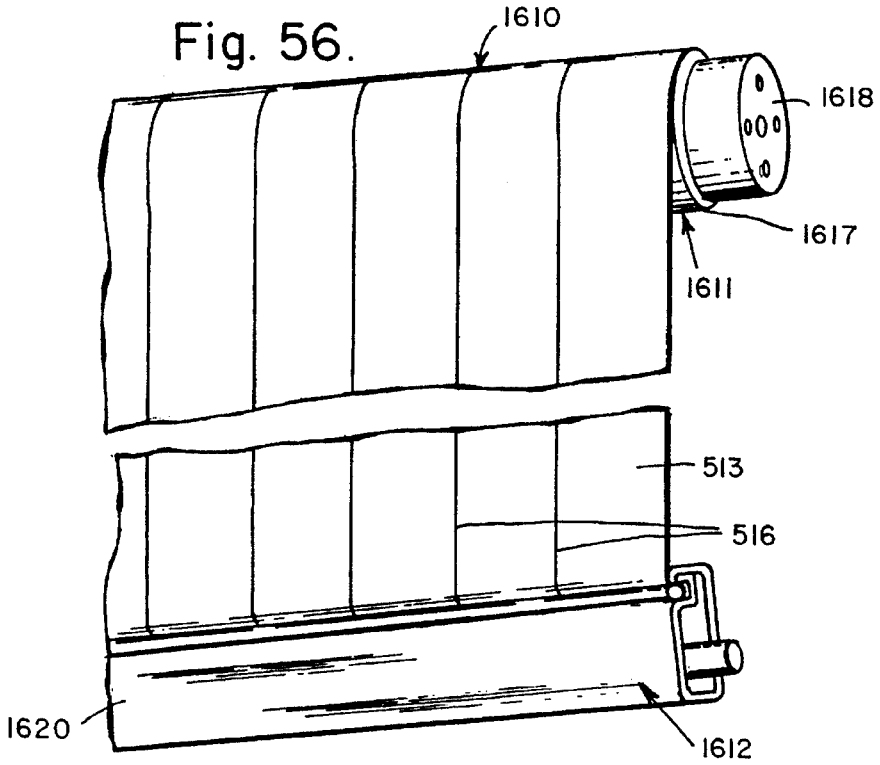
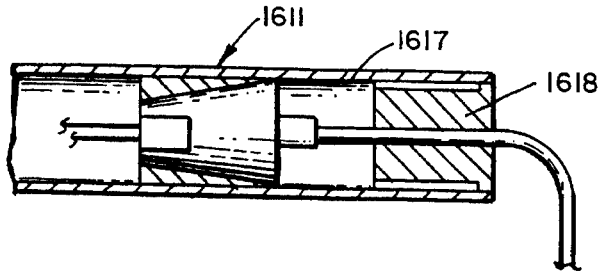
Fig. 57.
Fig. 58.
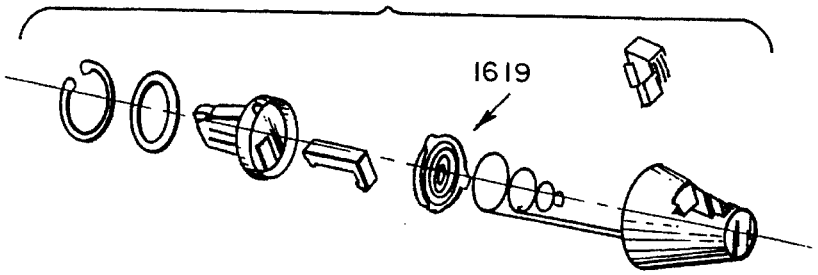
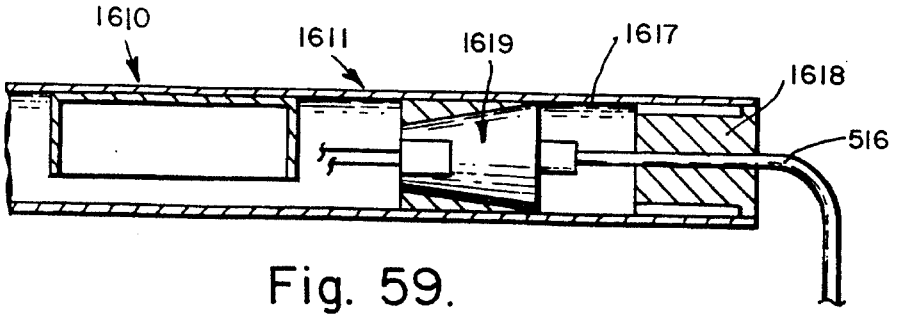
Fig. 59.

Fig. 71.
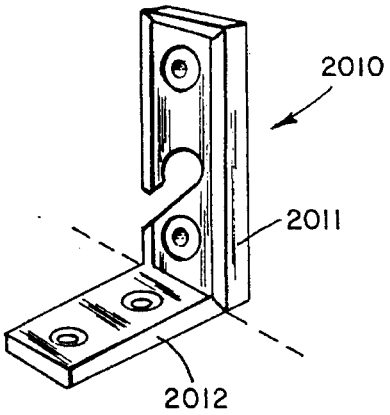
Fig. 72.
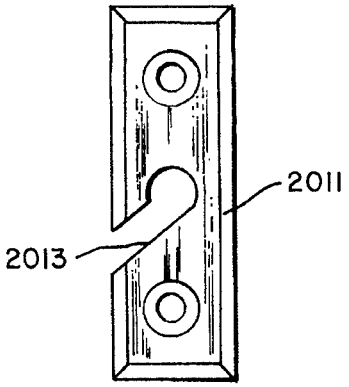
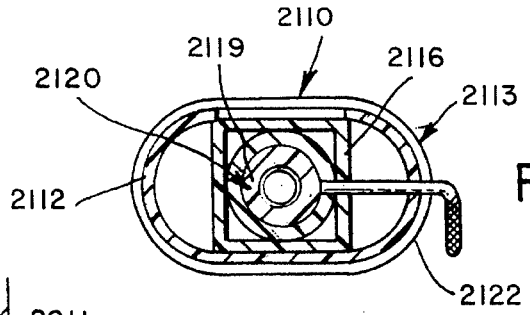
Fig. 75.
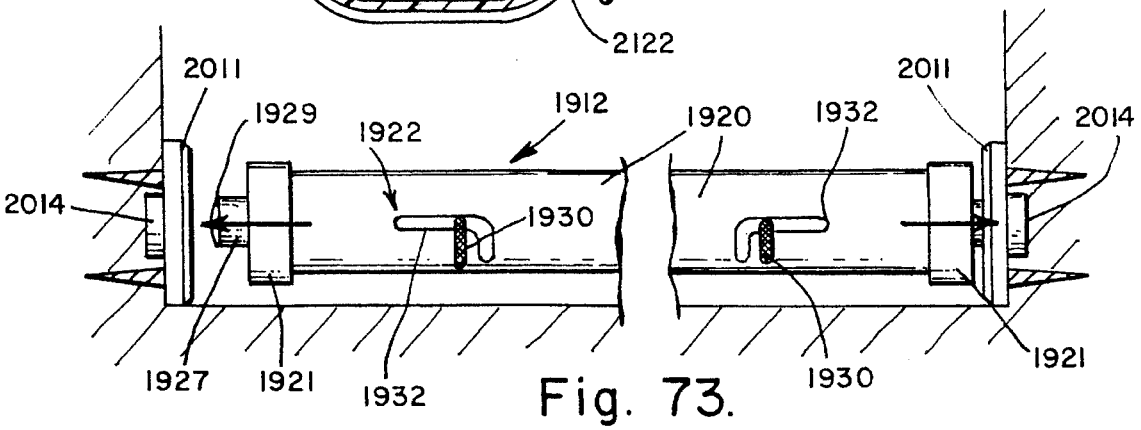
Fig. 73.
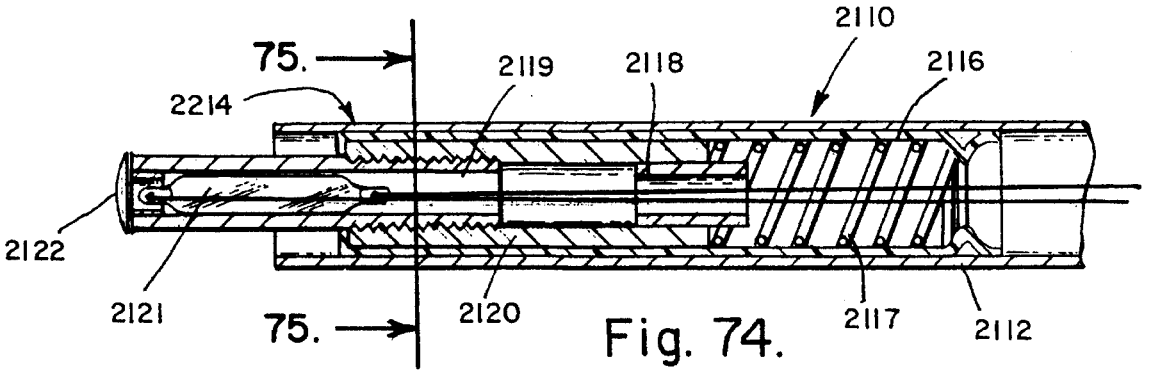
Fig. 74.

Fig. 92.
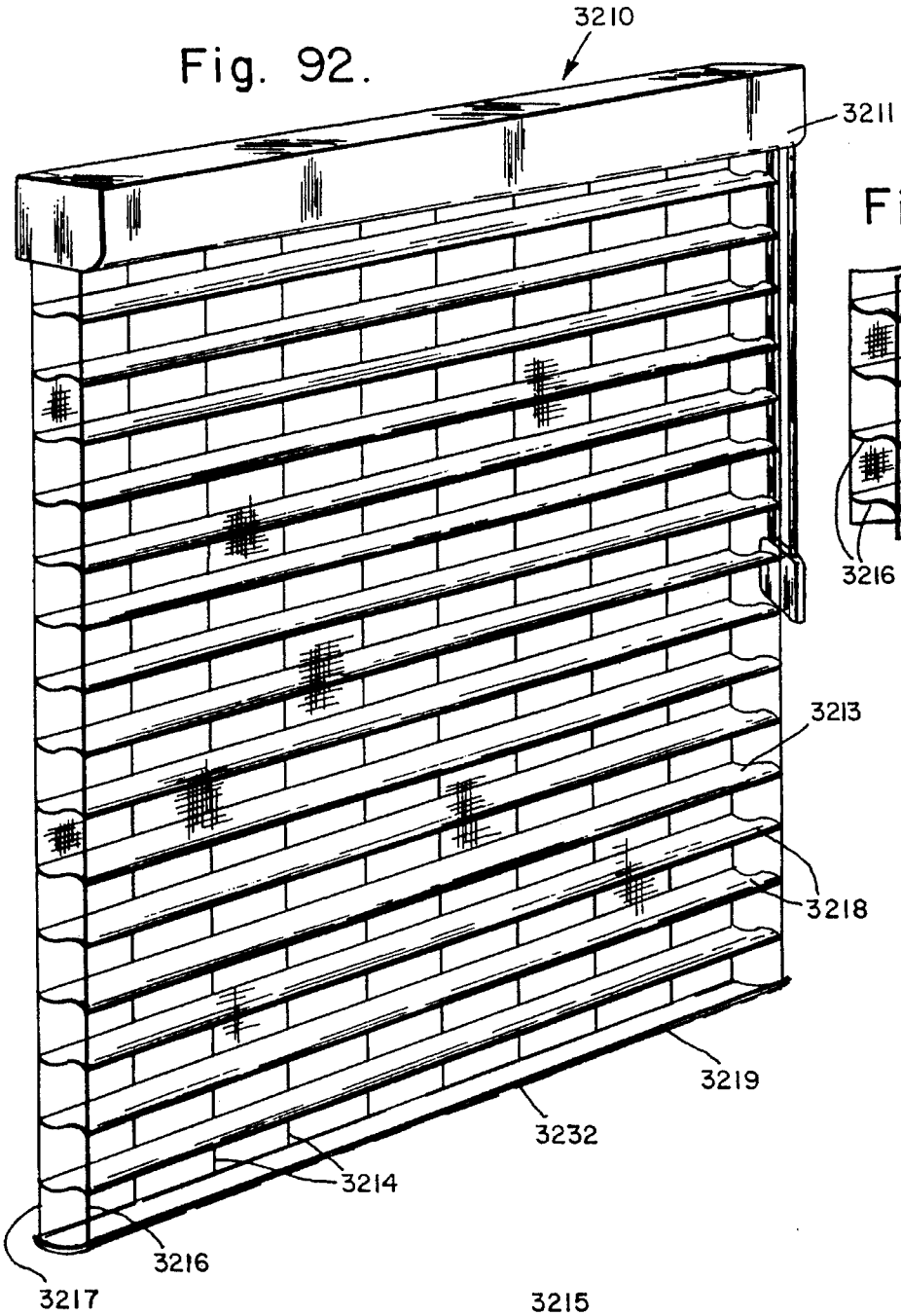
Fig. 95.
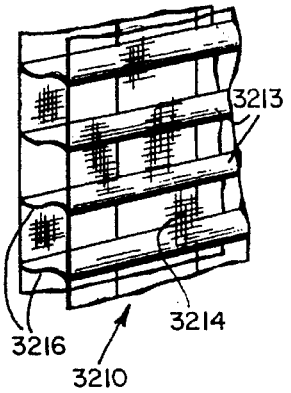
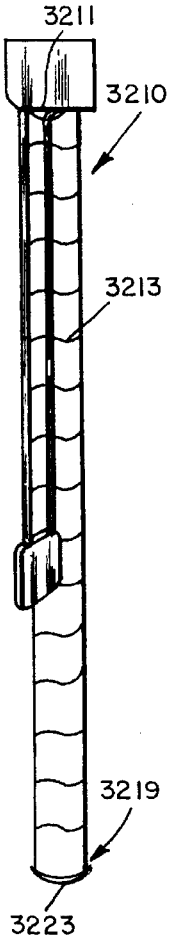
Fig. 93.
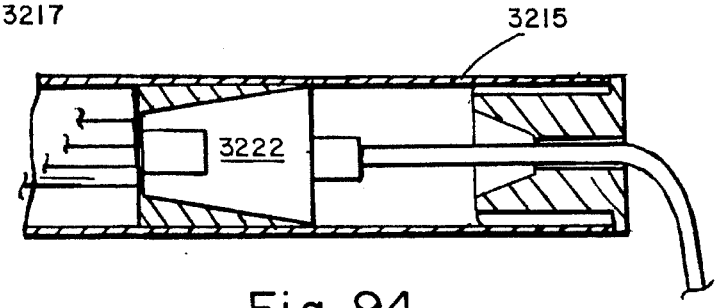
Fig. 94.

Fig. 106.
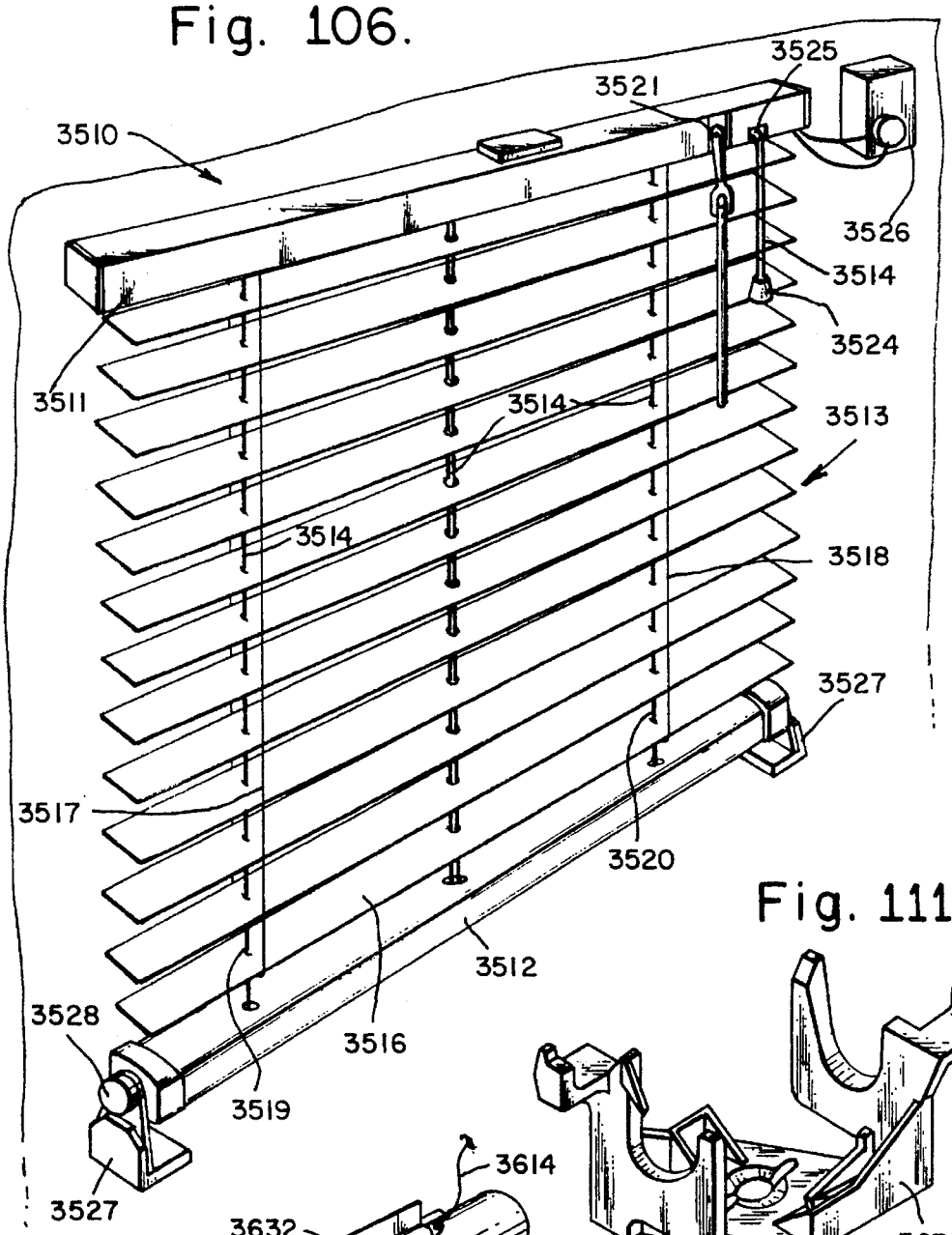
Fig. 111.
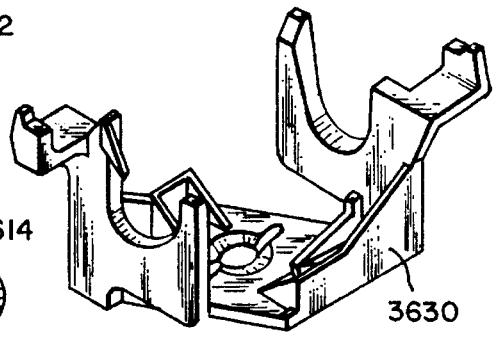
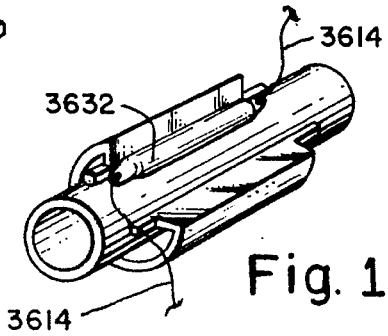
Fig. 114.
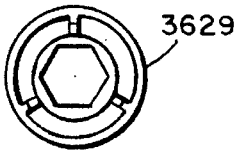
Fig. 113.
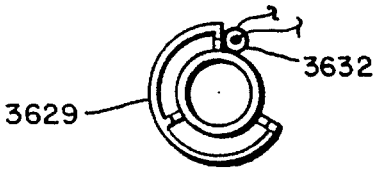
Fig. 115.

COMBINED ALARM SYSTEM AND WINDOW COVERING ASSEMBLY

This application is a continuation-in-part of the application, filed Jul. 28, 1992 under Ser. No. 07/920,837, now U.S. Pat. No. 5,440,289, which is a continuation-in-part of the application, filed Feb. 5, 1992 under Ser. No. 07/831,861, now U.S. Pat. No. 5,274,357.

BACKGROUND OF THE INVENTION

The field of the invention is combined alarm systems and window covering assemblies.

There are a number of combined alarm systems and window covering assemblies which have been proposed. These combined alarm systems and window covering assemblies include a blind assembly which has a taut trip element which sets off an alarm device if the blind assembly is moved, a screen mesh has a conductive wire which is mechanically thereto and which actuates an alarm device if the conductive wire is cut or shorted or subjected to a physical force, a window grille which defines an electrical capacitance field which is distorted to set off an alarm device upon the physical deformation of the window grille by an attempted intrusion, either a combined alarm system and roller-blind assembly or a combined alarm system and roller-screen assembly which, when raised, actuates an alarm device, and various types of other mechanical or magnetic switching arrangements which are actuated to set off an alarm device when an unauthorized attempt is made to open either a barrier or a window.

In general, however, the known combined alarm systems and window covering assemblies are not entirely satisfactory for one or more of the following reasons. Some of these combined alarm systems and window covering assemblies do not provide for convenient arrangements for opening the barrier and disabling the alarm device by an authorized user. Other combined alarm systems and window covering assemblies are of complicated and therefore expensive constructions. Most combined alarm systems and window covering assemblies are of unpleasant external appearance.

U.S. Pat. No. 4,160,972 teaches a combined alarm system and blind assembly which includes a magnetic reed switch which is normally open and which is mounted on the bottom of a bottom railing. A magnet is mounted in a window sill to hold the magnetic reed switch normally closed when the combined alarm system and blind assembly is in its normal position. When the magnetic reed switch moves away from the magnet the magnetic reed switch opens.

U.S. Pat. No. 4,281,320 teaches a combined alarm system and blind assembly which includes a plurality of slats which may be compacted to open the combined alarm system and blind assembly. The slats are supported by flexible cords which include electrical conductors establishing an electrically-conductive pathway through the length of the window blind. The lower end of the combined alarm system and blind assembly carries a retaining mechanism which retains the combined blind assembly and burglar alarm in its closed position. A circuit-interrupting mechanism is effective when the combined alarm system and blind assembly is raised or severed to actuate an alarm device. The retaining mechanism and the circuit interrupting mechanism include magnetic retainer elements which are adapted to actuate magnetic reed switches which are carried at the lower ends of the combined alarm system and blind assembly.

U.S. Pat. No. 4,940,070 teaches a blind assembly in which a string ladder support system on each side supports the individual slats. A main pull string at each ladder support system extends down through holes in each slat to a bottom rail where it is attached. The main pull string goes through the top housing and down over a roller so that the main pull string can raise and lower the blind assembly.

U.S. Pat. No. 4,487,243 teaches a blind assembly which has a lift cord lock. U.S. Pat. No. 4,945,970 teaches a cord lock unit for use in a blind assembly. U.S. Pat. No. 4,660,612 teaches a cord lock for a blind assembly. U.S. Pat. No. 4,802,644 teaches a bracket which releasably secures a channel section head-rail of blind assembly to a wall. U.S. Pat. No. 4,363,459 teaches a bracket for use with a blind assembly. U.S. Pat. No. 4,722,383 teaches a cord lock for locking a blind assembly in its raised position only. U.S. Pat. No. 5,002,113 teaches a blind assembly. U.S. Pat. No. 4,476,909 teaches a cord lock for a blind assembly. U.S. Pat. No. 4,541,468 teaches a tilting mechanism. U.S. Pat. No. 4,386,644 teaches a first tilting mechanism which includes a tilt rod, a cap which is mounted to one end of the head and which includes a bushing, a sleeve which is connected to the tilt rod and which is rotatably supported in the bushing, and a worm gear which is located within the cap and which is connected to the sleeve, and a worm on a shaft which is accessible from outside the cap and which is operatively connected to the worm gear for rotating the worm gear by means of a wand. U.S. Pat. No. 4,386,644 also teaches a second tilting mechanism which includes a sprocket wheel and a bead chain. U.S. Pat. No. 4,621,673 teaches a tilting mechanism for a blind assembly. U.S. Pat. No. 5,176,193 teaches a venetian blind assembly which includes a headrail, a series of horizontal tiltable slats and a bottom rail.

U.S. Pat. No. 4,697,630 teaches a tilt mechanism for monocontrol Venetian blinds uses band brakes to the ends of which the ladder cords are attached. The weight of the blind provides the tightening forces to cause the band brakes to grip the rotating control rod and rotate the slats to open and close the blind. Stops loosen the band brakes allowing further rotation for raising or lowering of the blind to take place with a minimum of torque.

U.S. Pat. No. 4,644,990 teaches an apparatus for automatically moving a set of venetian blinds between open or closed positions in response to sensing a predetermined level of solar energy imposed on the window across which the venetian blinds are to be disposed.

U.S. Pat. No. 4,623,012 teaches a capstan based system for pulling and accumulating the pull-cords used to lift hanging window coverings from their bottoms. A cylindrical capstan is supported in bearings so that it is free to rotate and move axially. A splined connection to a holding device permits controlled rotation and locking of the capstan. Each of one or more cords is attached to the capstan by means of a clip which can be easily positioned to adjust the position and length of its cord. As the capstan is turned, the cords wind onto the capstan in a single layer due to the camming action of a specially configured camming surface. The capstan begins to move laterally when sufficient friction has developed between the capstan and the cord which has been wound onto it. This provides space for the cord to wind onto the capstan in a single layer. During unwinding of the cord, a guiding surface, over which the cord moves, pulls the capstan back toward its original position. The camming and guiding surfaces can be made symmetric so that bi-directional operation of the system is possible.

U.S. Pat. No. 4,582,109 teaches an accordion fold type decorative fabric drapery system which has a pair of drapery sections of decorative weave fabric sheets specially formed into sharply pleated accordion-like folds to provide a large number of vertically elongated narrow panels resembling in size the slats or louvers of a vertical blind system. U.S. Pat. No. 4,677,013 teaches a honeycomb structure which is formed of a continuous length of foldable material which is folded into a Z-configuration and which is stacked in layers which are adhered together. These layers form longitudinally extending cells, one on top of the other, of the honeycomb structure. U.S. Pat. No. 4,861,404 teaches a honeycomb product. U.S. Pat. No. 4,687,039 teaches a pleated shade in which there is a vacuum deposited aluminized surface. The first and second pleated sheets are arranged so that the corresponding aluminized surfaces face one another within the second pleated shade so that the second pleated shade has a significant resistance to heat loss or gain, if properly installed, and is decorative and distinctive in appearance. U.S. Pat. No. 4,982,776 and U.S. Pat. No. 4,913,210 teach a cord lock for a pleated shade. U.S. Pat. No. 4,974,656 teaches a pleated shade. U.S. Pat. No. 4,913,210 teaches a cord lock for a pleated shade.

U.S. Pat. No. 4,843,375 teaches a roll-up alarm screen assembly for use in a frame which has a first magnet disposed in its bottom portion and a second magnet disposed in its top portion. The roll-up alarm screen assembly includes an alarm screen and a roll-up mechanism which rolls the alarm screen up and down. The alarm screen includes a screen mesh and a conductive wire which is mechanically coupled to the screen mesh. The roll-up alarm screen assembly also includes a first magnetic coupler and a second magnetic coupler. The first magnetic coupler electrically couples severed ends of conductive wire when the first magnetic coupler is disposed adjacent to the first magnet. The second magnetic coupler electrically couples severed ends of conductive wire when the second magnetic coupler is mechanically coupled to the roll-up mechanism and is positioned so that the second magnetic coupler is disposed adjacent to the second magnet in order to detect any movement of either the roll-up mechanism or the screen mesh.

U.S. Pat. No. 4,839,632 teaches a combined alarm system and screen assembly which has mounting brackets at the corners and a pair of substantially rigid opposite end piece assemblies on which a screen mesh can be rolled up. At each corner a circuit closing mechanism acts between the bracket there and the adjacent end piece assembly to close circuit of an alarm device through electrical wiring in the screen only when that end piece assembly is held by the bracket. U.S. Pat. No. 5,176,194 teaches a roller screen unit. U.S. Pat. No. 3,911,990 teaches a window and screen combination.

U.S. Pat. No. 4,146,293 teaches a combined alarm system and screen assembly includes a frame and a screen mesh. The combined alarm system and screen assembly includes a continuous length of conductive wire which may be sewn, glued or interwoven onto the screen mesh in order to fix it in place and which provide a series circuit. U.S. Pat. No. 4,232,310, U.S. Pat. No. 3,051,935 and U.S. Pat. No. 5,005,000 all teach combined alarm system and screen assemblies in which the continuous length of conductive wire may be interwoven, glued by an air hardening process and/or sewn onto the screen mesh.

U.S. Pat. No. 4,234,875 teaches a security panel arrangement for use with an intrusion alarm system which is designed to monitor the continuity of a normally continuous signal conductive path and to produce a warning signal when the signal conductive path is broken, which arrangement includes a cellular panel forming a series of parallel elongated passages through which extends at least one means for conducting a signal. The cellular panel is attached to a surface portion of a structure to be secured, and the means for conducting a signal is connected at its two ends to the alarm system in a continuity monitoring relationship therewith. Passage of a human being through the surface portion breaks the continuity of the means for conducting a signal and causes the alarm system to produce the warning signal.

U.S. Pat. No. 4,293,778 teaches a partially conductive security screen arrangement for use with an intrusion alarm system designed to operate in a normally closed sensing circuit condition and to produce a warning signal when the sensing circuit is broken, which arrangement includes conductive means overlying and bonded to a mesh screen positionable to cover an opening in a building. The conductive means is connectible at its two ends to the sensing circuit in a series relationship with the remainder of that circuit. The conductive means is positioned on the screen in a configuration preventing passage of a human being through the screen unless the conductive means is severed. Passage of a human being through the opening while the screen is in position to cover the opening therefore breaks the sensing circuit to produce a warning signal. One or more electrical switches located within a frame at the periphery of the screen may also be connected in a series relationship with the remainder of the sensing circuit, the switches being adapted to close for the screen in position covering the opening in the building and to open for the screen moved out of that position. The conductive means may include a plurality of parallel longitudinal lengths of wire connected in series with each other and with one or more transverse lengths of wire. The respective lengths of wire may be mechanically interlocked with each other and with the mesh screen at the points of intersection therebetween.

U.S. Pat. No. 4,372,432 teaches a bi-directional clutch, particularly useful in window shade applications. The bi-directional clutch includes a first or core member and an unwrap spring, that is, a spring having an inside diameter somewhat smaller than the diameter of the core, the spring being wound around the core. The unwrap spring has a number of helical turns and spring tangs which extend outwardly past the circumference of the spring and generally perpendicular to the axis of the spring. The spring is controlled by a second, control or driving member which, when rotated, applies force to one or the other of the spring tangs to unwrap or loosen the spring, thereby allowing the spring to rotate relative to the core. As the spring rotates, one of the spring tangs abuts a third or driven member. The third or driven member is rotated by the spring, allowing the third member to rotate relative to the first or core member. The third or driven member continues to rotate, relative to the first or core member, until the second, control or driving member stops rotating. However, when the driven member is rotated directly, the spring is locked onto the core member and further rotation of the driven member is prevented.

U.S. Pat. No. 4,433,765 teaches a spring clutch which has multiple springs disposed between two coaxially mounted cylindrical elements. The springs are designed to slip so that all of the springs are required to support the maximum load. During the onset of rotation, tabs at the ends of the springs contact the load surfaces on one of the cylindrical elements sequentially, with some slippage occurring, so that impulse is reduced.

U.S. Pat. No. 4,275,294 teaches a security system and strip or strand which incorporates an optical fiber wave-guide. To provide security against unauthorized crossing of a boundary, at least one optical fiber wave-guide extends along the boundary. Light is directed into one end of the optical fiber wave-guide and the light leaving the optical fiber wave-guide is detected by an optical detector. An indication is given when the optical intensity of the detected light falls below a predetermined threshold, so as to warn when the optical fiber wave-guide is disturbed significantly or cut through.

U.S. Pat. No. 4,367,460 teaches a transparent continuous optical fiber which is embedded in a transparent panel made of glass or plastic, with the two ends of the optical fiber accessible from outside the panel for coupling to a visible or invisible light source and detector respectively. By nearly matching the refractive indices of the panel and the optical fiber, and using good-quality material for the fiber so that it does not scatter significant amounts of the light passing through it, the optical fiber can be made virtually invisible although it establishes a complete light circuit. Cutting or breaking through the panel at a point intersecting the optical fiber interrupts the light circuit and triggers an alarm.

U.S. Pat. No. 5,049,855 teaches a security screen assembly which includes a screen of mesh material with an optical path formed from at least one optical fiber integrally interwoven with the screen material in a generally serpentine path. A light souce or transmitter is coupled to the first end of the optical path while a suitable light detector is coupled to detect light emitted from a second end of the optical path. An interface control unit connects the security screen assembly to a remote alarm control unit for activating an alarm if the detected light signal falls below a predetermined intensity.

U.S. Pat. No. 4,999,608 teaches an electrically conductive security screen which includes an electrical resistance sensor and alarm to detect tampering with the screening material of a window. An elongated path of flexible and electrically conductive coating composition is applied to the screening material in a predetermined and non-overlapping pattern, such that a closed circuit loop is formed when it is attached to the sensor alarm. The coating has an electrical resistance that varies when it is distorted or its path interrupted.

SUMMARY OF THE INVENTION

The present invention is generally directed to a combined alarm system and window covering assembly which is visually identical to a window covering assembly having a top housing, a bottom rail and a covering and which has an alarm element extending from the top housing down to the bottom rail and up from the bottom rail to the top housing. The alarm element may be either a conductive wire or an optical fiber and is used as a main pull string for raising and lowering the covering and the bottom rail.

In a first aspect two resiliently biased reed relay switches each of which is mechanically coupled to one of the ends of the bottom rail and which are electrically coupled to the alarm element.

In a second aspect a resiliently biased reed relay switch is mechanically coupled to the top housing and is electrically coupled to the alarm element.

In a third aspect a plurality of slats form the covering and a tilting mechanism is disposed in the top housing and mechanically coupled to the slats.

In a fourth aspect the alarm element is a conductive wire and a roll-up mechanism and a rotatable electrical connector are disposed in the top housing. The roll-up mechanism raises and lowers the covering and the bottom rail. The rotatable electrical connector is electrically coupled to the conductive wire.

In a fifth aspect the alarm element is an optical fiber and an optical switching assembly which includes a light bulb and an optical relay switch is optically coupled to the optical fiber.

In a sixth aspect a roll-up mechanism and a rotatable electrical connector are disposed in the top housing. The roll-up mechanism raises and lowers the covering and the bottom rail. The rotatable electrical connector is electrically coupled to the optical switching assembly.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 1 is a perspective drawing of a combined alarm system and blind assembly which includes a top housing assembly, a bottom housing assembly, including a first bottom rail and a second bottom rail, and a conductive wire.

FIG. 2 is a partial elevational view in cross-section of the combined alarm system and blind assembly of FIG. 1 taken along line 2—2 of FIG. 1.

FIG. 30 is a perspective drawing of a combined alarm system and screen assembly which includes a top housing assembly, a bottom housing assembly, a screen mesh and a conductive wire.

FIG. 31 is a partial side elevational view in cross-section of the bottom bracket assemblies of the combined alarm system and screen assembly of FIG. 30.

FIG. 32 is a schematic diagram of the conductive wire of the combined alarm system and screen assembly of FIG. 30.

FIG. 33 is a side elevational view in cross-section of the bottom housing assembly of the combined alarm system and screen assembly of FIG. 30 after it has been inserted into a bottom bracket assembly thereof.

FIG. 34 is a perspective drawing of one of two caps of each of the top and bottom housing assemblies.

FIG. 35 is a perspective drawing of a top bracket assembly for use with any of the combined alarm system and window covering assemblies including the combined alarm system and shade assembly of FIG. 21, the combined alarm system and shade assembly of FIG. 24 and the combined alarm system and screen assembly of FIG. 30.

FIG. 39 is a partial side elevational view in cross-section of the top bracket assembly of FIG. 35 showing a smoke detector including a battery and a smoke detecting circuit.

FIG. 40 is a partial bottom plan view of the top bracket assembly of FIG. 35 showing the smoke detector of FIG. 39.

FIG. 41 is a schematic drawing of a solar battery charging system for use in any of the combined alarm systems and window covering assemblies.

FIG. 49 is a partial side elevational view in cross-section of the combined alarm system and shade assembly of FIG. 48.

FIG. 50 is a perspective drawing of a combined alarm system and shade assembly which includes a double honeycomb shade and an optical fiber.

FIG. 51 is a partial side elevational view of the combined alarm system and shade assembly of FIG. 50.

FIG. 55 is a partial perspective drawing of a combined alarm system and blind assembly which includes an optical fiber having been substituted in place of the conductive wire in the combined alarm system and blind assembly of FIG. 1.

FIG. 56 is a perspective drawing of a combined alarm system and roll-up screen assembly which includes a top assembly having a rotating rail, a roll-up mechanism and a conductive wire.

FIG. 57 is a side elevational view in cross-section of the rotating rail of FIG. 56 which includes a rotatable electrical connector having two internal leads.

FIG. 58 is an exploded perspective drawing of the cross-section of the rotating rail of FIG. 56.

FIG. 59 is a side elevational view in cross-section of the rotating rail of FIG. 56 which includes a rotatable electrical connector and alarm circuit.

FIG. 71 is a perspective drawing of a mounting bracket having a breakaway base.

FIG. 72 is a side elevational view of the mounting bracket of FIG. 71 after the breakaway base has been removed.

FIG. 73 is a fragmented perspective drawing of a bottom housing assembly for use in a combined alarm system and window covering assembly.

FIG. 74 is a fragmented longitudinal view in cross-section of the bottom housing assembly of FIG. 73.

FIG. 75 is a cross-sectional view of the bottom housing assembly of FIG. 70 taken along the line 75—75 of FIG. 74.

FIG. 92 is a perspective view of a combined alarm system and blind assembly which includes a top assembly having a rotating rail and a continuous length of conductive wire in accordance with the thirty fourth embodiment.

FIG. 93 is a side elevational view of the combined alarm system and blind assembly of FIG. 91.

FIG. 94 is a front elevational view in cross-section of the rotating rail of FIG. 56 which includes a rotatable electrical connector.

FIG. 95 is a partial perspective view of a combined alarm system and blind assembly which includes a continuous length of optical fiber in accordance with the thirty fifth embodiment.

FIG. 102 is a side elevation of a mercury switch in a first position.

FIG. 103 is a side elevation of the mercury switch of FIG. 102 in a second position.

FIG. 104 is a side elevation of a reed relay-type switch for an optical fiber in a first position.

FIG. 105 is a side elevation of the reed relay-type switch for an optical fiber of FIG. 104 in a second position.

FIG. 106 is a perspective drawing of a combined alarm system and blind assembly which includes a plurality of slats, a top housing assembly including a first resiliently biased reed relay switch, a bottom rail including two first resiliently biased reed relay switches and a conductive wire in accordance with the first embodiment.

FIG. 111 is a perspective drawing of a boat support for use in the second resiliently biased reed relay switch of FIG. 109.

FIG. 113 is an end view of the boat of FIG. 112.

FIG. 114 is a perspective drawing of the boat of FIG. 112 which has been adapted for use in the second resiliently biased reed relay switch of FIG. 109.

FIG. 115 is an end view of the adapted boat of FIG. 114.

FIG. 120 is a grouping of perspective drawings of pull cords with conductive wires for use in the combined alarm system and blind assemblies of FIG. 106 and FIG. 109.

FIG. 121 is a perspective drawing of a three-ply alarm screen mesh for use in a combined alarm system and window covering assembly in accordance with the third embodiment.

FIG. 122 is a cross-sectional view of the three-ply alarm of FIG. 121 screen mesh taken along line 122—122 of FIG. 121.

Figure 123:
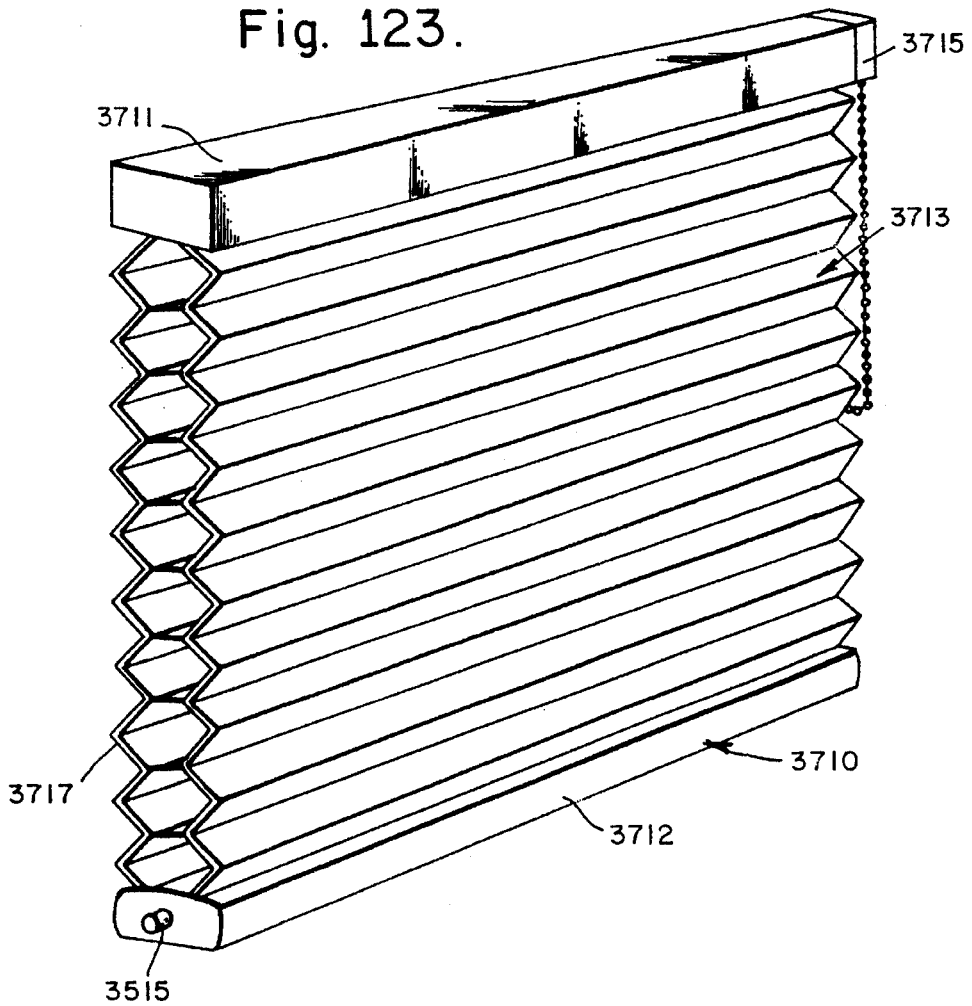

FIG. 123 is a perspective drawing of a combined alarm system and honeycomb shade assembly which includes a honeycomb shade, a top housing assembly including a rotating connector and a capstan based system which U.S. Pat. No. 4,623,012 teaches, a bottom rail including two resiliently biased reed relay switches and a conductive wire in accordance with the fourth embodiment.

Figure 124:
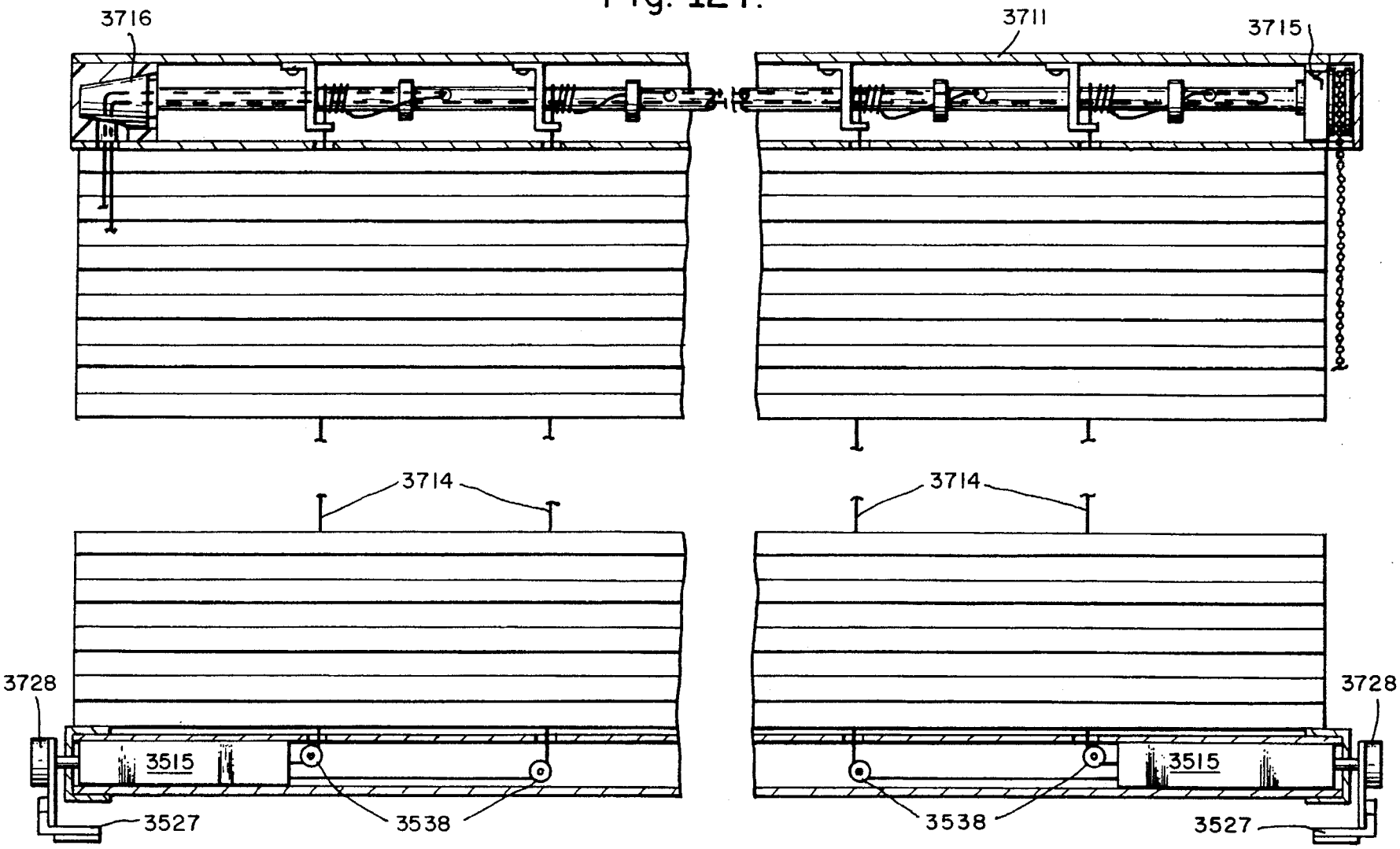

FIG. 124 is an elevational view in cross-section of the combined alarm system and honeycombed shade assembly of FIG. 123.

Figure 125:
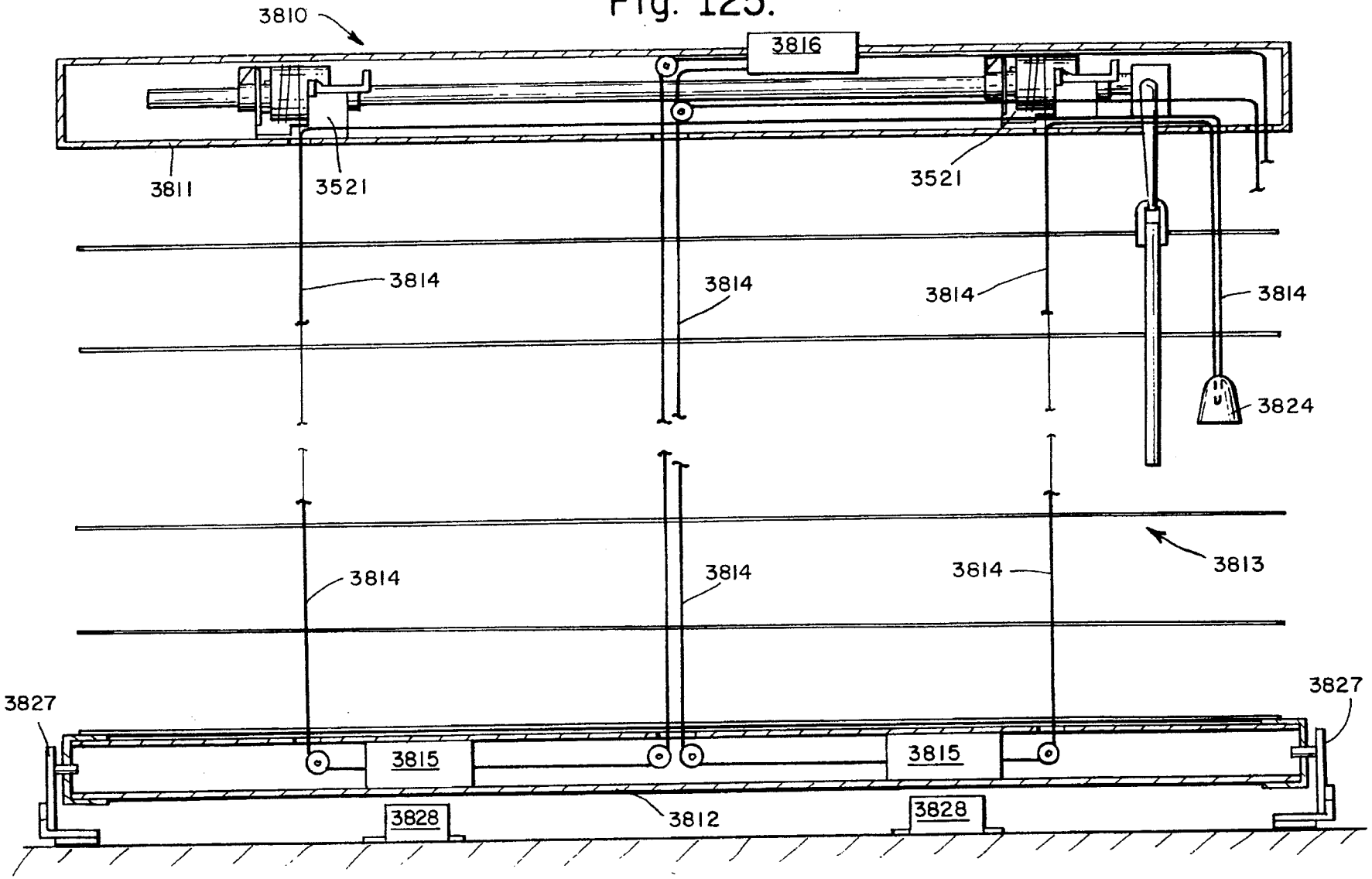

FIG. 125 is an elevational view in cross-section of a combined alarm system and blind assembly which includes a plurality of slats, a top housing assembly, an optical switching assembly, switch, a bottom housing assembly including two resiliently biased optical reed relay switches and an optical fiber in accordance with the fifth embodiment.

Figure 126:
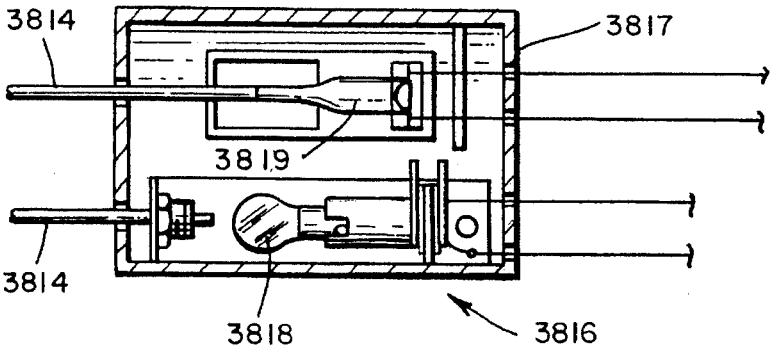

FIG. 126 is a side elevational view in cross-section of the optical switching assembly of FIG. 125 which includes a light bulb, an optical relay switch and a battery providing electrical power to the light bulb and the optical switch.

Figure 127:
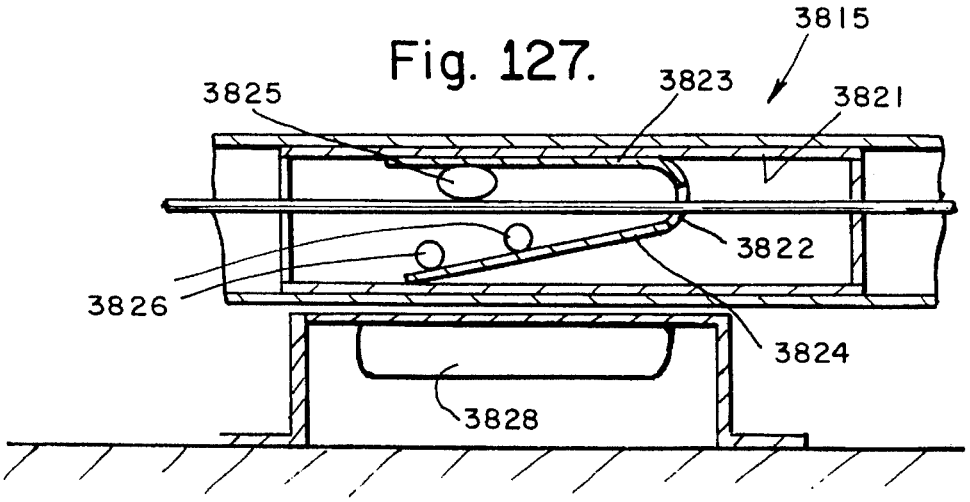

FIG. 127 is a side elevational view in cross-section of the of the resiliently biased optical reed relay switch of FIG. 125.

Figure 128:
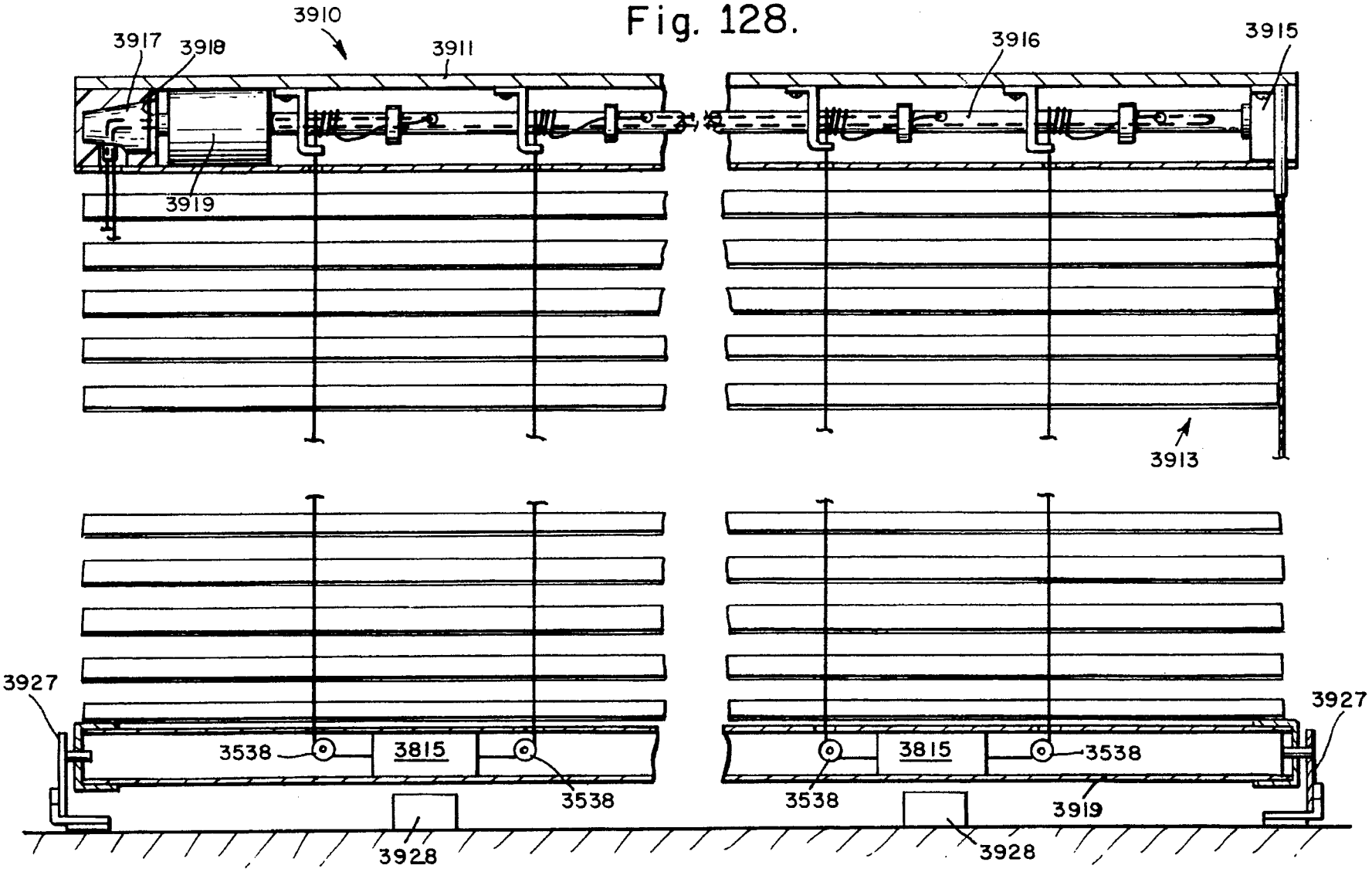

FIG. 128 is an elevational view in cross-section of a combined alarm system and honeycomb shade assembly which includes a honeycomb shade, a top housing assembly including a rotating connector, an optical switching assembly and a capstan based system which U.S. Pat. No. 4,623,012 teaches, a bottom housing assembly including two resiliently biased reed optical relay switches and an optical fiber in accordance with the sixth embodiment.

Figure 129:
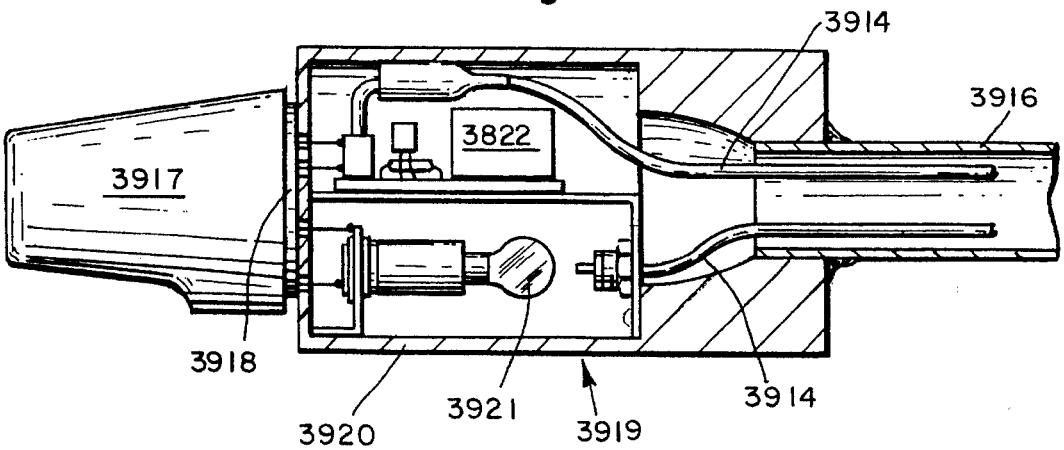

FIG. 129 is a side elevational view in cross-section of the optical switching assembly of FIG. 128 which includes a light bulb, an optical relay switch and a battery providing electrical power to the light bulb and the optical switch.

Figure 130:
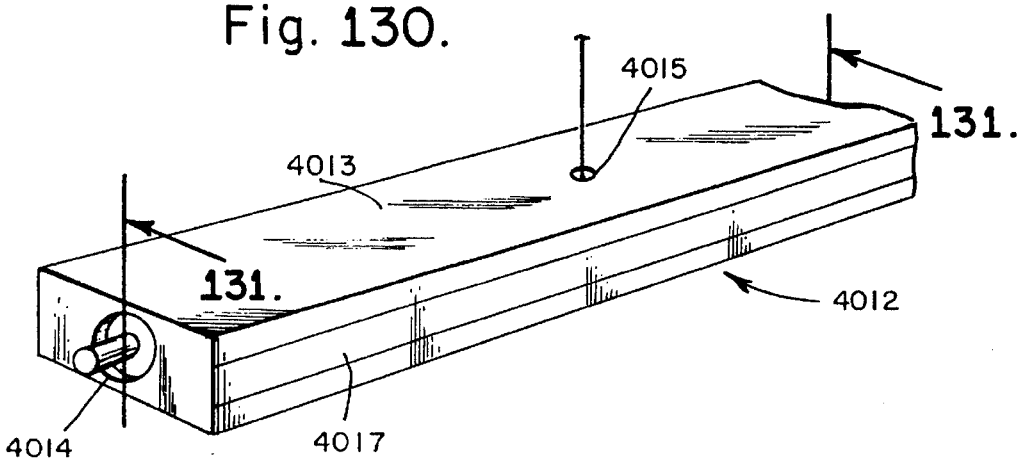

FIG. 130 is a partial perspective drawing of a wooden bottom rail which includes a resiliently biased reed relay switch and a conductive wire in accordance with the seventh embodiment.

Figure 131:
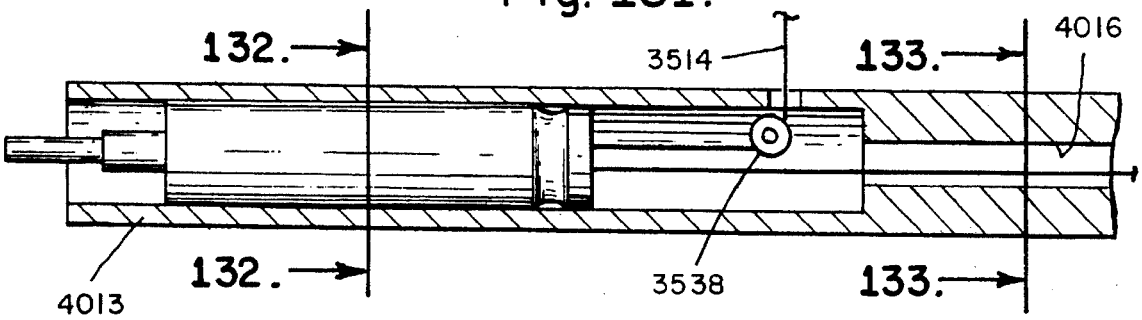

FIG. 131 is a side elevational view in cross-section of the wooden bottom rail of FIG. 130 taken along line 131—131 of FIG. 130.

Figure 132:
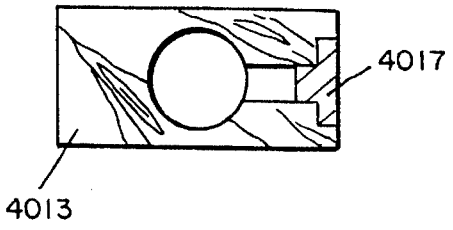

FIG. 132 is a cross-sectional view of the wooden bottom rail of FIG. 130 taken along line 132—132 of FIG. 131.

Figure 133:
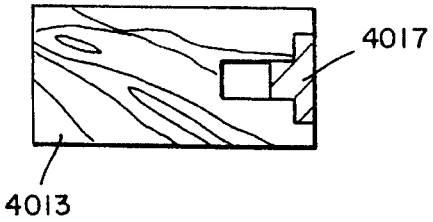

FIG. 133 is a cross-sectional view of the wooden bottom rail of FIG. 130 taken along line 133—133 of FIG. 131.

DESCRIPTION OF THE PREFERRED EMBODIMENT

Figures 3, 4:
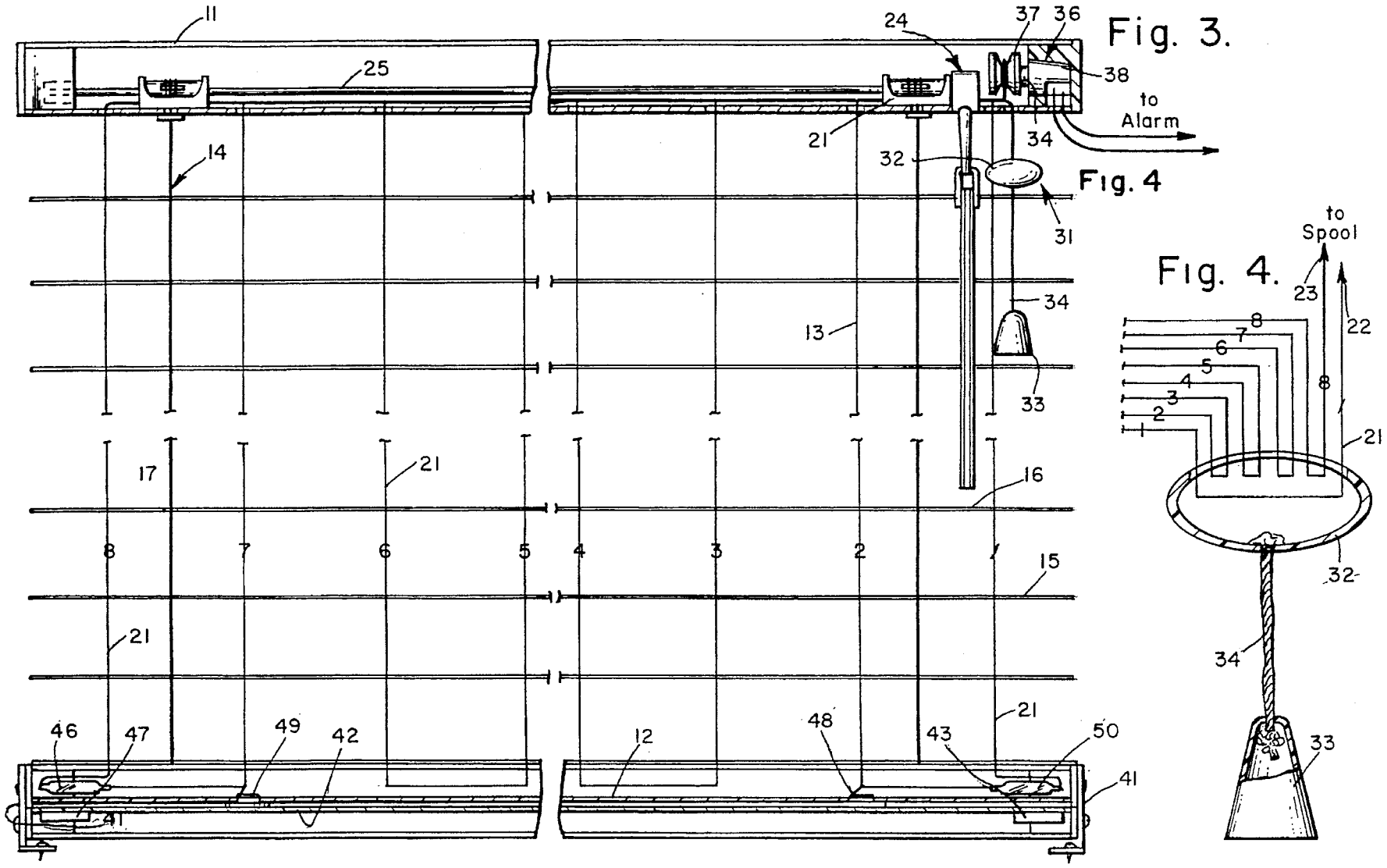
FIG. 3 is an elevational view in cross-section of the combined alarm system and blind assembly of FIG. 1 taken along line 3—3 of FIG. 1.
FIG. 4 is a schematic diagram of the conductive wire of the combined alarm system and blind assembly of FIG. 1.

Referring to FIG. 1 in conjunction with FIG. 2 and FIG. 3 a combined alarm system and blind assembly 10 includes a top housing assembly 11, a bottom housing assembly including a first bottom rail 12, a first string ladder support system 13, a second string ladder support system 14 and a plurality of slats 15. Each slat 15 has a first slot 16 and a second slot 17 which is spaced apart from the first slot 16. Each of the first and second string ladder support systems 13 and 14 has a front vertical ladder string 18 and a back vertical ladder string 19 with short support strings 20 fastened between the front and back vertical ladder strings 18 and 19. The first and second string ladder support systems 13 and 14 are mechanically coupled to the top housing assembly 11 and the first bottom rail 12. Each of the short support strings 20 of the first and second string ladder support systems 13 and 14 supports one of the slats 15 contiguous to the first and second slots 16 and 17, respectively, thereof. A length of conductive wire 21 has a first end 22 and a second end 23 and extends from the top housing assembly 11 down through each of the first slots 16 of the slats 15 to the first bottom rail 12 and from the first bottom rail 12 up through each of the second slots 17 of the slats 15 to the top housing assembly 11. The first top housing assembly 11 has a tilting mechanism 24 and a tilt rod 25 which are disposed in the top housing assembly 11. The tilt rod 25 is mechanically coupled to the tilting mechanism 24 and is fixedly coupled to the first and second string ladder support systems 13 and 14.

Referring to FIG. 3 in conjunction with FIG. 1 and FIG. 4 portions of the conductive wire 21 form part of a pull string assembly 31 for raising and lowering the combined alarm and blind assembly 10. The pull string assembly 31 includes a capsule member 32, a pull tab 33, a cord 34, a cord lock unit 35 and a winding mechanism 36. The cord 34 mechanically couples the pull tab 33 to the capsule 32. The cord lock unit 35 and the winding mechanism 36 are disposed in the top housing assembly 11 and mechanically coupled thereto. The first and second ends 22 and 23 of the conductive wire 21 are threaded through the cord lock unit 35 and the top housing assembly 11 into the capsule member 32. The cord lock unit 35 locks the conductive wire 21 in place. The winding mechanism 36 includes a spool 37, a rotating connector 38 having a shaft 39 to which the spool 37 is fixedly coupled and to which the first and second ends 22 and 23 of the conductive wire 21 are electrically coupled. The winding mechanism 36 winds and unwinds lengths of the conductive wire 21 which become slack when the pull string assembly 31 raises the combined alarm system and blind assembly 10.

Referring to FIG. 3 in conjunction with FIG. 1 and FIG. 2 the combined alarm system and blind assembly 10 also includes a first magnetic reed relay switch 40, two bottom brackets 41, a second bottom rail 42 and a first magnet 43. The two bottom brackets 41 mechanically couple the ends of the second bottom rail 42 to the bottom portion of a structure 44. The combined alarm system and blind assembly 10 further includes two top brackets 45, a second magnetic reed relay switch 46, a second magnet 47, a first wire-anchor 48 and a second wire-anchor 49. The two top brackets 45 mechanically couple the ends of the first top housing assembly 11 to the top portion of the structure 44. The first and second magnetic reed relay switches 40 and 46, respectively, are disposed in the first bottom rail 12 adjacent to the first and second magnets 43 and 47. The first and second magnets 43 and 47 are disposed in the second bottom rail 42 adjacent to each end thereof. The first and second magnetic reed relay switch 40 and 46 electrically couple the severed portions of the conductive wire 21 back together in the presence of the first and second magnets 43 and 47. The first and second wire-anchor 48 and 49 are disposed in the first bottom rail 12 and mechanically coupled thereto so that the first and second wire-anchor 48 and 49 support the portions of the conductive wire 21 adjacent to the first and second magnetic reed relay switch 40 and 46, respectively. The conductive wire 21 makes a plurality of round-trips each of which extends from the first top housing assembly 11 down through each of the first slots 16 of the slats 15 to the first bottom rail 12 and from the first bottom rail 12 up through each of the second slots 17 of the slats 15 to the first top housing assembly 11.

Referring to FIG. 3 in conjunction with FIG. 1 and FIG. 4 an alarm device 50 has a first input terminal 51 and a second input terminal 52. The first and second ends 22 and 23 of the conductive wire 21 are electrically coupled to the first and second input terminals 51 and 52, respectively, of the alarm device 50 through the rotating connector 38.

Figure 5:
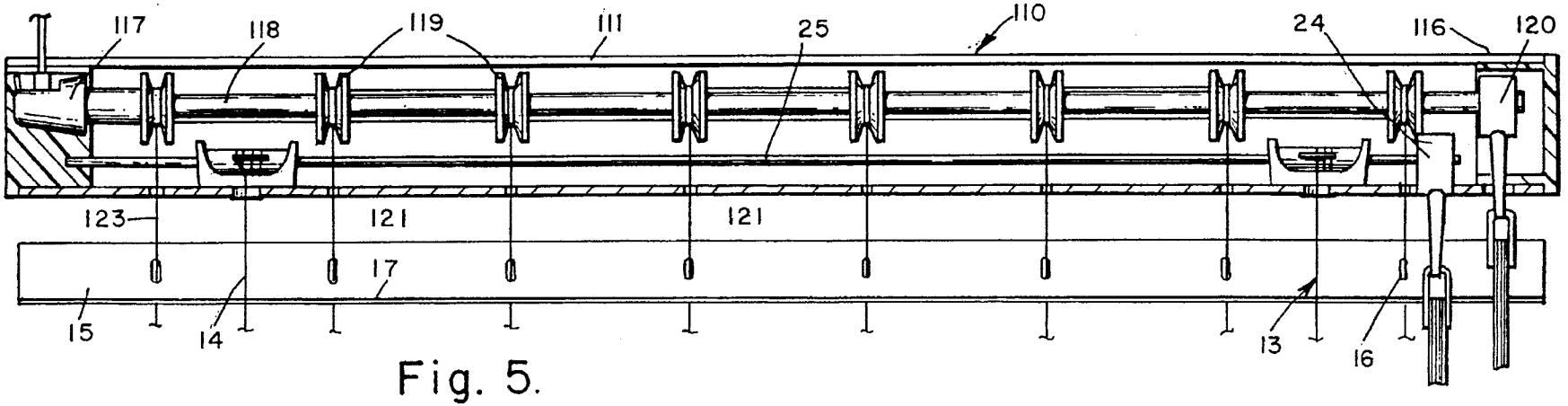
FIG. 5 is an elevational view in cross-section of a combined alarm system and blind assembly which includes a second top housing assembly and a lifting mechanism including a shaft, a plurality of spools and a plurality of vertically disposed conductive wires.
Figure 9:
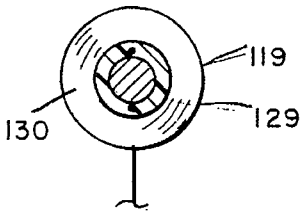
FIG. 9 is a second transverse cross-sectional view of the shaft and one of the spools of FIG. 5 taken along line 9—9 of FIG. 7.
Figure 8:
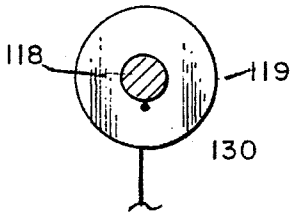
FIG. 8 is a first transverse cross-sectional view of the shaft and one of the spools of FIG. 5 taken along line 8—8 of FIG. 7.
Figure 7:
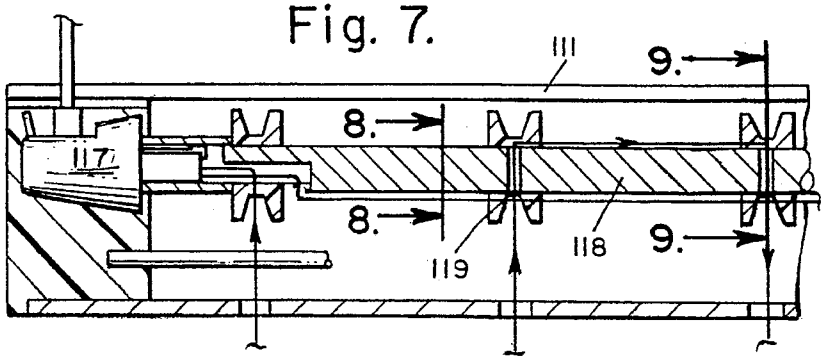
FIG. 7 is a partial elevational view in cross-section of the lifting mechanism of FIG. 5.
Figure 6:
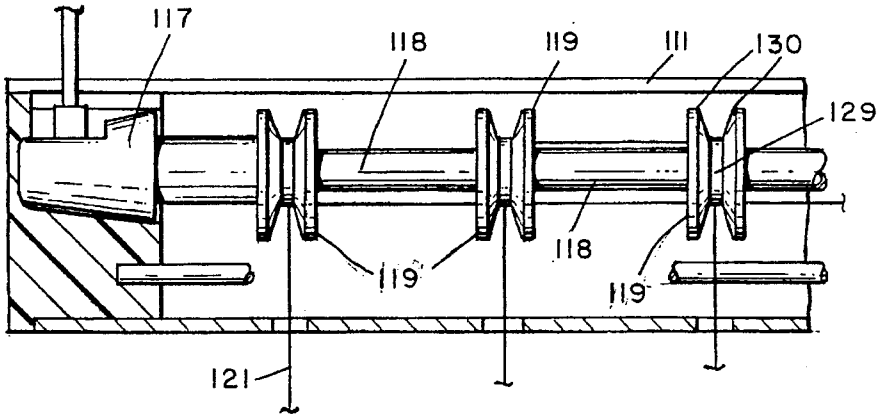
FIG. 6 is a partial elevational view of the lifting mechanism of FIG. 5.

Referring to FIG. 5 in conjunction with FIG. 3 and FIG. 6 a combined alarm system and blind assembly 110 includes a top housing assembly 111, the bottom housing assembly including the first bottom rail 12, the first string ladder support system 13, the second string ladder support system 14, the plurality of slats 15, the tilting mechanism 24, the tilt rod 25 and a lifting assembly 116, the first magnetic reed relay switch 40 and the second magnetic reed relay switch 46. Each slat 15 has a first slot 16 and a second slot 17 which is spaced apart from the first slot 16. The tilting mechanism 24 is disposed in the top housing assembly 111 and mechanically coupled thereto. The tilt rod 25 is fixedly coupled to the first and second string ladder support systems 13 and 14. The first and second magnetic reed relay switches 40 and 46 are disposed in the first bottom rail 12.

Referring to FIG. 5 in conjunction with FIG. 6, FIG. 7, FIG. 8 and FIG. 9 the lifting assembly 116 includes a rotating connector 117, a first shaft 118, a plurality of spools 119 and a winding mechanism 120. The shaft 118 is a solid rod which is disposed in the top housing assembly 111 and which is rotatively coupled to the rotating connector 117. Each spool 119 is disposed in the top housing assembly 111 and is fixedly coupled to the shaft 118. The winding mechanism 120 is disposed in the top housing assembly 111 and is rotatively coupled to the shaft 118. The lifting assembly 116 also includes a first vertically disposed conductive wire 121, a second vertically disposed conductive wire 122, a first horizontally disposed conductive wire 123, a first plurality of horizontally disposed conductive wire 124. The first vertically disposed conductive wire 121 has a first end and a second end. The second vertically disposed conductive wire 122 has a first end and a second end. Each spool 119 has a sleeve 129 which is fixedly coupled to the shaft 118 and two side panels 130 each of which has a first horizontal bore and a second horizontal bore. The first and second ends of the first vertically disposed conductive wire 121 are mechanically and electrically coupled to one of the spools 119 and the first magnetic reed relay switch 40, respectively. The first vertically disposed conductive wire 121 extends from one of the spools 119 in the top housing assembly 111 down through each of the first slots 16 of the slats 15 to the first bottom rail 12. The first and second ends 126 and 127 of the second vertically disposed conductive wire 122 are mechanically and electrically coupled to another spool 119 and the second magnetic reed relay switch 46, respectively. The second vertically disposed conductive wire 122 extends from the first bottom rail 12 up through each of the second slots 17 of the slats 15 to the other spool 119 in the top housing assembly 111. The first and second magnetic reed relay switch 40 and 46 electrically couple severed portions of the first and second vertically disposed conductive wire 121 and 122 back together in the presence of a first magnet 43 and a second magnet 47, respectively. The first and second vertically disposed conductive wire 121 and 122 make a plurality of round-trips each of which extends from the top housing assembly 111 down through each of the first slots 16 of the slats 15 to the first bottom rail 12 and from the first bottom rail 12 up through each of the second slots 17 of the slats 15 to the top housing assembly 111. The winding mechanism 120 winds and unwinds the first and second vertically disposed conductive wire 121 and 122 which otherwise would become slack when the lifting assembly 116 raises the combined alarm system and blind assembly 110.

Figure 10:
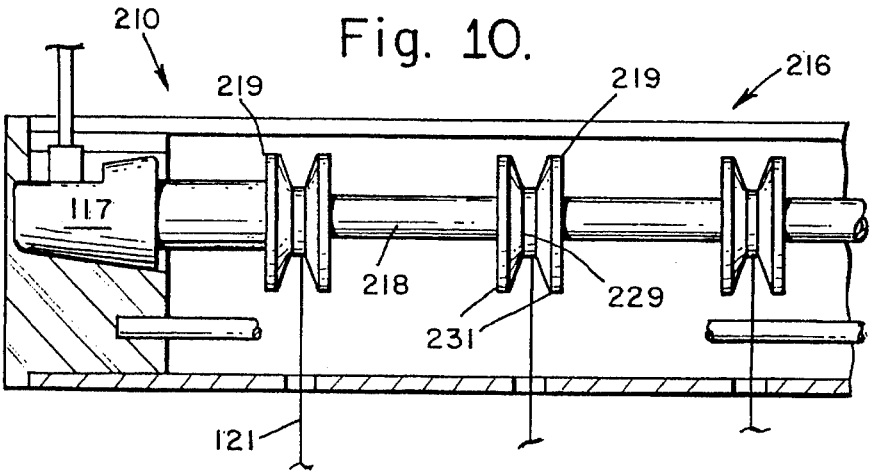
FIG. 10 is a partial elevational view of a combined alarm system and blind assembly which includes a second top housing and a second lifting mechanism including a shaft, a plurality of spools and a plurality of vertically disposed conductive wires.
Figure 12:
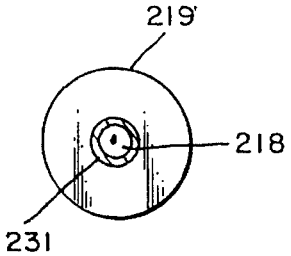
FIG. 12 is a first transverse cross-sectional view of the shaft and one of the spools of FIG. 10 taken along line 12—12 of FIG. 11.
Figure 13:
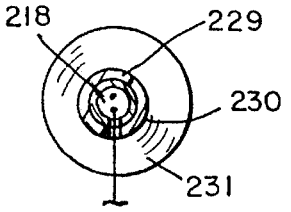
FIG. 13 is a second transverse cross-sectional view of the shaft and one of the spools of FIG. 10 taken along line 13—13 of FIG. 11.

Referring to FIG. 5 in conjunction with FIG. 3 and FIG. 10 a combined alarm system and blind assembly 210 includes the top housing assembly 111, the bottom housing assembly including the first bottom rail 12, the first string ladder support system 13, the second string ladder support system 14, the plurality of slats 15, the tilting mechanism 24, the tilt rod 25, a second lifting assembly 216, the first magnetic reed relay switch 40 and the second magnetic reed relay switch 46.

Referring to FIG. 5 in conjunction with FIG. 10, FIG. 11, FIG. 12 and FIG. 13 the lifting assembly 216 includes the rotating connector 117, a shaft 218, a plurality of spools 219 and the winding mechanism 120. The shaft 218 is a hollow cylinder which is disposed in the top housing assembly 111 and which is rotatively coupled to the rotating connector 117. Each spool 219 is disposed in the top housing assembly 111 and is fixedly coupled to the second shaft 218. The winding mechanism 120 is disposed in the top housing assembly 111 and is rotatively coupled to the shaft 218. The lifting assembly 216 also includes the first vertically disposed conductive wire 121, the second vertically disposed conductive wire 122, the first horizontally disposed conductive wire 123, the first plurality of horizontally disposed conductive wire 124. The first vertically disposed conductive wire 121 has a first end 125 and a second end 126. Each spool 219 has a sleeve 229 which has a transverse bore 230 and which is fixedly coupled to the shaft 218 and two side panels 231. The first and second ends 125 and 126 of the first vertically disposed conductive wire 121 are mechanically and electrically coupled to one of the second spools 219 and the first magnetic reed relay switch 40, respectively. The first vertically disposed conductive wire 121 extends from one of the spools 219 in the top housing assembly 111 down through each of the first slots 16 of the slats 15 to the first bottom rail 12. The first and second ends 126 and 127 of the second vertically disposed conductive wire 122 are mechanically and electrically coupled to another spool 219 and the second magnetic reed relay switch 46, respectively. The second vertically disposed conductive wire 122 extends from the first bottom rail 12 up through each of the second slots 17 of the slats 15 to the other spool 219 in the second top housing assembly 111. The first and second magnetic reed relay switch 40 and 46 electrically couple severed portions of the first and second vertically disposed conductive wire 121 and 122 back together in the presence of a first magnet 43 and a second magnet 47, respectively. The winding mechanism 120 winds and unwinds the first and second vertically disposed conductive wire 121 and 122 which otherwise would become slack when the second lifting assembly 216 raises the combined alarm system and blind assembly 210.

Figure 14:
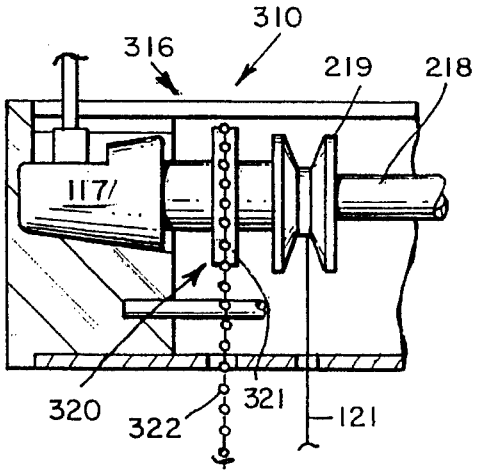
FIG. 14 is a partial elevational view of a combined alarm system and blind assembly which includes a top housing and a lifting mechanism including a shaft, a plurality of spools, a plurality of vertically disposed conductive wires.
Figure 11:
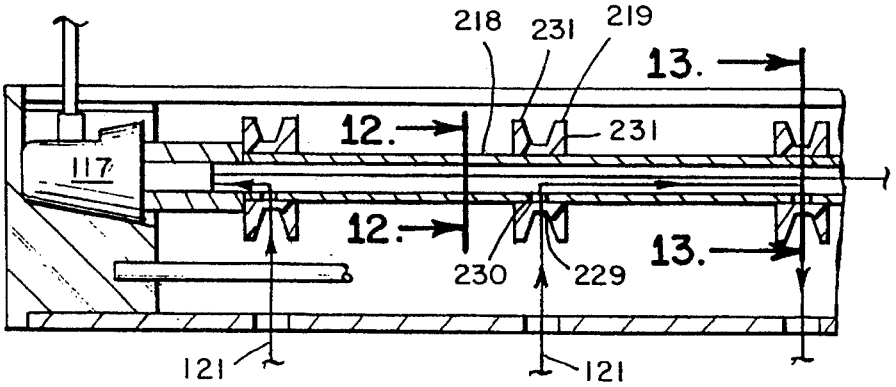
FIG. 11 is a partial elevational view in cross-section of the lifting mechanism of FIG. 10.

Referring to FIG. 5 in conjunction with FIG. 3 and FIG. 14 a combined alarm system and blind assembly 310 includes the top housing assembly 111, the bottom housing assembly including the first bottom rail 12, the first string ladder support system 13, the second string ladder support system 14, the plurality of slats 15, the tilting mechanism 24, the tilt rod 25, a third lifting assembly 316, the first magnetic reed relay switch 40 and the second magnetic reed relay switch 46.

Referring to FIG. 5 in conjunction with FIG. 14 the lifting assembly 316 includes the rotating connector 117, the shaft 218, the plurality of spools 219 and a winding mechanism 320. The shaft 118 is a hollow cylinder which is disposed in the top housing assembly 111 and which is rotatively coupled to the rotating connector 117. Each spool 219 is disposed in the top housing assembly 111 and is fixedly coupled to the shaft 218. The winding mechanism 320 is disposed in the top housing assembly 111 and is rotatively coupled to the shaft 218. The lifting assembly 316 also includes the first vertically disposed conductive wire 121, the second vertically disposed conductive wire 122, the first horizontally disposed conductive wire 123, the first plurality of horizontally disposed conductive wire 124. The winding mechanism 320 includes a sprocket wheel 321 and a bead chain 322. The sprocket wheel 321 which is connected to the shaft 218. The bead chain 322 which is accessible from the outside enages the sprocket wheel 321 in order to rotate the sprocket wheel 321.

Referring still to FIG. 14 the winding mechanism 320 may be coupled to an attachable hand-operated/automatic dual usage venetian blind controller which U.S. Pat. No. 4,956,588 teaches. The controller can be attached to an existing venetian blind either to set the blades of such a venetian blind together at any angle or to draw up the blades together to one side of the window by means of infrared remote control so as to regulate the light and air passing through. During power failure, the venetian blind can be controlled through hand operation without removing the controller. The controller includes two direct current motor and speed reducing gear set assemblies, two guide wheels, two pressure wheels, a beading cord driving wheel, a pull cord driving wheel, an infrared receiver control circuit and an infrared transmitter.

Figure 15:
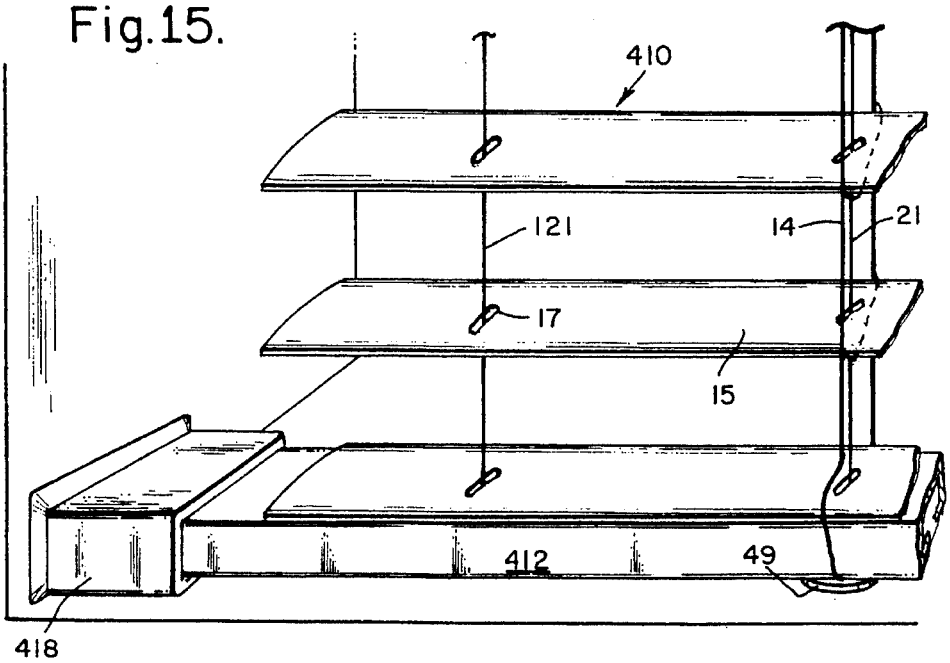
FIG. 15 is a partial perspective drawing of a combined alarm system and blind assembly which includes a top assembly, a bottom housing assembly, four magnetic reed relay switches, two top bracket assemblies, two bottom bracket assemblies, four magnets and a conductive wire.
Figure 16:
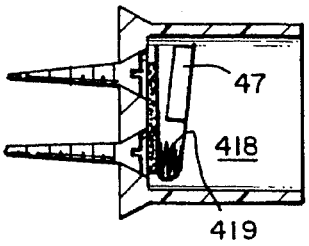
FIG. 16 is a side elevational view in cross-section of one of the two bottom bracket assemblies, each of which includes a spring on which one of the four magnets is mounted, of the combined alarm system and blind assembly of FIG. 15 in which the spring is compressed.
Figure 17:
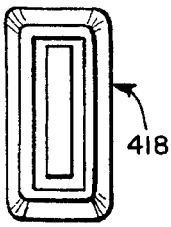
FIG. 17 is an end view of one of the two bottom bracket assemblies and one of the four magnets of the combined alarm system and blind assembly of FIG. 15.

Referring to FIG. 15 in conjunction with FIG. 3, FIG. 16 and FIG. 17 a combined alarm system and blind assembly 410 includes the top housing assembly 111, a bottom housing assembly 412, the first string ladder support system 13, the second string ladder support system 14, the plurality of slats 15, the tilting mechanism 24, the tilt rod 25, a third lifting assembly 316, two bottom bracket assemblies 418, the first magnetic reed relay switch 40 and the second magnetic reed relay switch 46.

Figure 18:
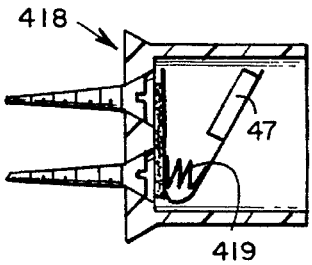
FIG. 18 is a side elevational view in cross-section of one of the two bottom bracket assemblies, each of which includes a spring on which one of the four magnets is mounted, of the combined alarm system and blind assembly of FIG. 15 in which the spring is not compressed.

Referring to FIG. 15 in conjunction with FIG. 16, FIG. 17 and FIG. 18 each of the two bottom bracket assemblies 418 includes a spring 419 on which one of the two first magnet is mounted. The spring 419 may be either compressed or not compressed.

Figure 19:
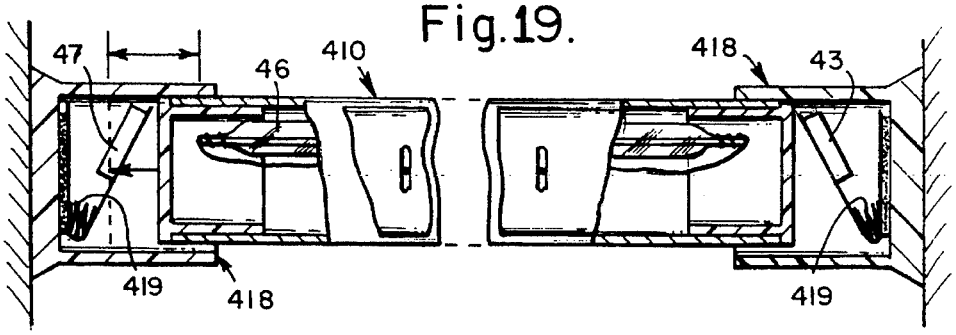
FIG. 19 is a fragmented side elevational view in cross-section of the bottom housing assembly, the two bottom bracket assemblies and two of the four magnets of the combined alarm system and blind assembly of FIG. 15 as the bottom housing assembly is being inserted into two bottom bracket assemblies.
Figure 20:
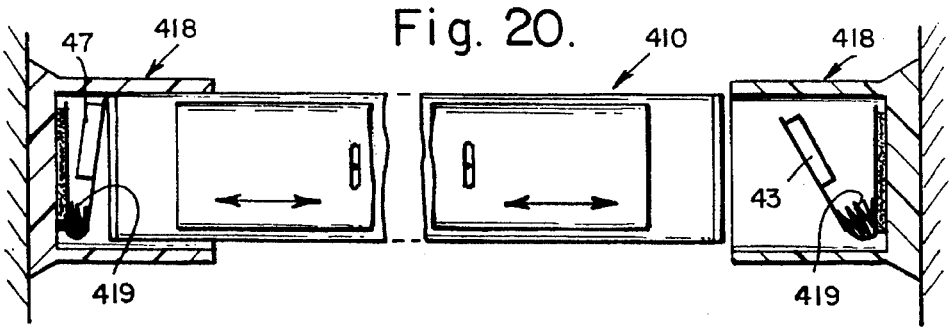
FIG. 20 is a fragmented side elevational view in cross-section of the bottom housing assembly, the two bottom bracket assemblies and two of the four magnets of the combined alarm system and blind assembly of FIG. 15 as the bottom housing assembly has been inserted into one of the two bottom bracket assemblies.

Referring to FIG. 15 in conjunction with FIG. 19 and FIG. 20 the bottom housing assembly 412 is shown as it is being inserted into two bottom bracket assemblies 418. The bottom housing assembly 412 is then shown after it has been inserted into one of the two bottom bracket assemblies 418.

Figure 21:
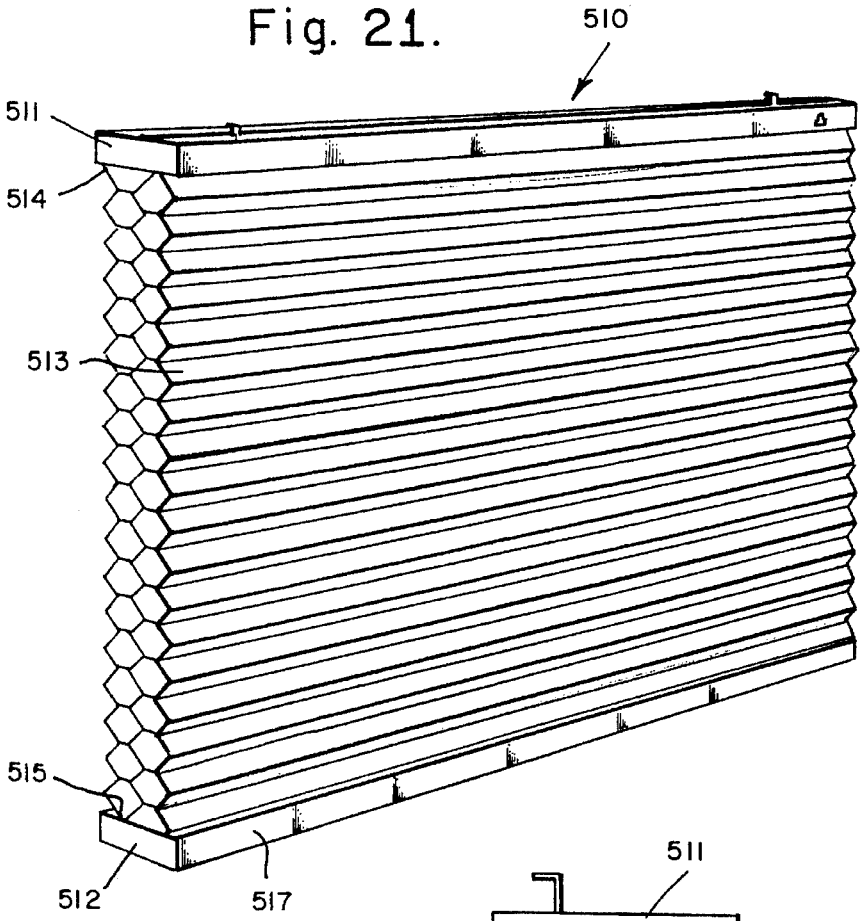
FIG. 21 is a perspective drawing of a combined alarm system and shade assembly which includes a top housing assembly, a bottom housing assembly, a double honeycomb shade, four magnetic reed relay switches, a cord lock, two top bracket assemblies, two bottom bracket assemblies, four magnets and a conductive wire.
Figure 21:
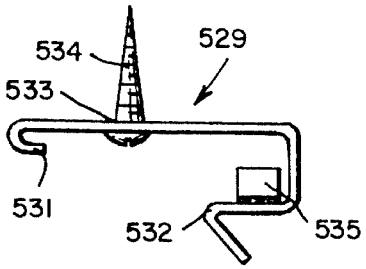
Figure 22:
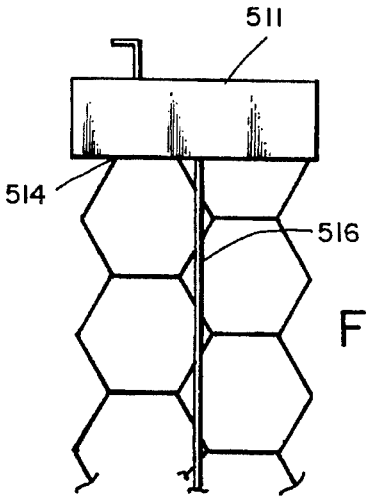
FIG. 22 is a side elevational view of one of the top and bottom bracket assemblies and one of the four magnets of the combined alarm system and shade assembly of FIG. 21.
Figure 23:
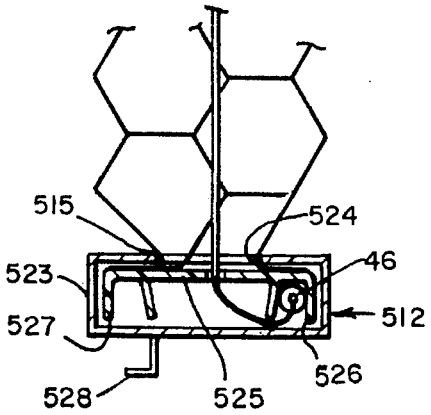
FIG. 23 is a side elevational view in partial cross-section of the combined alarm system and shade assembly of FIG. 21.

Referring to FIG. 21 in conjunction with FIG. 22 and FIG. 23 a combined alarm system and shade assembly 510 includes a top housing assembly 511, a bottom housing assembly 512, a double honeycomb shade 513 having a top edge 514 and a bottom edge 515, a conductive wire 516, the first magnetic reed relay switch 40 and the second magnetic reed relay switch 46. U.S. Pat. No. 4,582,109, U.S. Pat. No. 4,677,013 and U.S. Pat. No. 4,861,404 teach single honeycomb structures which may be used to make the double honeycomb shade 513. The top housing assembly 511 includes an elongated, hollow rectangular member 517 with a slot 518 extending lengthwise along the bottom surface thereof, an elongated rail 519 with a first channel 520 and a second channel 521 each of which extends lengthwise along the top inner surface thereof and two L-shaped flanges 522 each of which is mechanically coupled to the elongated, hollow rectangular member 517 and disposed on the top outer surface thereof. One of the first magnetic reed relay switches 40 is disposed in the first channel 520 of the elongated rail 519 at each end thereof. The double honeycomb shade 513 is mechanically coupled to the elongated rail 519 adjacent to the first end 514 thereof. The elongated rail 519 is slidably coupled to the elongated, hollow rectangular member 517 so that the double honeycomb shade 513 extends through the slot 518 of the elongated, hollow rectangular member 517. The bottom housing assembly 512 includes a elongated, hollow rectangular member 523 with a slot 524 extending lengthwise along the bottom surface thereof, a elongated rail 525 with a first channel 526 and a second channel 527 each of which extends lengthwise along the bottom inner surface thereof, two L-shaped flanges 528 each of which is mechanically coupled to the elongated, hollow rectangular member 523 and disposed on the bottom outer surface thereof. One of the second magnetic reed relay switches 46 is disposed in the first channel 526 of the elongated rail 525 at each end thereof. The double honeycomb shade 513 is mechanically coupled to the elongated rail 524 adjacent to the second end 515 thereof. The elongated rail 525 is slidably coupled to the elongated, hollow rectangular member 523 so that the double honeycomb shade 513 extends through the slot 524 of the elongated, hollow rectangular member 523. The combined alarm system and shade assembly 510 also includes two top bracket assemblies 529, two bottom bracket assemblies 530 and a cord lock 531. U.S. Pat. No. 4,982,776 and U.S. Pat. No. 4,913,210 teach cord locks. Each top bracket assembly 529 includes a first J-shaped member 531 with a first crook 532 and a first bore 533, a first mounting screw 534 and a first magnet 535. Each bottom bracket assembly 530 includes a second J-shaped member 536 with a second crook 537 and a second bore 538, a second mounting screw 539 and a second magnet 540. U.S. Pat. No. 4,363,459 teaches a bracket which includes a first J-shaped member with a first crook and a first bore and a first mounting screw. The conductive wire 516 has a first end 541 and a second end 542 and extends from the top housing assembly 511 down to the bottom housing assembly 512 and from the bottom housing 512 to the top housing assembly 511. The first and second magnetic reed relay switch 40 and 46 electrically couple the severed portions of the conductive wire 516 back together in the presence of the first and second magnets 535 and 540. The conductive wire 516 makes a plurality of round-trips each of which extends from the top housing assembly 511 down through the double honeycomb shade 513 to the bottom housing assembly 512 and from the bottom housing assembly 512 up through the double honeycomb shade 513 to the top housing assembly 511.

Figure 24:
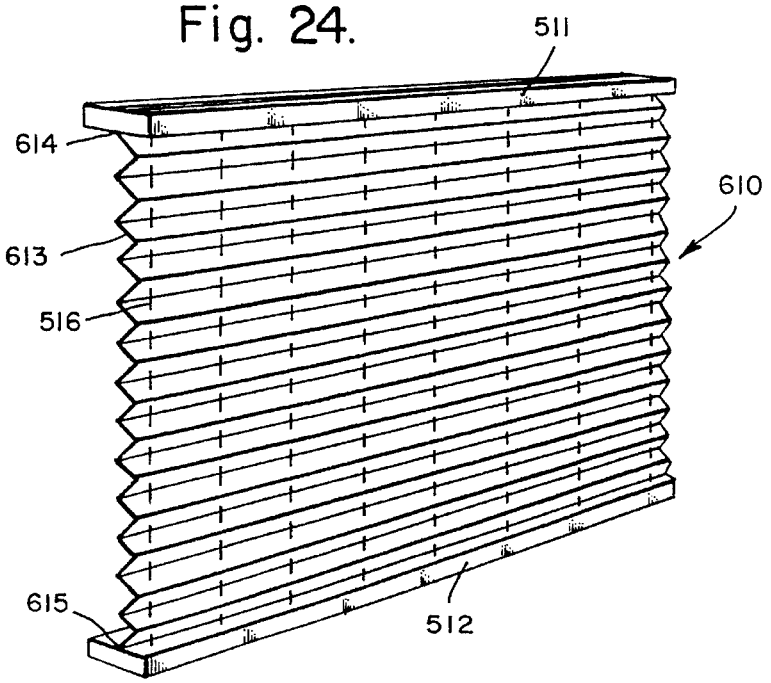
FIG. 24 is a perspective drawing of a combined alarm system and shade assembly which includes a top housing assembly, a bottom housing assembly, a pleated shade, four magnetic reed relay switches, a cord lock, two top bracket assemblies, two bottom bracket assemblies, four magnets and a conductive wire.
Figure 25:
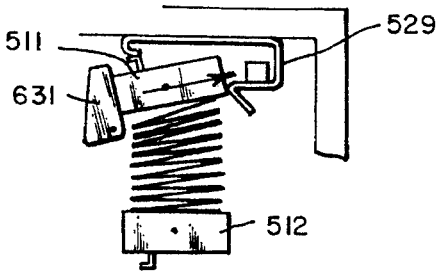
FIG. 25 is a side elevational view of the combined alarm system and shade assembly of FIG. 24 as the top housing assemblies is being placed in the two top bracket assemblies.
Figure 26:
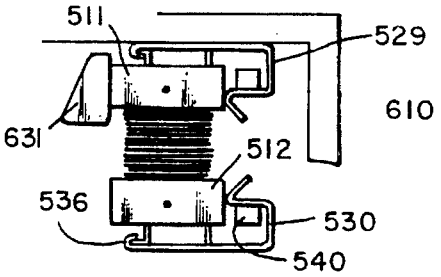
FIG. 26 is a side elevational view of the combined alarm system and shade assembly of FIG. 24 as the bottom housing assembly is being placed in the two bottom bracket assemblies after the top housing assembly has been placed in the two top bracket assemblies.
Figure 27:
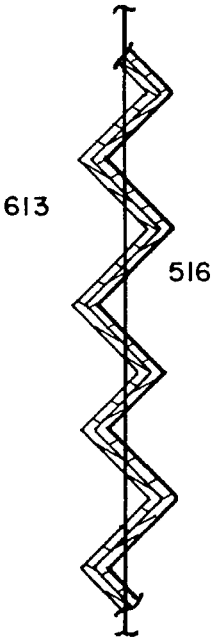
FIG. 27 is a side elevational view in cross-section of the pleated shade of the combined alarm system and shade assembly of FIG. 24 which has a first sheet and a second sheet.

Referring to FIG. 24 in conjunction with FIG. 25, FIG. 26 and FIG. 27 a combined alarm system and shade assembly 610 includes the top housing assembly 511, the bottom housing assembly 512, a pleated shade 613 having a top edge 614 and a bottom edge 615, the conductive wire 516, the first magnetic reed relay switch 40 and the second magnetic reed relay switch 46. U.S. Pat. No. 4,974,656 teaches a pleated shade which may be used to make the pleated shade 613. The pleated shade 613 is mechanically coupled to the elongated rail 519 adjacent to the first end 614 thereof. The elongated rail 519 is slidably coupled to the elongated, hollow rectangular member 517 so that the pleated shade 613 extends through the slot 518 of the elongated, hollow rectangular member 517. The pleated shade 613 is mechanically coupled to the elongated rail 524 adjacent to the second end 615 thereof. The elongated rail 525 is slidably coupled to the elongated, hollow rectangular member 523 so that the pleated shade 613 extends through the slot 524 of the elongated, hollow rectangular member 523. The combined alarm system and shade assembly 610 also includes the two top bracket assemblies 529, the two bottom bracket assemblies 530 and a cord lock 631. U.S. Pat. No. 4,913,210 teaches a cord lock for a pleated shade. The conductive wire 516 makes a plurality of round-trips each of which extends from the top housing assembly 511 down through the pleated shade 613 to the bottom housing assembly 512 and from the bottom housing assembly 512 up through the pleated shade 613 to the housing assembly 511.

Figure 28:
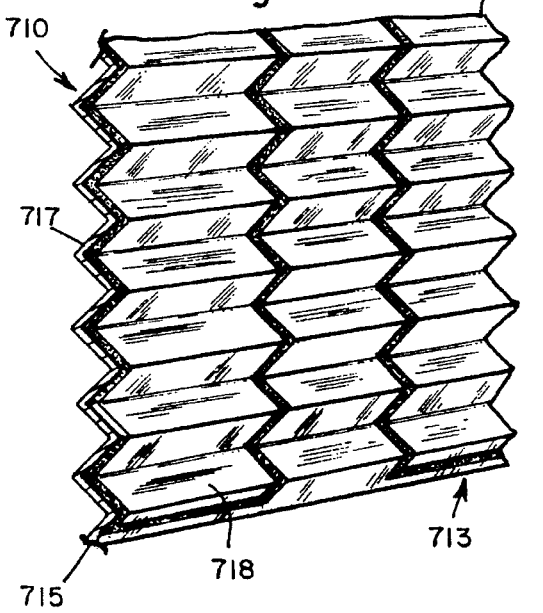
FIG. 28 is a perspective drawing of a first sheet and a conductive path of a pleated shade for use in a combined alarm system and shade assembly including a top housing assembly, a bottom housing assembly, four magnetic reed relay switches, a cord lock, two top bracket assemblies, two bottom bracket assemblies, four magnets and a conductive wire.
Figure 29:
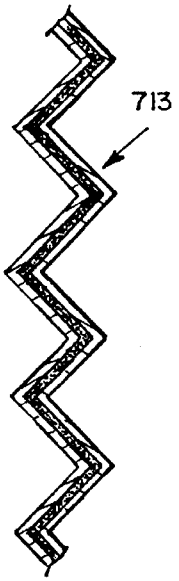
FIG. 29 is a side elevational view in cross-section of the second pleated shade of FIG. 28 which includes the first sheet, the conductive path and a second pleated sheet.
Figure 36:
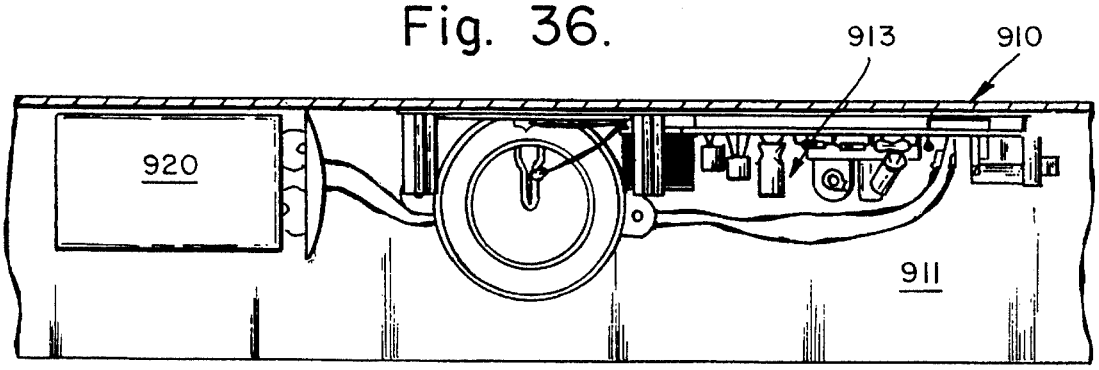
FIG. 36 is a partial side elevational view in cross-section of the top bracket assembly of FIG. 35 showing an alarm circuit including a relay, a battery and a relay.
Figure 37:
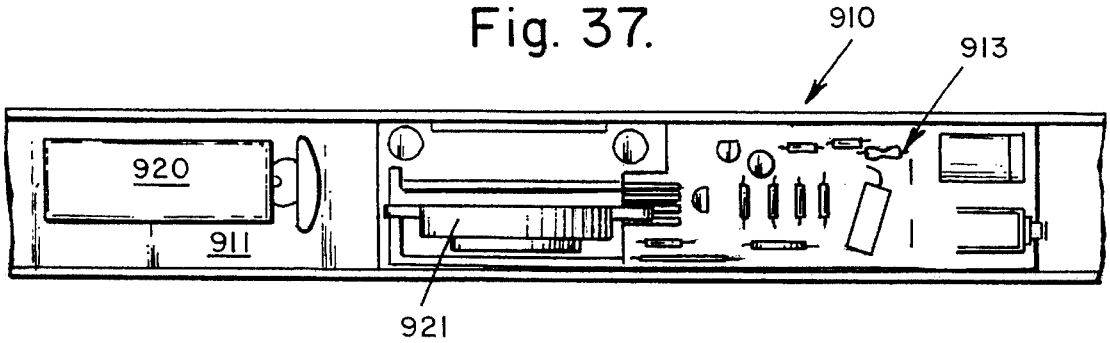
FIG. 37 is a partial bottom plan view of the top bracket assembly of FIG. 35 showing the alarm circuit of FIG. 36.
Figure 38:
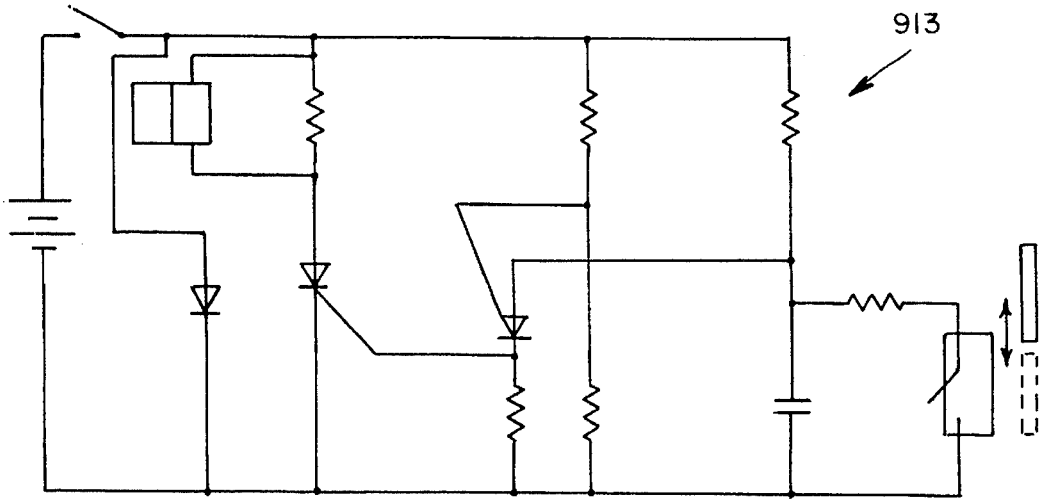
FIG. 38 is a circuit diagram of the alarm circuit of FIG. 36.

Referring to FIG. 28 in conjunction with FIG. 27, FIG. 28 and FIG. 29 a third combined alarm system and shade assembly 710 includes the third top housing assembly 511, the third bottom housing assembly 512, a pleated shade 713 having a top edge 714 and a bottom edge 715, a conductive path 716, the first magnetic reed relay switch 40 and the second magnetic reed relay switch 46. U.S. Pat. No. 4,862,941 teach a pleated shade which may be used to make the second pleated shade 713. The pleated shade 713 includes a first pleated sheet 717 and a second pleated sheet 718 which are spaced apart in substantially parallel array by the top and bottom housing assemblies 511 and 512. The conductive path 716 is formed by applying a layer of flexible and electrically conductive coating composition to the first pleated sheet. U.S. Pat. No. 4,999,608 teaches the use of an elongated path of flexible and electrically conductive coating composition which is applied to a screen mesh in a predetermined and non-overlapping pattern. The pleated shade 713 is mechanically coupled to the elongated rail 519 adjacent to the first end 714 thereof. The elongated rail 519 is slidably coupled to the elongated, hollow rectangular member 517 so that the pleated shade 713 extends through the slot 518 of the elongated, hollow rectangular member 517. The pleated shade 713 is mechanically coupled to the elongated rail 524 adjacent to the second end 615 thereof. The elongated rail 525 is slidably coupled to the elongated, hollow rectangular member 523 so that the pleated shade 713 extends through the slot 524 of the elongated, hollow rectangular member 523. The combined alarm system and shade assembly 710 also includes the two top bracket assemblies 529, the two bottom bracket assemblies 530 and a cord lock 631. U.S. Pat. No. 4,913,210 teaches a cord lock for a pleated shade. The conductive path 716 makes a plurality of round-trips each of which extends from the top housing assembly 511 down through the pleated shade 713 to the bottom housing assembly 512 and from the bottom housing assembly 512 up through the pleated shade 713 to the top housing assembly 511.

Referring to FIG. 30 in conjunction with FIG. 31 and FIG. 33 a combined alarm system and screen assembly 810 includes the top housing assembly 511, the bottom housing assembly 512, a screen mesh 813 having a top edge 814 and a bottom edge 815, a conductive wire 516, the first magnetic reed relay switch 40 and the second magnetic reed relay switch 46. U.S. Pat. No. 4,146,293 teaches a combined alarm system and screen assembly includes a screen mesh and a conductive wire which may be sewn, glued or interwoven onto the screen mesh. The third top housing assembly 511 includes an elongated, hollow rectangular member 517 with a slot 518 extending lengthwise along the top surface thereof and an elongated rail 519 with a first channel 520 and a second channel 521 each of which extends lengthwise along the bottom inner surface thereof. Each of the two L-shaped flanges 522 may be mechanically coupled to the first elongated, hollow rectangular member 517 and disposed on the bottom outer surface thereof. The screen mesh 813 is mechanically coupled to the first elongated rail 519 adjacent to the first end 814 thereof. The first elongated rail 519 is slidably coupled to the first elongated, hollow rectangular member 517 so that the screen mesh 813 extends through the slot 518 of the first elongated, hollow rectangular member 517. The top housing assembly 511 also includes a spline 829 and an elongated elastic member 830. The spline 829 is disposed in the first channel 520 of the elongated rail 519 and secures the screen mesh 813 within the top housing assembly 511. The elongated elastic member 830 is disposed along with the screen mesh 813 between the elongated, hollow rectangular member 517 and the second channel 521 of the first elongated rail 519 and functions as a tensioning mechanism for taking up any slack in the screen mesh 813. One of the first magnetic reed relay switches 40 is disposed in the first channel 520 of the elongated rail 519 at each end thereof. The bottom housing assembly 512 includes an elongated, hollow rectangular member 523 with a slot 524 extending lengthwise along the top surface thereof and a second elongated rail 525 with a first channel 526 and a second channel 527 each of which extends lengthwise along the bottom inner surface thereof. Each of the two L-shaped flanges 528 may be mechanically coupled to the elongated, hollow rectangular member 523 and disposed on the bottom outer surface thereof. One of the second magnetic reed relay switches 46 is disposed in the first channel 526 of the second elongated rail 525 at each end thereof. The screen mesh 813 is mechanically coupled to the elongated rail 524 adjacent to the second end 815 thereof. The elongated rail 525 is slidably coupled to the elongated, hollow rectangular member 523 so that the screen mesh 813 extends through the slot 524 of the elongated, hollow rectangular member 523. The bottom housing assembly 512 also includes a spline 831 and an elongated elastic member 832. The spline 831 is disposed in the first channel 526 of the elongated rail 525 and secures the screen mesh 813 within the bottom housing assembly 512. The elongated elastic member 832 is disposed along with the screen mesh 813 between the elongated, hollow rectangular member 523 and the second channel 527 of the elongated rail 525 and functions as a tensioning mechanism for taking up any slack in the screen mesh 813. The combined alarm system and shade assembly 510 may also include the two top bracket assemblies 529, the two bottom bracket assemblies 530 and a cord lock 531. U.S. Pat. No. 4,982,776 and U.S. Pat. No. 4,913,210 teach cord locks. Each top bracket assembly 529 includes a first J-shaped member 531 with a first crook 532 and a first bore 533, a first mounting screw 534 and a first magnet 535. Each bottom bracket assembly 530 includes a second J-shaped member 536 with a second crook 537 and a second bore 538, a second mounting screw 539 and a second magnet 540. The conductive wire 516 has a first end 541 and a second end 542 and extends from the top housing assembly 511 down to the bottom housing assembly 512 and from the bottom housing 512 to the top housing assembly 511. The first and second magnetic reed relay switch 40 and 46 electrically couple the severed portions of the conductive wire 516 back together in the presence of the first and second magnets 535 and 540. The conductive wire 516 makes a plurality of round-trips each of which extends from the top housing assembly 511 down through the screen mesh 813 to the bottom housing assembly 512 and from the bottom housing assembly 512 up through the screen mesh 813 to the top housing assembly 511. The screen mesh 813 is formed from a sheet of screen material and has marginal edge portions which are adapted to be secured to a frame. A single integral length of conductive wire 516 has a first plurality of parallel segments and a second plurality of parallel segments. The first plurality of parallel segments has been spaced apart and interwoven into the screen mesh 813. The second plurality of parallel segments is contiguous at each end to one of the first plurality of parallel segments and has not been interwoven into the screen mesh 813. The second plurality of parallel segments are disposed perpendicular to the first plurality of parallel segments. None of the first and second pluralities of parallel segments are spliced together.

Referring to FIG. 30 in conjunction with FIG. 34 the bottom housing assembly 512 has a pair of end pieces 820. Each end piece 820 is coupled to the one of ends of the bottom housing 512.

Referring to FIG. 35 in conjunction with FIG. 30, FIG. 31, FIG. 36, FIG. 37 and FIG. 38 a top housing assembly 910 may be used with any of the combined alarm system and window covering assemblies including the combined alarm system and shade assembly 510, the combined alarm system and shade assembly 610 and the combined alarm system and screen assembly 810. The top housing assembly 910 includes an inverted U-shaped railing 911, a top bracket assembly 912 at each end and an alarm circuit 913. Each top bracket assembly 912 includes a J-shaped member 914 with a crook 915 and a bore, a mounting screw and a magnet 918. The alarm circuit 913 includes a relay 919, a battery 920 and a buzzer 921. U.S. Pat. No. 4,160,972 teaches an alarm system which has an alarm circuit.

Referring to FIG. 39 in conjunction with FIG. 40 the top housing assembly 910 also includes a smoke detector 922 including a battery 923 and a smoke detecting circuit 924. U.S. Pat. No. 4,525,703 teaches a smoke detecting circuit which is connected to an audible signal activated on the presence of smoke. U.S. Pat. No. 4,897,634 teaches a scattered-light smoke detector. U.S. Pat. No. 4,954,816 teaches a smoke detector for mounting on a wall or ceiling of a room.

Referring to FIG. 41 the top housing assembly 910 further includes a solar battery charging system 925 having a solar cell 926, a first conductive wire 927, a second conductive wire 928, a third conductive wire 929, a capacitor 930 and a wind-up spooling system 931. The second conductive wire 928 electrically couples a second lead of the solar cell 926 to a first terminal of the capacitor 930. The third conductive wire 929 electrically couples a second lead of the capacitor 930 to a second terminal of the battery 920. The solar battery charging system 925 may be used with any of the combined alarm system and window covering assemblies. U.S. Pat. No. 4,982,176 teaches a solar powered outdoor lighting and/or alarm systems which includes either a light source or an alarm circuit, a passive infrared sensor in conjunction with a battery which is recharged via solar cells and a control circuit coupled to either the light source or the alarm circuit, the passive infrared sensor and the rechargeable battery. The control circuit guarantees that either the light source or the alarm circuit is turned on by the battery only when the sensor senses the presence of a moving target. U.S. Pat. No.

4,837,558 teaches a glass break detector which includes a unidirectional acoustic transducer directed toward an area of glass to be monitored. The transducer is narrowband and has a sharp frequency response peak in the 4 to 8 kHz range. An electronic audio discriminator connected to the transducer output is responsive to signals within this frequency range having a predetermined amplitude thereby eliminating ambient or environmental sounds not characteristic of breaking glass. The transducer is mounted in a rectangular enclosure which is pointed at the area to be monitored and includes a flat circular metallic disk affixed to the enclosure with a piezo electric element affixed to the rear of the metallic disk. The enclosure is tuned to resonate at a frequency characteristic of the sound of breaking glass.

Figure 42:
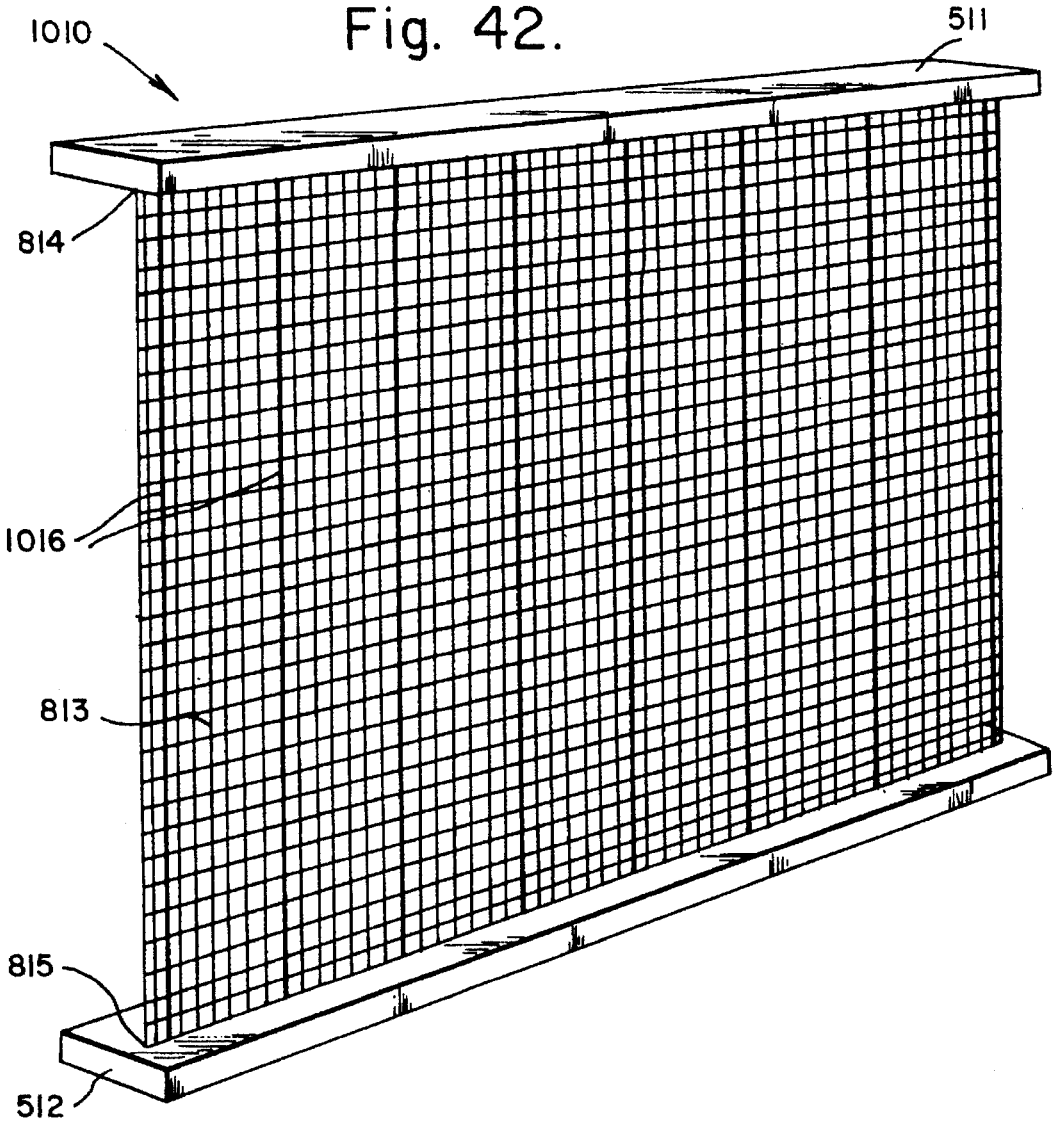
FIG. 42 is a perspective drawing of a combined alarm system and screen assembly which includes a top housing assembly, a bottom housing assembly, a screen mesh and an optical fiber.
Figure 43:
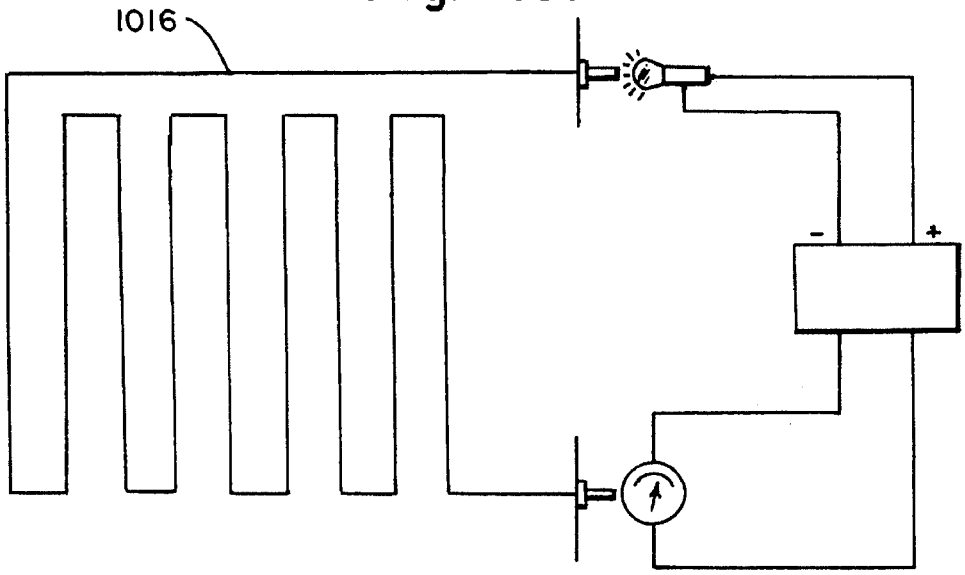
FIG. 43 is a schematic diagram of the optical fiber of the combined alarm system and screen assembly of FIG. 42.
Figure 44:
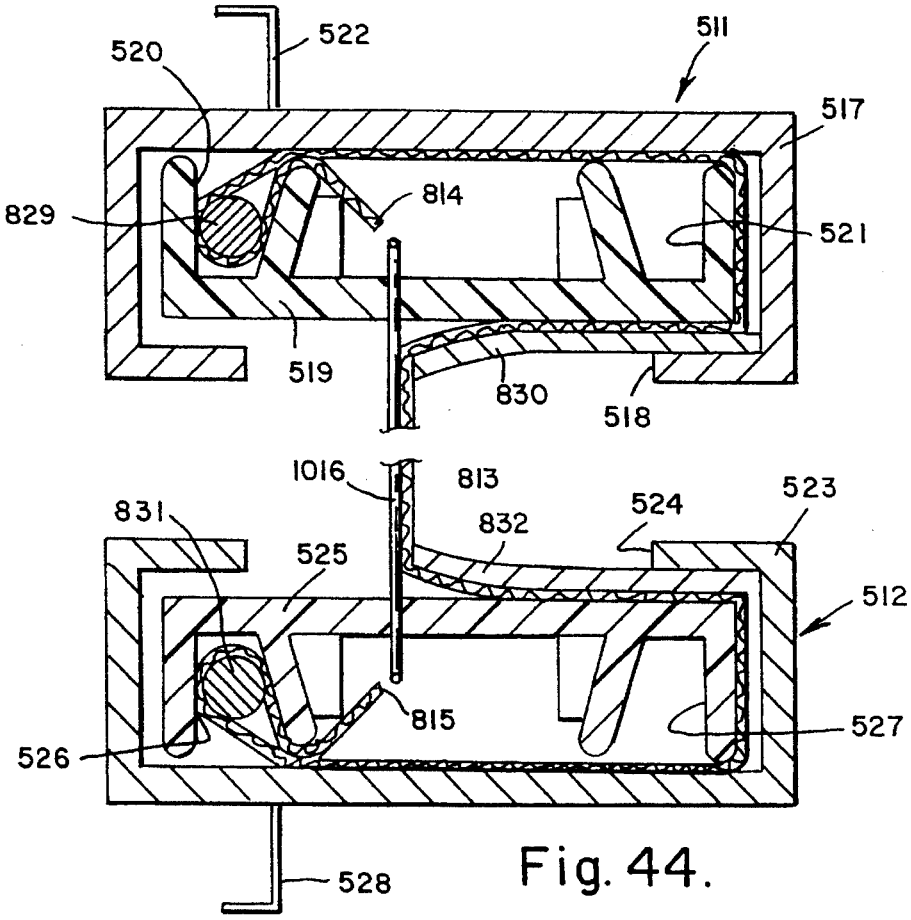
FIG. 44 is a partial side elevational view in cross-section of the top and bottom housing assemblies of the combined alarm system and screen assembly of FIG. 42.

Referring to FIG. 42 in conjunction with FIG. 31, FIG. 43 and FIG. 44 a combined alarm system and screen assembly 1010 includes the top housing assembly 511, the bottom housing assembly, a screen mesh 813 having a top edge 814 and a bottom edge, an optical fiber 1016 which may be sewn, glued or interwoven onto the screen mesh. The third top housing assembly 511 includes an elongated, hollow rectangular member 517 with a slot 518 extending lengthwise along the top surface thereof and an elongated rail 519 with a first channel 520 and a second channel 521 each of which extends lengthwise along the bottom inner surface thereof. Each of the two L-shaped flanges 522 may be mechanically coupled to the first elongated, hollow rectangular member 517 and disposed on the bottom outer surface thereof. The screen mesh 813 is mechanically coupled to the first elongated rail 519 adjacent to the first end 814 thereof. The first elongated rail 519 is slidably coupled to the first elongated, hollow rectangular member 517 so that the screen mesh 813 extends through the slot 518 of the first elongated, hollow rectangular member 517. The top housing assembly 511 also includes a spline 829 and an elongated elastic member 830. The spline 829 is disposed in the first channel 520 of the elongated rail 519 and secures the screen mesh 813 within the top housing assembly 511. The elongated elastic member 830 is disposed along with the screen mesh 813 between the elongated, hollow rectangular member 517 and the second channel 521 of the first elongated rail 519 and functions as a tensioning mechanism for taking up any slack in the screen mesh 813. The bottom housing assembly 512 includes an elongated, hollow rectangular member 523 with a slot 524 extending lengthwise along the top surface thereof and a second elongated rail 525 with a first channel 526 and a second channel 527 each of which extends lengthwise along the bottom inner surface thereof. Each of the two L-shaped flanges 528 may be mechanically coupled to the elongated, hollow rectangular member 523 and disposed on the bottom outer surface thereof. The screen mesh 813 is mechanically coupled to the elongated rail 524 adjacent to the second end 815 thereof. The elongated rail 525 is slidably coupled to the elongated, hollow rectangular member 523 so that the screen mesh 813 extends through the slot 524 of the elongated, hollow rectangular member 523. The bottom housing assembly 512 also includes a spline 831 and an elongated elastic member 832. The spline 831 is disposed in the first channel 526 of the elongated rail 525 and secures the screen mesh 813 within the bottom housing assembly 512. The elongated elastic member 832 is disposed along with the screen mesh 813 between the elongated, hollow rectangular member 523 and the second channel 527 of the elongated rail 525 and functions as a tensioning mechanism for taking up any slack in the screen mesh 813. The combined alarm system and screen assembly 1010 may also include the two top bracket assemblies 529, the two bottom bracket assemblies 530 and a cord lock 531. U.S. Pat. No. 4,982,776 and U.S. Pat. No. 4,913,210 teach cord locks. Each top bracket assembly 529 includes a first J-shaped member 531 with a first crook 532 and a first bore 533, a first mounting screw 534 and a first magnet 535. Each bottom bracket assembly 530 includes a second J-shaped member 536 with a second crook 537 and a second bore 538, a second mounting screw 539 and a second magnet 540. The optical fiber 1016 has a first end 1041 and a second end 1042 and extends from the top housing assembly 511 down to the bottom housing assembly 512 and from the bottom housing 512 to the top housing assembly 511. An optical reed relay-type switch 1043 electrically couples the severed portions of the optical fiber 1016 back together in the presence of the first and second magnets 535 and 540. The optical fiber 1016 makes a plurality of round-trips each of which extends from the top housing assembly 511 down through the screen mesh 813 to the bottom housing assembly 512 and from the bottom housing assembly 512 up through the screen mesh 813 to the top housing assembly 511. The screen mesh 813 is formed from a sheet of screen material and has marginal edge portions which are adapted to be secured to a frame. The optical fiber 1016 has a first plurality of parallel segments and a second plurality of parallel segments. The first plurality of parallel segments has been spaced apart and interwoven into the screen mesh 813. The second plurality of parallel segments is contiguous at each end to one of the first plurality of parallel segments and has not been interwoven into the screen mesh 813. The second plurality of parallel segments are disposed perpendicular to the first plurality of parallel segments.

Figure 45:
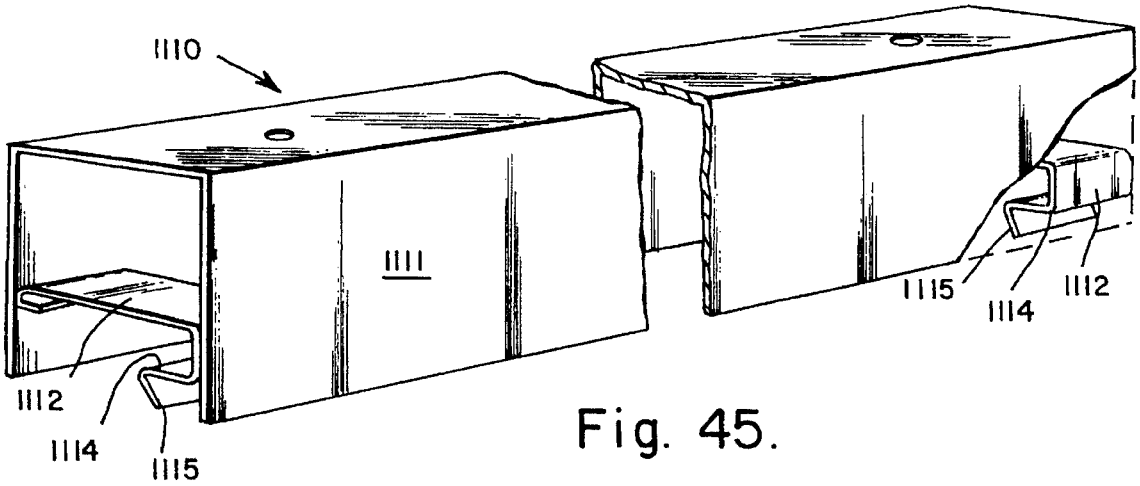
FIG. 45 is a perspective drawing of a top bracket assembly for use with the combined alarm system and screen assembly of FIG. 42.
Figure 46:
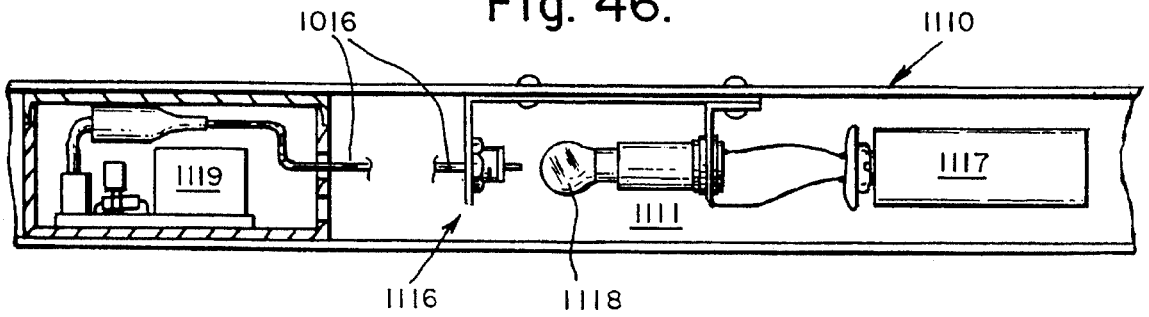
FIG. 46 is a partial side elevational view in cross-section of the top bracket assembly of FIG. 45 showing an optical fiber relay including a battery and a relay switch.
Figure 47:
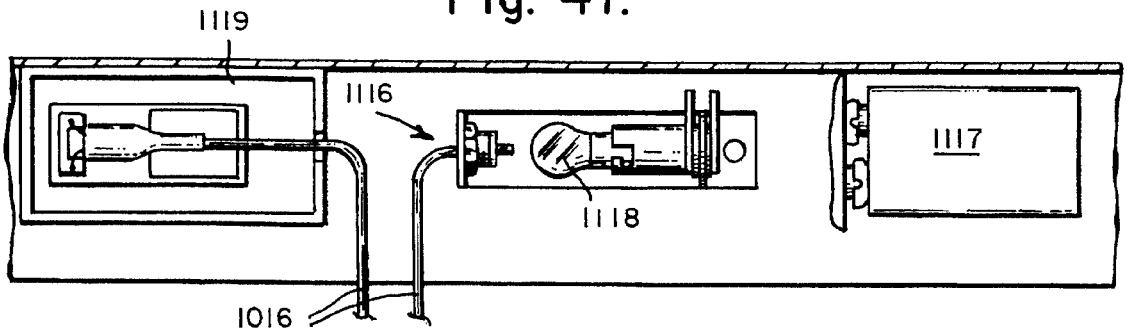
FIG. 47 is a partial bottom plan view of the top bracket assembly of FIG. 45 showing the optical fiber relay of FIG. 46.

Referring to FIG. 45 in conjunction with FIG. 46 and FIG. 47 a top housing assembly 1110 may be used with the combined alarm system and screen assembly 1010. The top housing assembly 1110 includes an inverted U-shaped railing 1111 and a top bracket assembly 1112 at each end. Each top bracket assembly 1112 includes a J-shaped member 1114 with a crook 1115. The top housing assembly 1110 also includes the alarm circuit 913, the smoke detector 922, the solar battery charging system 925 and an optical relay system 1116 which includes a battery 1117 and a light 1118 and an optical relay switch 1119.

Figure 48:
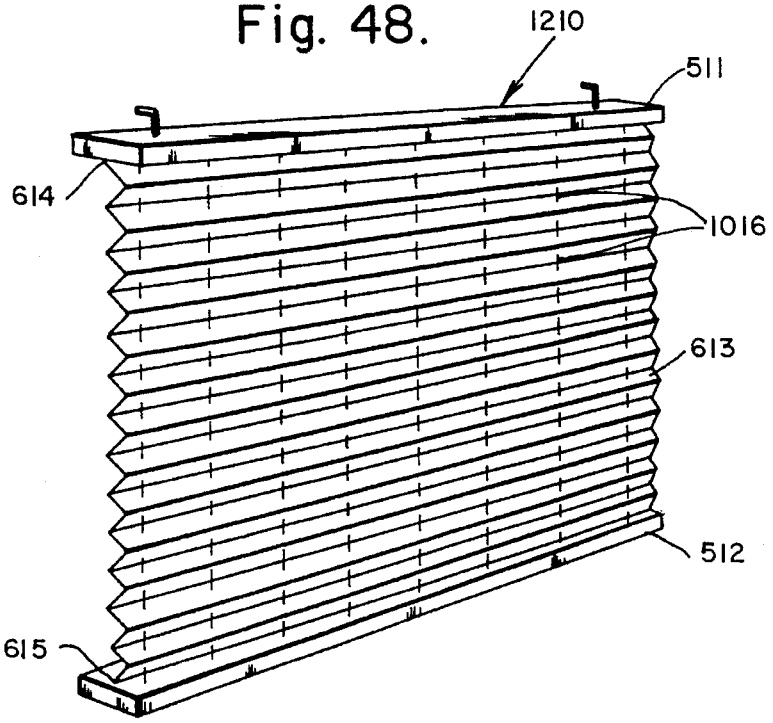
FIG. 48 is a perspective drawing of a combined alarm system and shade assembly which includes a pleated shade and an optical fiber.

Referring to FIG. 48 in conjunction with FIG. 31 and FIG. 49 a combined alarm system and shade assembly 1210 includes the top housing assembly 511, the bottom housing assembly 512, a pleated shade 613 having a top edge 614 and a bottom edge 615 and the optical fiber 1016. The pleated shade 613 is mechanically coupled to the elongated rail 519 adjacent to the first end 614 thereof. The elongated rail 519 is slidably coupled to the elongated, hollow rectangular member 517 so that the pleated shade 613 extends through the slot 518 of the elongated, hollow rectangular member 517. The pleated shade 613 is mechanically coupled to the elongated rail 524 adjacent to the second end 615 thereof. The elongated rail 525 is slidably coupled to the elongated, hollow rectangular member 523 so that the pleated shade 613 extends through the slot 524 of the elongated, hollow rectangular member 523. The combined alarm system and shade assembly 1210 also includes the two top bracket assemblies 529, the two bottom bracket assemblies 530 and a cord lock 631. The optical fiber 1016 makes a plurality of round-trips each of which extends from the top housing assembly 511 down through the pleated shade 613 to the bottom housing assembly 512 and from the bottom housing assembly 512 up through the pleated shade 613 to the housing assembly 511.

Referring to FIG. 50 in conjunction with FIG. 31 and FIG. 51 a combined alarm system and shade assembly 1310 includes a top housing assembly 511, a bottom housing assembly 512, a double honeycomb shade 513 having a top edge 514 and a bottom edge 515 and the optical fiber 1016. The double honeycomb shade 513 is mechanically coupled to the elongated rail 519 adjacent to the first end 514 thereof. The elongated rail 519 is slidably coupled to the elongated, hollow rectangular member 517 so that the double honeycomb shade 513 extends through the slot 518 of the elongated, hollow rectangular member 517. The double honeycomb shade 513 is mechanically coupled to the elongated rail 524 adjacent to the second end 515 thereof. The optical fiber 1016 has a first end 541 and a second end 542 and extends from the top housing assembly 511 down to the bottom housing assembly 512 and from the bottom housing 512 to the top housing assembly 511. The optical fiber 1016 makes a plurality of round-trips each of which extends from the top housing assembly 511 down through the double honeycomb shade 513 to the bottom housing assembly 512 and from the bottom housing assembly 512 up through the double honeycomb shade 513 to the top housing assembly 511.

Figure 52:
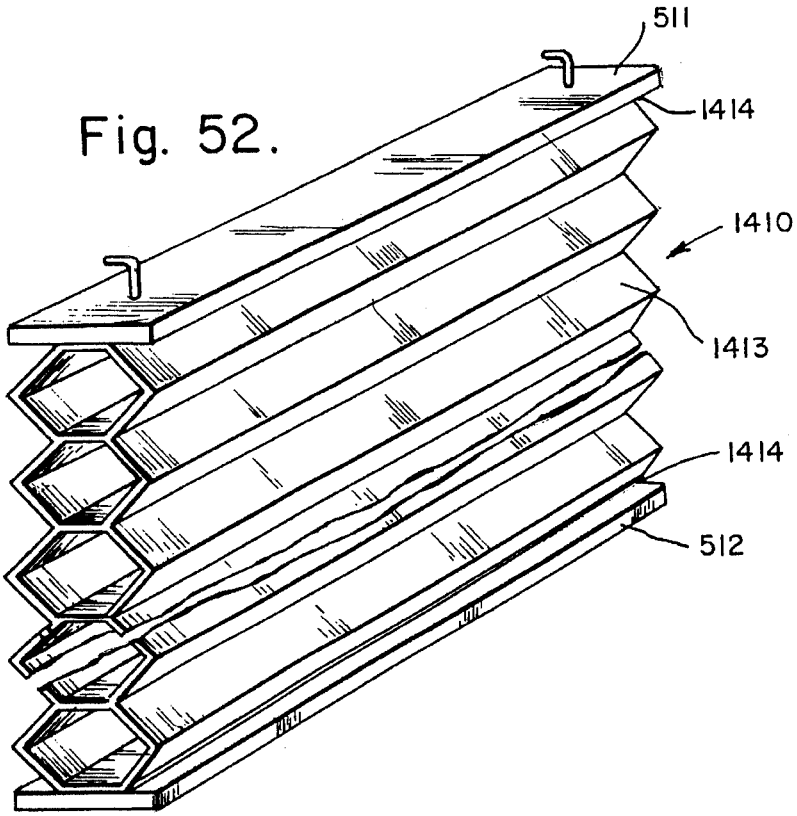
FIG. 52 is a partial perspective drawing of a combined alarm system and shade assembly which includes a single honeycomb shade and an optical fiber.
Figure 53:
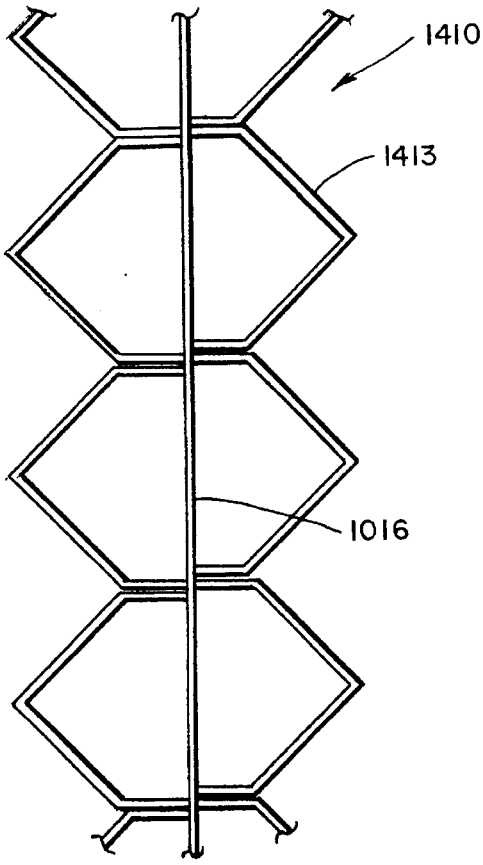
FIG. 53 is a partial side elevational view of the combined alarm system and shade assembly of FIG. 52.

Referring to FIG. 52 in conjunction with FIG. 31 and FIG. 53 a combined alarm system and shade assembly 1410 includes a top housing assembly 511, a bottom housing assembly 512, a single honeycomb shade 1413 having a top edge 1414 and a bottom edge 1415 and the optical fiber 1016. The single honeycomb shade 1413 is mechanically coupled to the elongated rail 519 adjacent to the first end 514 thereof. The single honeycomb shade 1413 is mechanically coupled to the elongated rail 524 adjacent to the second end 515 thereof. The optical fiber 1016 has a first end 541 and a second end 542 and extends from the top housing assembly 511 down to the bottom housing assembly 512 and from the bottom housing 512 to the top housing assembly 511. The optical fiber 1016 makes a plurality of round-trips each of which extends from the top housing assembly 511 down through the single honeycomb shade 1413 to the bottom housing assembly 512 and from the bottom housing assembly 512 up through the single honeycomb shade 1413 to the top housing assembly 511.

Figure 54:
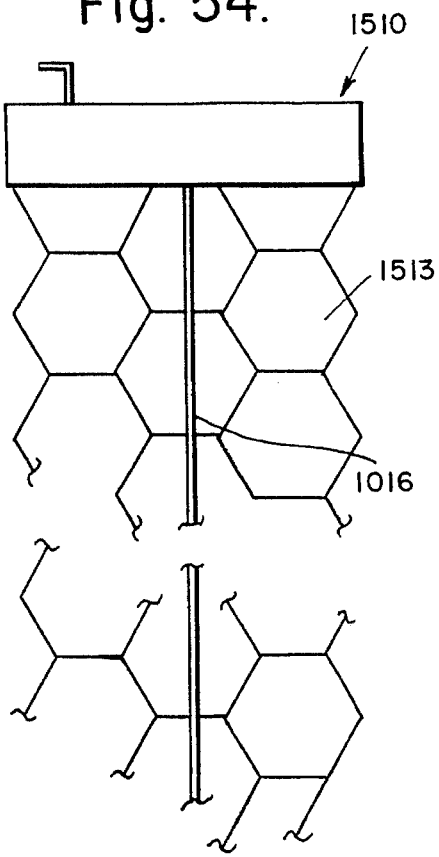
FIG. 54 is a partial side elevational view of a combined alarm system and shade assembly which includes a triple honeycomb shade and an optical fiber.

Referring to FIG. 54 in conjunction with FIG. 31 a combined alarm system and shade assembly 1510 includes a top housing assembly 511, a bottom housing assembly 512, a triple honeycomb shade 1513 having a top edge and a bottom edge and the optical fiber 1016. The triple honeycomb shade 1513 is mechanically coupled to the elongated rail 519 adjacent to the first end 514 thereof. The triple honeycomb shade 1513 is mechanically coupled to the elongated rail 524 adjacent to the second end 515 thereof. The optical fiber 1016 has a first end 541 and a second end 542 and extends from the top housing assembly 511 down to the bottom housing assembly 512 and from the bottom housing 512 to the top housing assembly 511. The optical fiber 1016 makes a plurality of round-trips each of which extends from the top housing assembly 511 down through the triple honeycomb shade 1513 to the bottom housing assembly 512 and from the bottom housing assembly 512 up through the triple honeycomb shade 1513 to the top housing assembly 511.

Referring to FIG. 55 in conjunction with FIG. 1 a combined alarm system and blind assembly 1560 includes a optical fiber 1016 which has been substituted in place of the conductive wire 21 in the combined alarm system and blind assembly 10.

Referring to FIG. 56 in conjunction with FIG. 57, FIG. 58, FIG. 59 and FIG. 66 a combined alarm system and roll-up screen assembly 1610 includes a top housing assembly 1611, a bottom housing assembly 1612, a screen mesh 513 and a conductive wire 516. The top housing assembly 1611 includes a rotating rail 1617, a roll-up mechanism 1618 and a rotatable electrical connector 1619. U.S. Pat. No. 4,843,375 teaches the roll-up mechanism. U.S. Pat. No. 5,082,448 teaches a rotatable electrical connector. An alarm circuit may be disposed either within or without the rotating rail 1617. The bottom housing assembly 1612 includes a bottom rail 1620, two end pieces 1621 and two mounting assemblies 1622. Each end piece 1621 has a hole 1623 therein. The combined alarm system and roll-up screen assembly 1610 may also include an optical fiber 1016 in place of the conductive wire 516.

Figure 60:
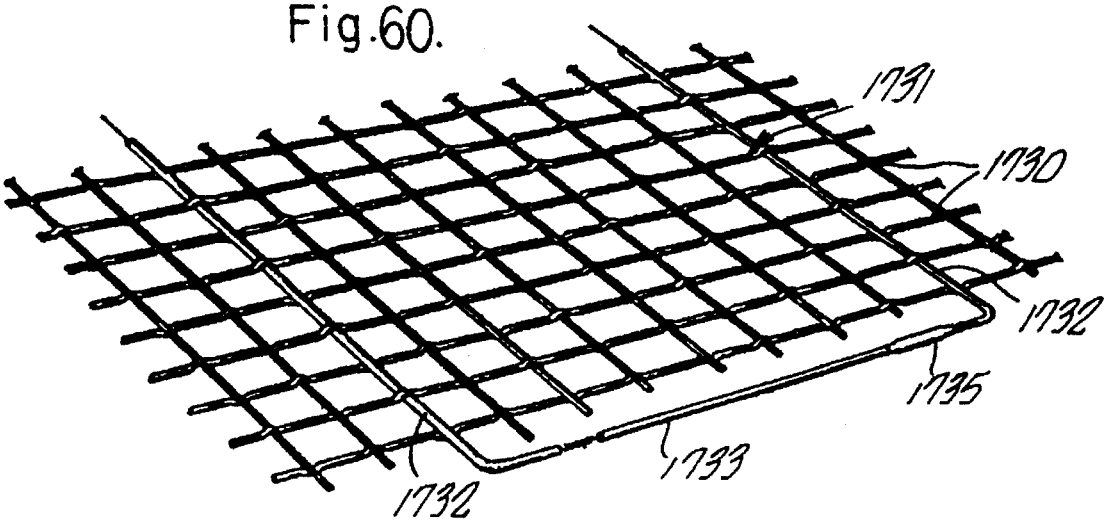
FIG. 60 is a perspective drawing of the alarm screen mesh of U.S. Pat. No. 4,232,310.
Figure 61:
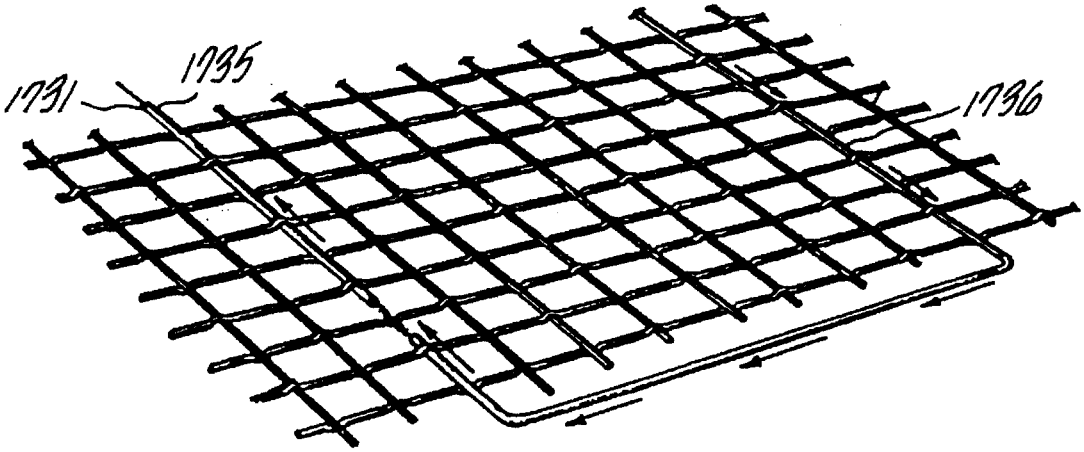
FIG. 61 is a perspective drawing of the alarm screen mesh of FIG. 60 which is being used to construct an alarm screen mesh.
Figure 62:
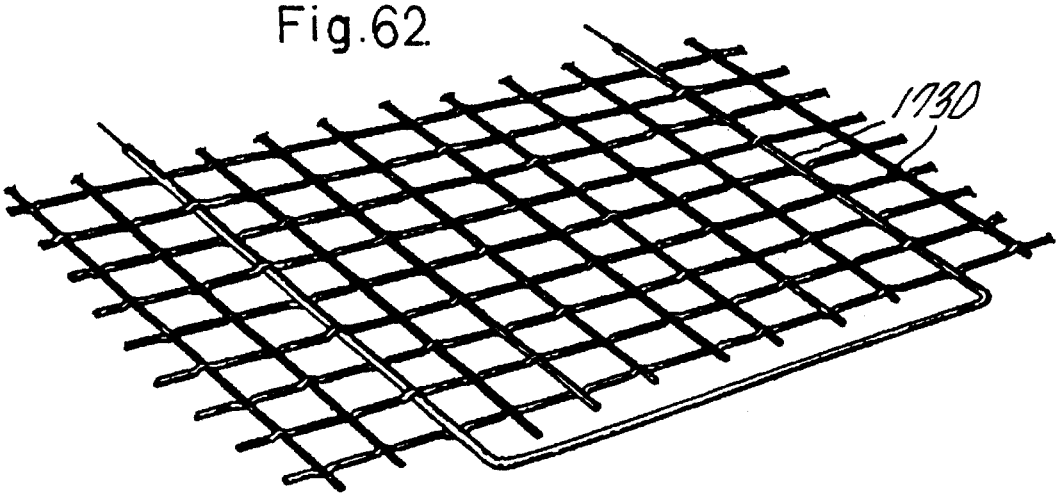
FIG. 62 is a perspective drawing of the constructed alarm screen mesh of FIG. 61 which includes a screen mesh and a conductive wire without any splices.

Referring to FIG. 60 in conjunction with FIG. 61 and FIG. 62 the alarm screen mesh of U.S. Pat. No. 4,232,310 includes a screen mesh 1730 and a conductive wire 1731. The screen mesh 1730 is formed from a sheet of screen material and has marginal edge portions which are adapted to be secured to a frame. The conductive wire 1731 has a first plurality of parallel segments 1732 and a second plurality of parallel segments 1733. The first plurality of parallel segments 1732 are spaced apart and interwoven into the screen mesh 1730 and the second plurality of parallel segments 1733 are contiguous at each end to one of the first plurality of parallel segments 1732 and are interwoven into the screen mesh 1730. The second plurality of parallel segments 1733 have been disposed perpendicular to the first plurality of parallel segments 1732. The ends 1734 of each parallel segment 1732 are mechanically coupled to the ends of the two contiguous parallel segment 1733. A plastic sheath 1735 covers the mechanically coupled ends 1734 in order to protect them from environmental elements. A conductive wire 1736 replaces the integral conductive wire 1731 of U.S. Pat. No. 4,232,310 in the screen mesh 1730. The conductive wire 1731 is used to pull the conducive wire 1736 through the screen mesh 1730 in order to form an alarm screen mesh 1740 which is protected from the environmental elements. The conductive wire 1731 has a first plurality of parallel segments and a second plurality of parallel segments. The first plurality of parallel segments have been spaced apart and interwoven into the screen mesh and the second plurality of parallel segments is contiguous at each end to one of the first plurality of parallel segments and have not been interwoven into the screen mesh. The second plurality of parallel segments have been disposed perpendicular to the first plurality of parallel segments. All of the first and second pluralities of parallel segments of the conductive wire 1731 have been spliced together. None of the first and second pluralities of parallel segments of the conductive wire 1736 have been spliced together. In another embodiment a length of optical fiber 1016 may be substituted in place of the length of conductive wire. None of the first and second pluralities of parallel segments of the optical fiber 1016 have been spliced together.

Figures 63, 64, 65:
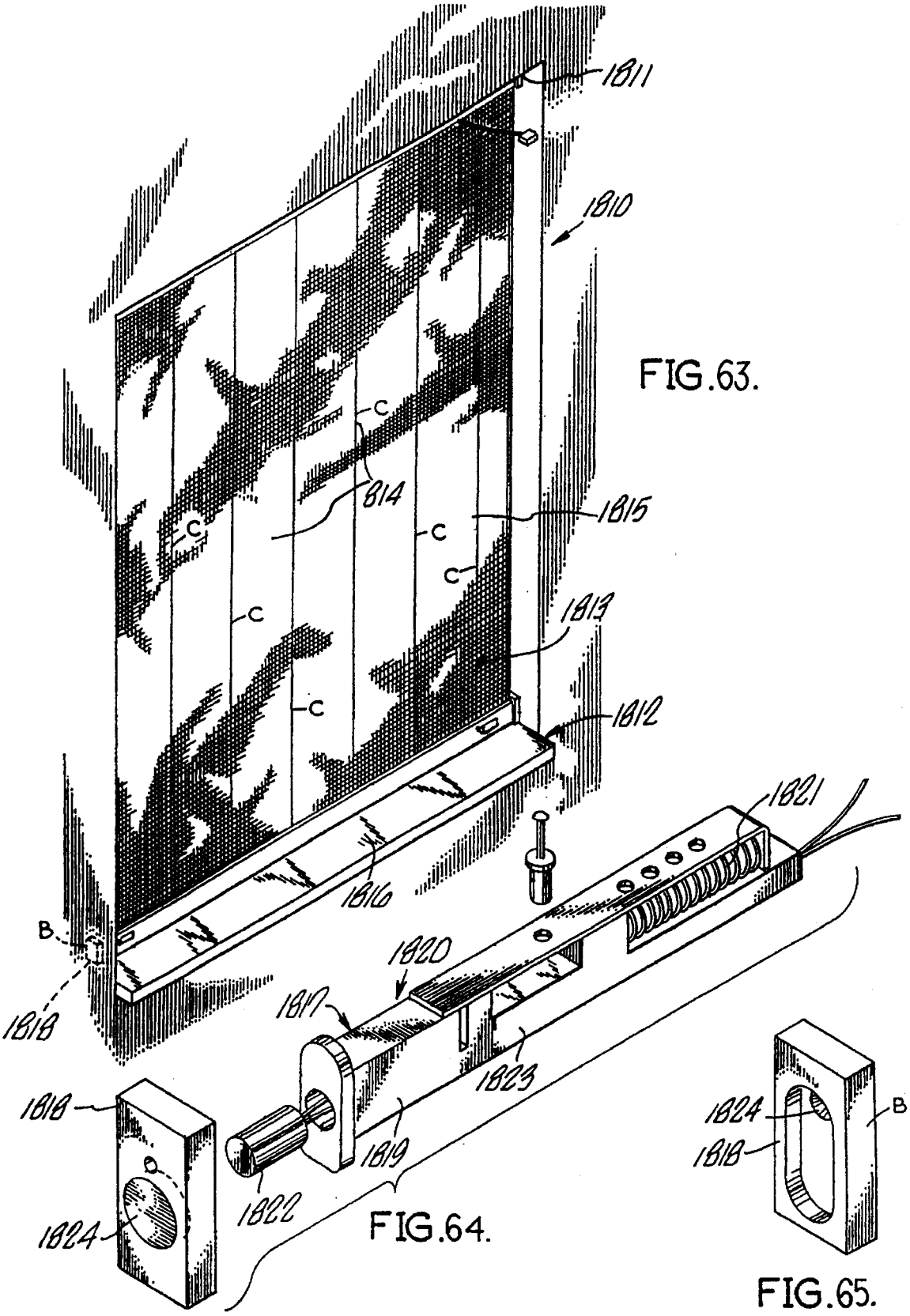
FIG. 63 is a perspective drawing of a combined alarm system and screen assembly of the prior art in accordance with the principles of U.S. Pat. No. 4,839,632.
FIG. 64 is a perspective drawing of a bottom bracket and a mounting assembly of the combined alarm system and screen assembly of FIG. 63.
FIG. 65 is a perspective drawing of the bottom bracket of FIG. 64 after it has been rotated one hundred eighty degrees.

Referring to FIG. 63 in conjunction with FIG. 64 and FIG. 65 U.S. Pat. No. 4,839,632 teaches a combined alarm system and screen assembly 1810 which includes a top housing assembly 1811, a bottom housing assembly 1812, a screen mesh 1813 and a circuit 1814 including a length of conductive wire 1815 which is coupled in the screen mesh 1813. The bottom housing assembly 1812 includes a bottom rail 1816, two end piece assemblies 1817, two bottom brackets 1818 and two mounting assemblies 1819. Each end piece assembly 1817 includes a circuit closing mechanism 1820, a spring 1821 and a reed-relay switch 1822. Each circuit closing mechanism 1820 is disposed at one corner of the bottom housing assembly 1812 and includes two mounting assembly 1823, Each bottom bracket 1818 includes a magnet 1824. The circuit closing mechanism 1820 acts between the bottom bracket 1818 there and the adjacent end piece assembly 1817 to close the circuit of the alarm device through the conductive wire 1815 in the screen mesh 1813 only when both end piece assemblies 1817 are held by both of the bottom brackets 1818.

Figure 66:
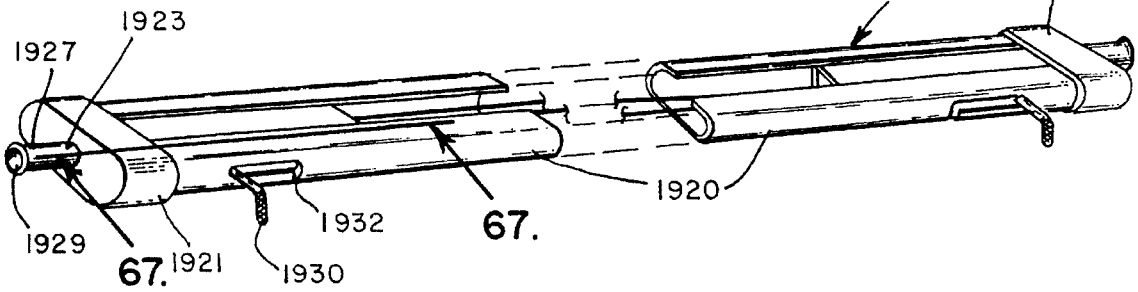
FIG. 66 is a fragmented perspective drawing of a bottom housing assembly for use in any of the combined alarm system and window covering assemblies.

Referring to FIG. 66 in conjunction with FIG. 56, FIG. 67, FIG. 68 and FIG. 69 a bottom housing assembly 1912 includes a bottom rail 1920, two end pieces 1921 and two mounting assemblies 1922. Each end piece 1921 has a hole 1923 therein. The bottom housing assembly 1912 may be incorporated into the combined alarm system and roll-up screen assembly 1610. Each mounting assembly 1922 includes a housing 1924, a spring 1925, a spacer 1926, a plunger 1927, a reed-relay switch 1928 and a cap 1929. The reed-relay switch 1928 is disposed in the plunger 1927. Each cap 1929 covers one of the ends of the plunger 1927. The spring 1925 is coupled to the plunger 1927 by the spacer 1926 at its other end and resiliently couples the plunger 1927 to the housing 1924. Each plunger 1927 is slidably coupled to the housing 1924 and projects from the hole 1923 in one of the end pieces 1921. The reed-relay switch 1928 is electrically coupled to a length of conductive wire 516.

Figure 67:
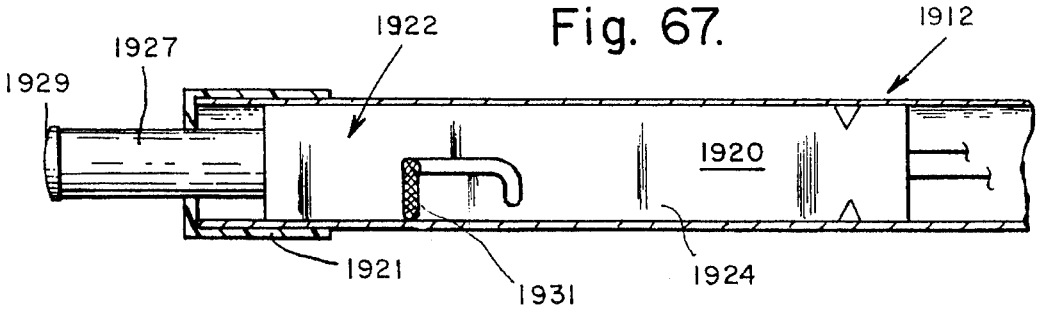
FIG. 67 is a fragmented longitudinal view in partial cross-section of the bottom housing assembly of FIG. 66.
Figure 70:
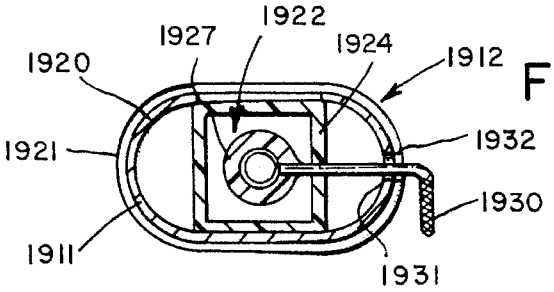
FIG. 70 is a cross-sectional view of the bottom housing assembly of FIG. 66 taken along the line 70—70 of FIG. 68.
Figure 69:
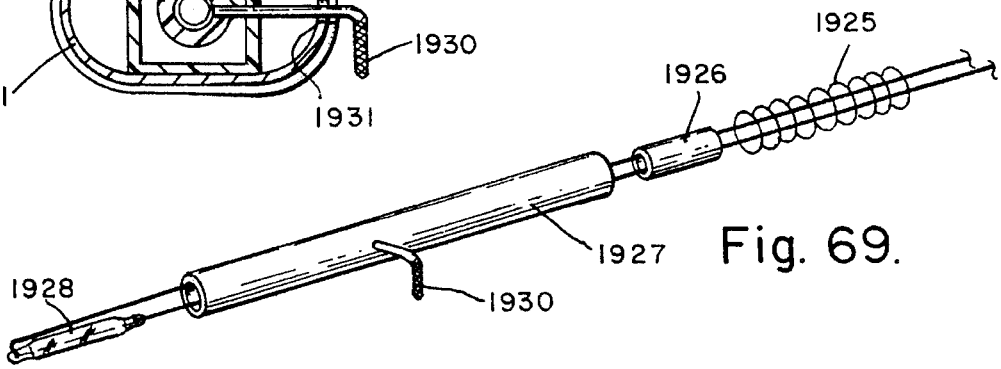
FIG. 69 is an exploded perspective drawing of the spring mechanism of FIG. 68.
Figure 68:
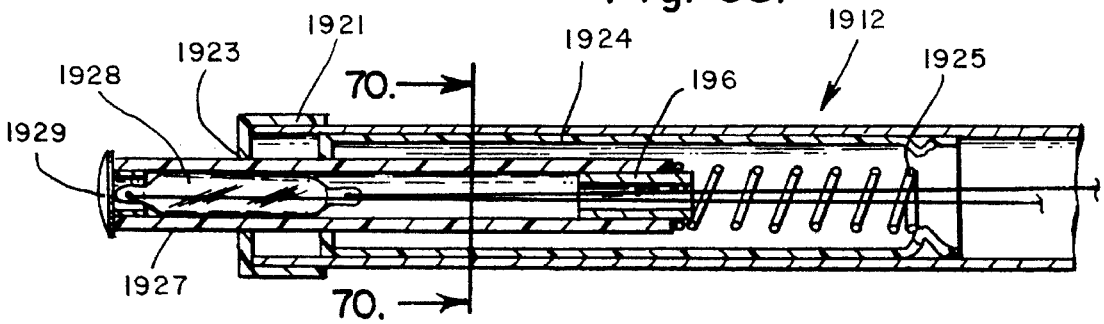
FIG. 68 is a fragmented longitudinal view in cross-section of the bottom housing assembly of FIG. 66 including a spring mechanism.

Referring to FIG. 70 in conjunction with FIG. 66 and FIG. 67 each mounting assembly 1922 also includes a lever-arm 1930. Each housing 1924 has a slot 1932 which is aligned with one of the lever-arms 1930. The bottom rail 1920 also has a slot 1931 at each end which is aligned with one of the lever-arms 1930.

Referring to FIG. 71 in conjunction with FIG. 66, FIG. 72 and FIG. 73 a bottom bracket 2010 includes a mounting plate 2011 and a breakaway base 2012. The mounting plate 2011 has a receiving slot 2013 which receives the plunger 1927. The mounting plate 2011 also has a magnet 2014. A mounting assembly 1922 of the bottom housing assembly 1912 is inserted into the bottom bracket 2010.

Referring to FIG. 74 in conjunction with FIG. 75 a bottom housing assembly 2110 includes a bottom rail 2112, two end pieces 2113 and two mounting assemblies 2114. Each end piece 2113 has a hole 2115 therein. Each mounting assembly 2114 includes a housing 2116, a spring 2117, a spacer 2118, a first plunger 2119, a second plunger 2120, a reed-relay switch 2121 and a cap 2122. The reed-relay switch 2121 is disposed in the first plunger 2119. Each cap 2122 covers one of the ends of the first plunger 2119. The first plunger 2119 at its other end is coaxially disposed and threadedly coupled to the second plunger 2120 at one of its end. The spring 2117 is coupled to the second plunger 2120 by the spacer 2118 at its other end and resiliently couples the second plunger 2120 to the housing 2116. The second plunger 2120 is slidably coupled to the housing 2116 and projects from the hole 2115 in one of the end pieces 2113. The reed-relay switch 2121 is electrically coupled to the length of conductive wire 516. The bottom housing assembly 2110 is used with the two bottom brackets 2010.

Figure 76:
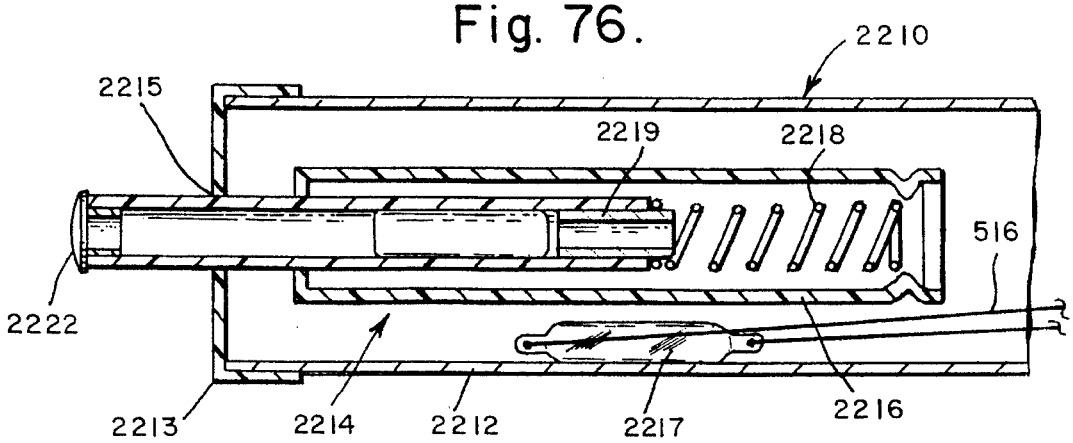
FIG. 76 is a fragmented longitudinal view in cross-section of a bottom housing assembly for use in a combined alarm system and window covering assembly.

Referring to FIG. 76 a bottom housing assembly 2210 includes a bottom rail 2212, two end pieces 2213 and two mounting assemblies 2214. Each end piece 2213 has a hole therein. Each mounting assembly 2214 includes a housing 2216, a reed-relay switch 2217, a spring 2218, a spacer 2219, a plunger 2220, a magnet 2221 and a cap 2222. The reed-relay switch 2217 is disposed in the housing 2216. The magnet 2221 is disposed in the plunger 2220. Each cap 2222 covers one end of the plunger 2220. The spring 2218 is coupled to the plunger 2220 by the spacer 2219 at its other end and resiliently couples the plunger 2220 to the housing 2216. Each plunger 2220 is slidably coupled to one of the housings 2220 and projects from the hole 2215 in one of the end pieces 2213. The reed-relay switch 2217 is electrically coupled to the length of conductive wire 516. The bottom housing assembly 2210 is used with the two bottom brackets 2010 without the magnets.

Figure 77:
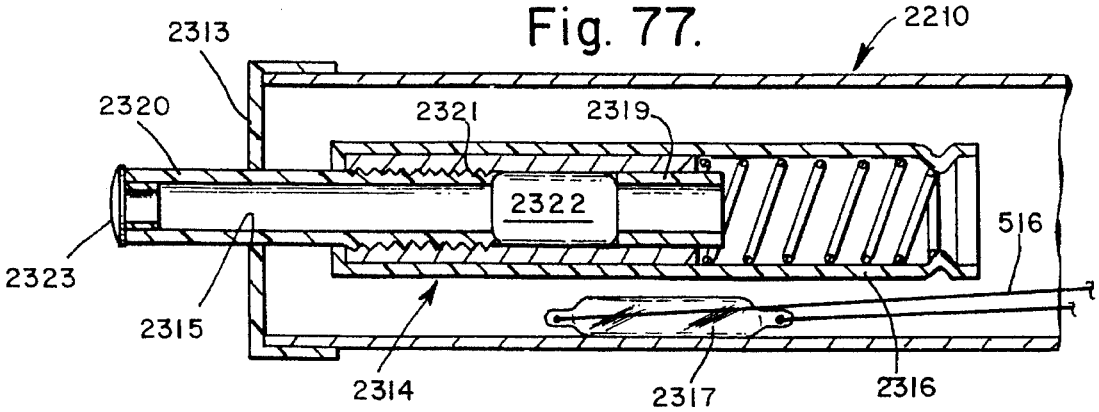
FIG. 77 is a fragmented longitudinal view in cross-section of a bottom housing assembly for use in a combined alarm system and window covering assembly.

Referring to FIG. 77 a bottom housing assembly 2310 includes a bottom rail 2312, two end pieces 2313 and two mounting assemblies 2314. Each end piece 2313 has a hole 2315 therein. Each mounting assembly 2314 includes a housing 2316, a reed-relay switch 2317, a spring 2318, a spacer 2319, a first plunger 2320, a second plunger 2321, a magnet 2322 and a cap 2323. The reed-relay switch 2317 is disposed in the housing 2314. The magnet 2322 is disposed in the first plunger 2321. Each cap 2323 covers one of the ends of the first plunger 2320. The first plunger 2320 at its other end is coaxially disposed and threadedly coupled to the second plunger 2321 at one of its end. The spring 2318 is coupled to the second plunger 2321 by the spacer 2319 at its other end and resiliently couples the second plunger 2321 to the housing 2316. Each second plunger 2321 is slidably coupled to one of the housings 2316 and projects from the hole 2315 in one of the end pieces 2315. The reed-relay switch 2317 is electrically coupled to the length of conductive wire 516. The bottom housing assembly 2310 is used with the two bottom brackets 2010 without the magnets.

Figure 78:
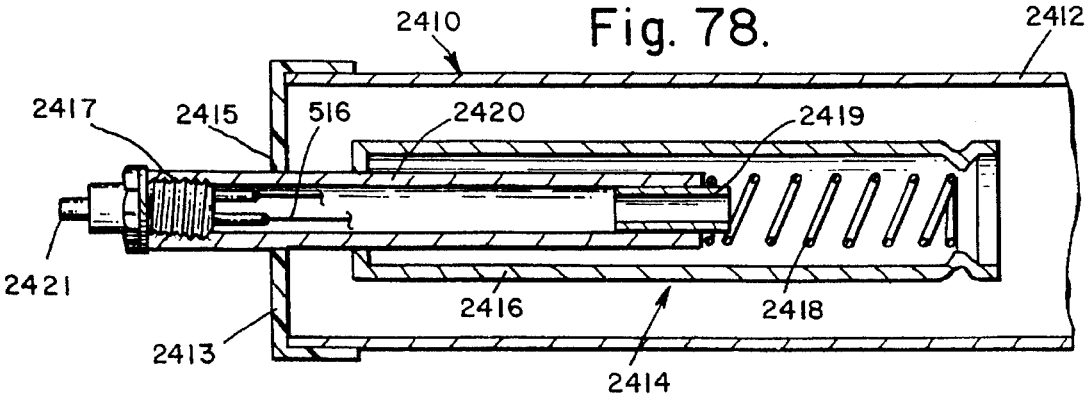
FIG. 78 is a fragmented longitudinal view in cross-section of a bottom housing assembly for use in a combined alarm system and window covering assembly.

Referring to FIG. 78 a bottom housing assembly 2410 includes a bottom rail 2412, two end pieces 2413 and two mounting assemblies 2414. Each end piece 2413 has a hole 2415 therein. Each mounting assembly 2414 includes a housing 2416, a momentary switch 2417, a spring 2418, a spacer 2419, a plunger 2420 and a cap 2421. The momentary switch 2417 is disposed in the plunger 2420. Each cap 2421 covers one of the ends of the plunger 2420. The spring 2418 is coupled to the plunger 2420 by the spacer 2419 at its other end and resiliently couples the plunger 2420 to the housing 2416. Each plunger 2420 is slidably coupled to one of the housings 2416 and projects from the hole 2415 in one of the end pieces 2413. The momentary switch 2417 is electrically coupled to the length of conductive wire 516. The bottom housing assembly 2410 is used with the two bottom brackets 2010 without the magnets.

Figure 79:
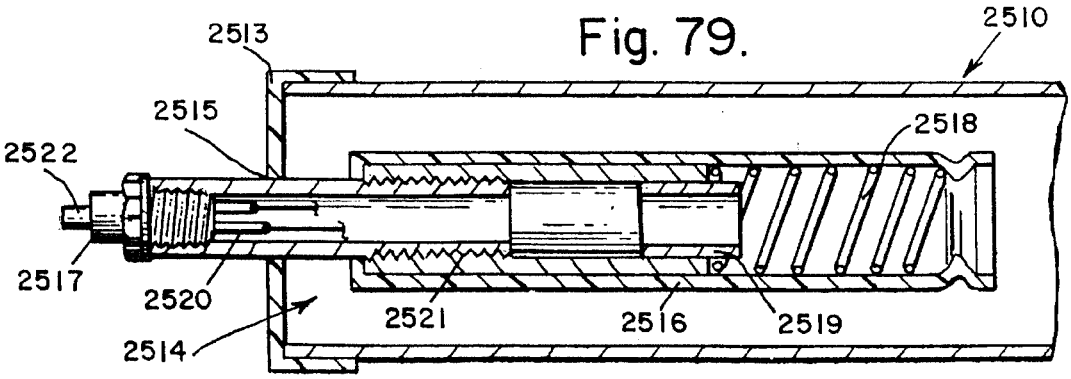
FIG. 79 is a fragmented longitudinal view in cross-section of a bottom housing assembly for use in a combined alarm system and window covering assembly.

Referring to FIG. 79 a bottom housing assembly 2510 includes a bottom rail 2512, two end pieces 2513 and two mounting assemblies 2514. Each end piece 2513 has a hole 2515 therein. Each mounting assembly 2514 includes a housing 2516, a momentary switch 2517, a spring 2518, a spacer 2519, a first plunger 2520, a second plunger 2521 and a cap 2522. The momentary switch 2517 is disposed in the first plunger 2520. Each cap 2522 covers one of the ends of the first plunger 2520. Each first plunger 2520 at its other end is coaxially disposed and threadedly coupled to one of the second plungers 2521 at one of its end. The spring 2518 is coupled to the second plunger 2521 by the spacer 2519 at its other end and resiliently couples the second plunger 2521 to the housing 2516. Each second plunger 2521 is slidably coupled to one of the housings 2516 and projects from the hole 2513 in one of the end pieces 2513. The momentary switch 2517 is electrically coupled to the length of conductive wire 516. The bottom housing assembly 2510 is used with the two bottom brackets 2010 without the magnets.

Figure 82:
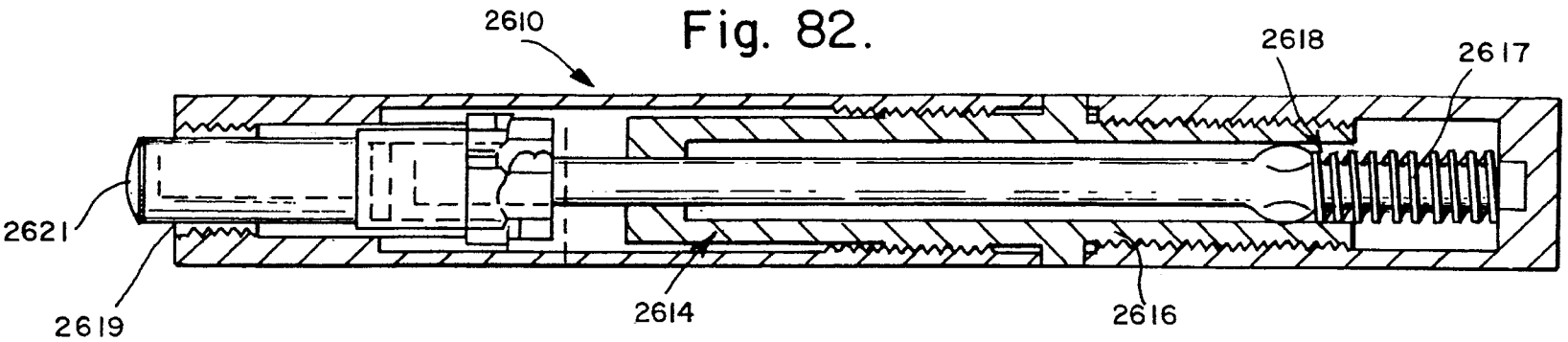
FIG. 82 is a longitudinal view in cross-section of the protracting and retracting mechanism of FIG. 80 in a second position.
Figure 81:
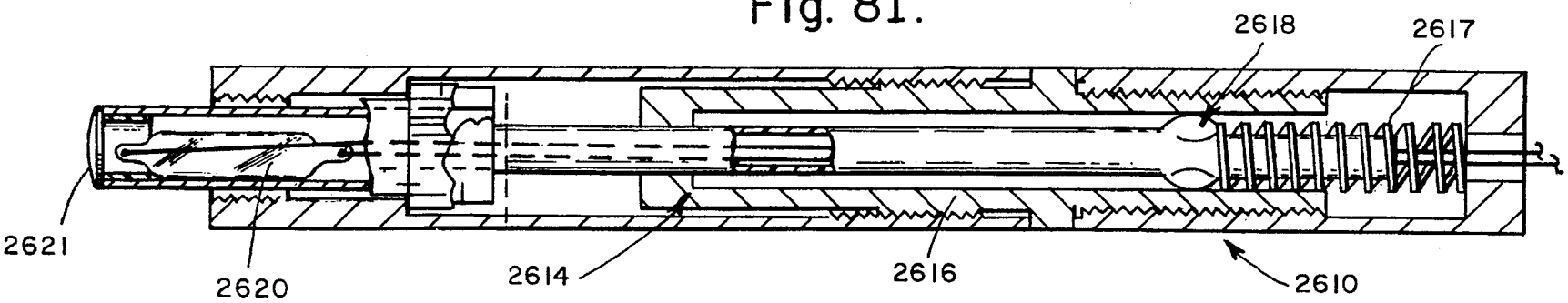
FIG. 81 is a longitudinal view in cross-section of the protracting and retracting mechanism of FIG. 80 in a first position.
Figure 80:
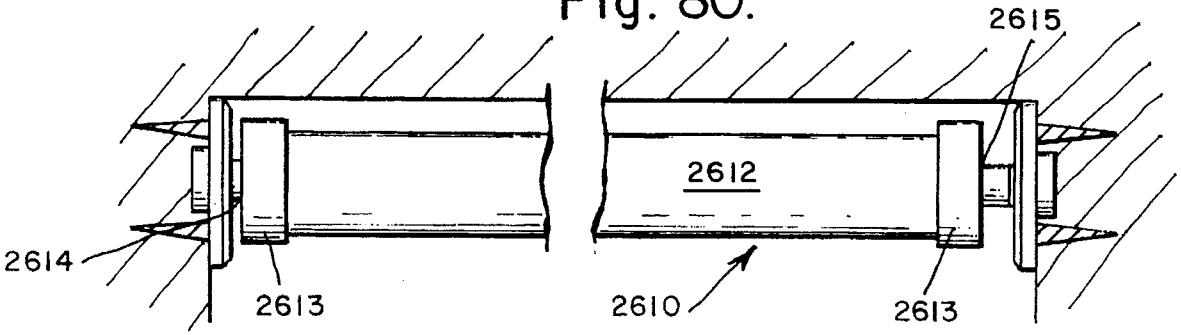
FIG. 80 is a fragmented longitudinal view in cross-section of a bottom housing assembly including a protracting and retracting mechanism for use in a combined alarm system and window covering assembly.

Referring to FIG. 80 in conjunction with FIG. 81 and FIG. 82 a bottom housing assembly 2610 includes a bottom rail 2612, two end pieces 2613 and two mounting assemblies 2614. Each end piece 2613 has a hole 2615 therein. Each mounting assembly 2614 includes a housing 2616, a spring 2617, a protracting and retracting mechanism 2618, a plunger 2619, a reed-relay switch 2620 and a cap 2621. The reed-relay switch 2620 is disposed in the plunger 2619. Each cap 2621 covers one of the ends of the plunger 2619. U.S. Pat. No. 3,137,276 teaches a protracting and retracting mechanism for use in a writing instrument. The spring 2617 couples to the plunger 2619 to the protracting and retracting mechanism 2618 at its other end and resiliently couples the plunger 2619 to the housing 2616. Each plunger 2619 is slidably coupled to the housing 2616 and projects from the hole 2615 in one of the end pieces 2613. The reed-relay switch 2620 is electrically coupled to the length of conductive wire 516. The bottom housing assembly 2610 is inserted into the bottom bracket 2010.

Figure 83:
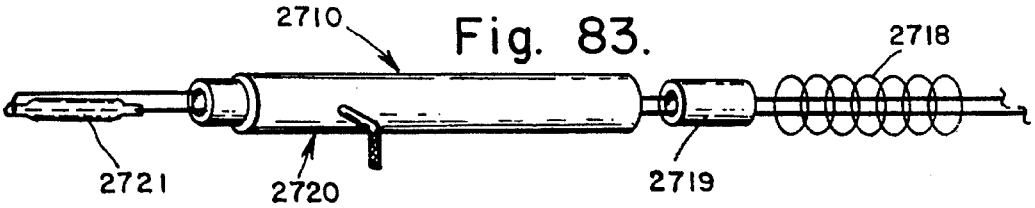
FIG. 83 is an exploded perspective view of the spring mechanism of a bottom housing assembly in accordance with the twenty ninth embodiment.

Referring to FIG. 83 a bottom housing assembly 2710 includes a bottom rail, two end pieces and two mounting assemblies. Each end piece has a hole therein. Each mounting assembly includes a housing, a spring 2718, a spacer 2719, a telescoping plunger 2720, a reed-relay switch 2721 and a cap. The reed-relay switch 2721 is disposed in the telescoping plunger 2720.

Figure 85:
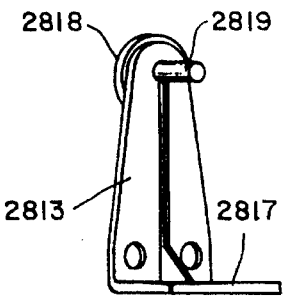
FIG. 85 is a perspective view of the bottom bracket of FIG. 84.
Figure 84:
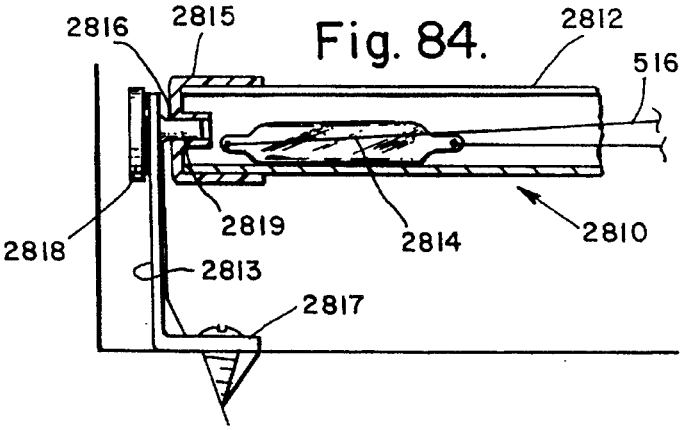
FIG. 84 is a fragmented perspective view of a bottom housing assembly and a bottom bracket for use in any of the combined alarm system and window covering assemblies in accordance with the thirtieth embodiment.

Referring to FIG. 84 in conjunction with FIG. 85 a bottom housing assembly 2810 includes a bottom rail 2812, two bottom brackets 2813, two reed-relay switches 2814 and two end pieces 2815. Each end piece 2815 has a hole 2816 therein. The reed-relay switch 2814 is disposed in the bottom rail 2812 and is electrically coupled to the length of conductive wire 516. Each bottom bracket 2813 includes a mounting plate 2817 and a magnet 2818. Each mounting plate 2816 has a projection 2819 which engages the hole 2816 of one of the end pieces 2815.

Figure 86:
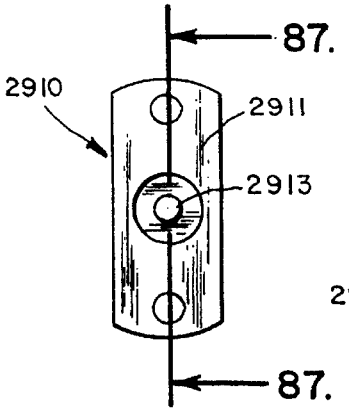
FIG. 86 is a front elevational view of a bottom bracket in accordance with the thirty first embodiment.
Figure 87:
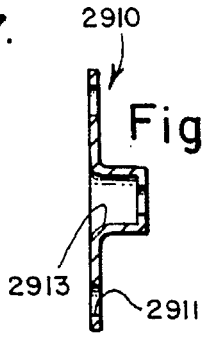
FIG. 87 is a cross-sectional view of the bottom bracket of FIG. 86 taken along line 87—87 of FIG. 86.
Figure 88:
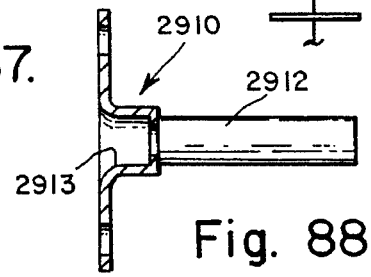
FIG. 88 is a cross-sectional view of the bottom bracket of FIG. 86 also taken along line 87—87 of FIG. 86 which includes a magnet.

Referring to FIG. 86 in conjunction with FIG. 87 and FIG. 88 a bottom bracket 2910 includes a mounting plate 2911 and a magnet 2912. The mounting plate 2911 has a hole 2913 which engages the plunger of one of the mounting assemblies.

Figure 89:
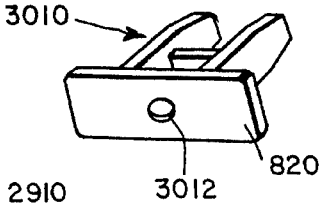
FIG. 89 is a perspective view of an end piece in accordance with the thirty second embodiment.

Referring to FIG. 89 in conjunction with FIG. 85 the bottom housing assembly 3010 has a pair of end pieces 3011. Each end piece 820 has a hole 3012 and is coupled to the one of ends of the bottom housing assembly 512.

Figure 90:
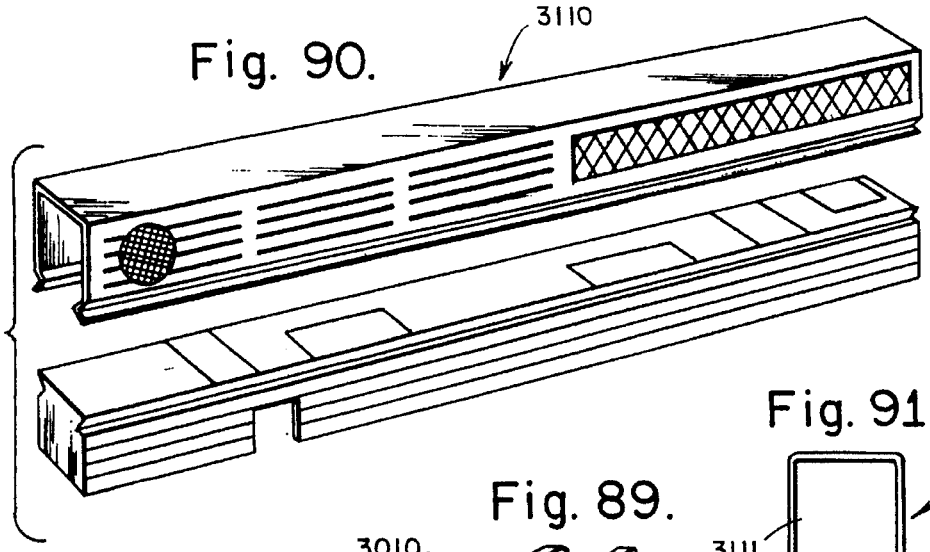
FIG. 90 is an exploded perspective view of a top housing assembly in accordance with the thirty third embodiment which may be used with the combined alarm system and blind assembly of FIG. 1.
Figure 91:
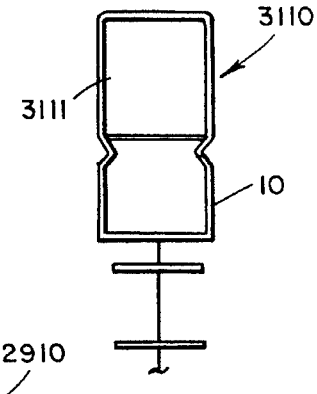
FIG. 91 is a side elevational view of the top housing assembly of FIG. 90.

Referring to FIG. 90 in conjunction with FIG. 1 and FIG. 91 a top housing assembly 3110 may be used with the combined alarm system and blind assembly 10. The top housing assembly 3110 includes an enclosure 3111 into which an alarm device may be placed.

Referring to FIG. 92 in conjunction with FIG. 93, FIG. 94 and FIG. 95 a combined alarm system and blind assembly 3210 includes a top assembly 3211, a bottom assembly 3212, a fabric blind system 3213 and a conductive wire 3214. The top assembly 3211 includes a rotating rail 3215. The fabric blind system 3213 includes a front fabric facing 3216, a back fabric facing 3217 and a plurality of fabric supports 3218 which couple the front and back fabric facings 3216 and 3217 to each other. A conductive wire 3214 may be replaced by an optical fiber.

Figure 96:
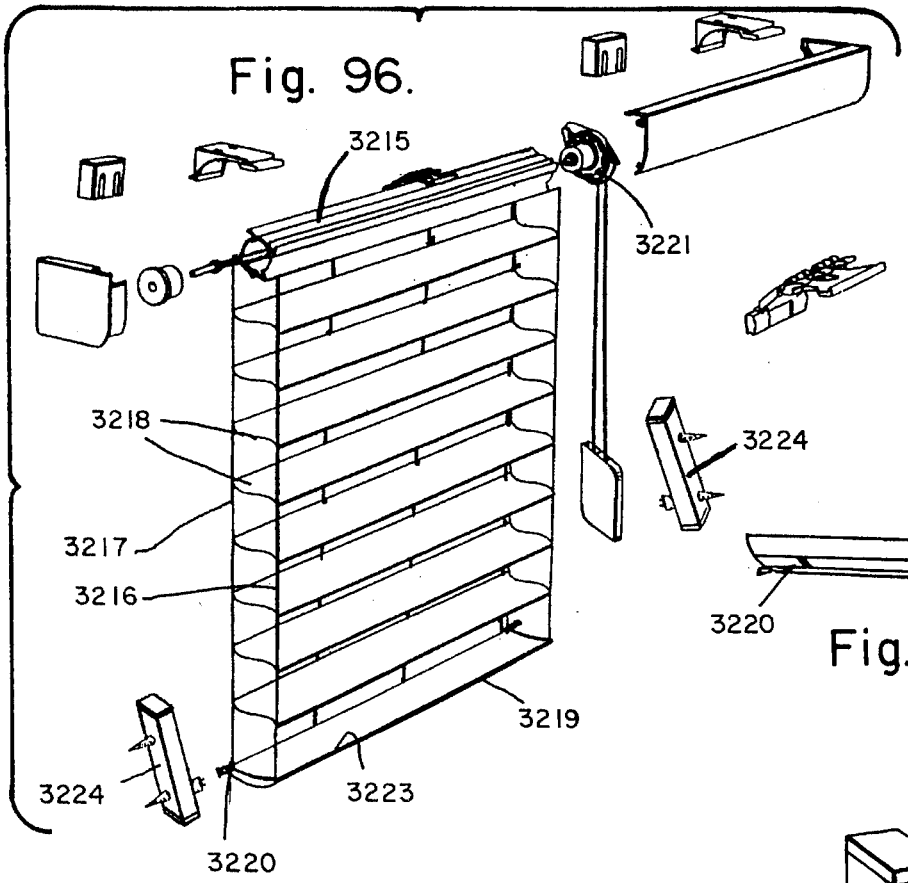
FIG. 96 is an exploded perspective view of a combined alarm system and blind assembly which includes a top assembly having a rotating rail, a bottom housing assembly including a bottom rail with a pair of plunger-activated switches disposed therein and a pair of brackets each with a slidable plunger-mount and a magnet, and a continuous length of optical fiber in accordance with the thirty sixth embodiment.
Figure 97:
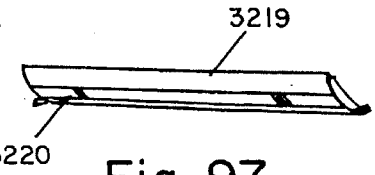
FIG. 97 is a perspective of the bottom housing assembly of the combined alarm system and blind assembly of FIG. 95.

Referring to FIG. 96 in conjunction with FIG. 96 and FIG. 97 the bottom housing assembly 3212 includes a bottom rail 3219 with a pair of plunger-activated switches 3220 which are disposed therein.

Figure 98:
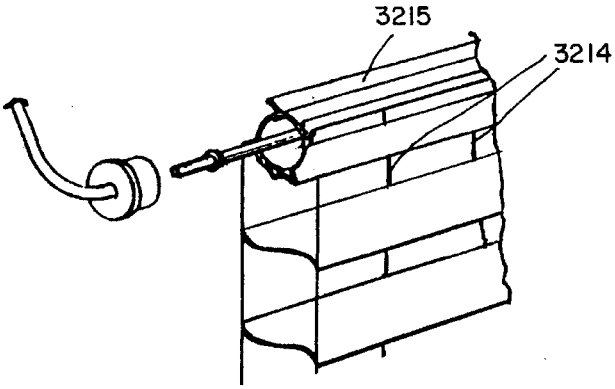
FIG. 98 is a fragmented perspective of the combined alarm system and blind assembly of FIG. 95.
Figure 99:
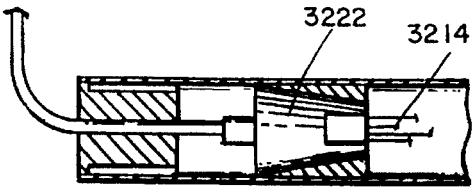
FIG. 99 is a front elevational view in cross-section of the rotating rail of FIG. 96 which includes a rotatable electrical connector.

Referring to FIG. 98 in conjunction with FIG. 96 and FIG. 99 the rotating rail 3215 includes a roll-up mechanism 3221 and a rotatable electrical connector 3222. The roll-up mechanism 3221 raises and lowers the bottom rail 3212 and the fabric blind system 3213. The rotatable electrical connector 3222 has a first input terminal, a second input terminal, a first output terminal and a second output terminal and is disposed in the rotating rail 3212. The first and second ends of the conductive wire 516 are electrically coupled to the first and second input terminals of the rotatable electrical connector 3222.

Figure 100:
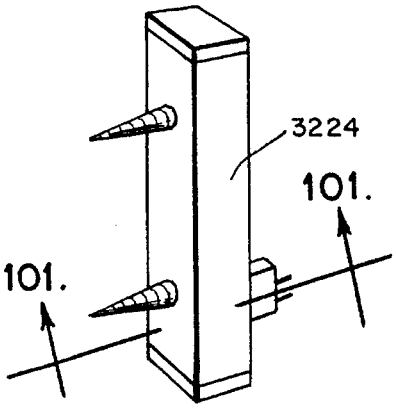
FIG. 100 is a perspective of one of the brackets of FIG. 96.
Figure 101:
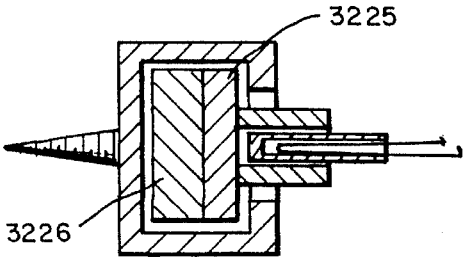
FIG. 101 is a cross-sectional view of one of the brackets of FIG. 96 taken along line 101—101 of FIG. 100.

Referring to FIG. 96 in conjunction with FIG. 100 and FIG. 101 the bottom housing assembly 3212 also includes a bottom fabric rail 3223, a pair of brackets 3224. Each bracket 3224 has a slidable plunger-mount 3225 and a magnet 3226.

Referring to FIG. 102 in conjunction with FIG. 103 a mercury switch 3310 includes a bulb 3311, two parallel conductive poles 3312 and the quantity of mercury 3313 are disposed in the bulb 3311. The two parallel conductive poles 3312 electrically couples the ends of two conductive wires 516. The quantity of mercury 3313 electrically couples the two parallel conductive poles 3311. When the mercury switch 3310 is moved the electrical coupling between the two parallel conductive poles 3311 is disrupted.

Referring to FIG. 104 in conjunction with FIG. 105 a reed relay-type switch 3410 for an optical fiber includes a mount 3411, a magnet 3412 and a lever-arm 3413. A segment of the optical fiber is disposed on the mount 3411. The magnet 3412 is disposed adjacent to the mount 3411. The lever-arm 3413 is coupled to the mount 3411 adjacent to the segment of the optical fiber and is resiliently biased by the magnet 3412. When magnet 3412 is removed the lever-arm 3413 presses against the segment of the optical fiber thereby changing the optical properties thereof.

Figure 107:
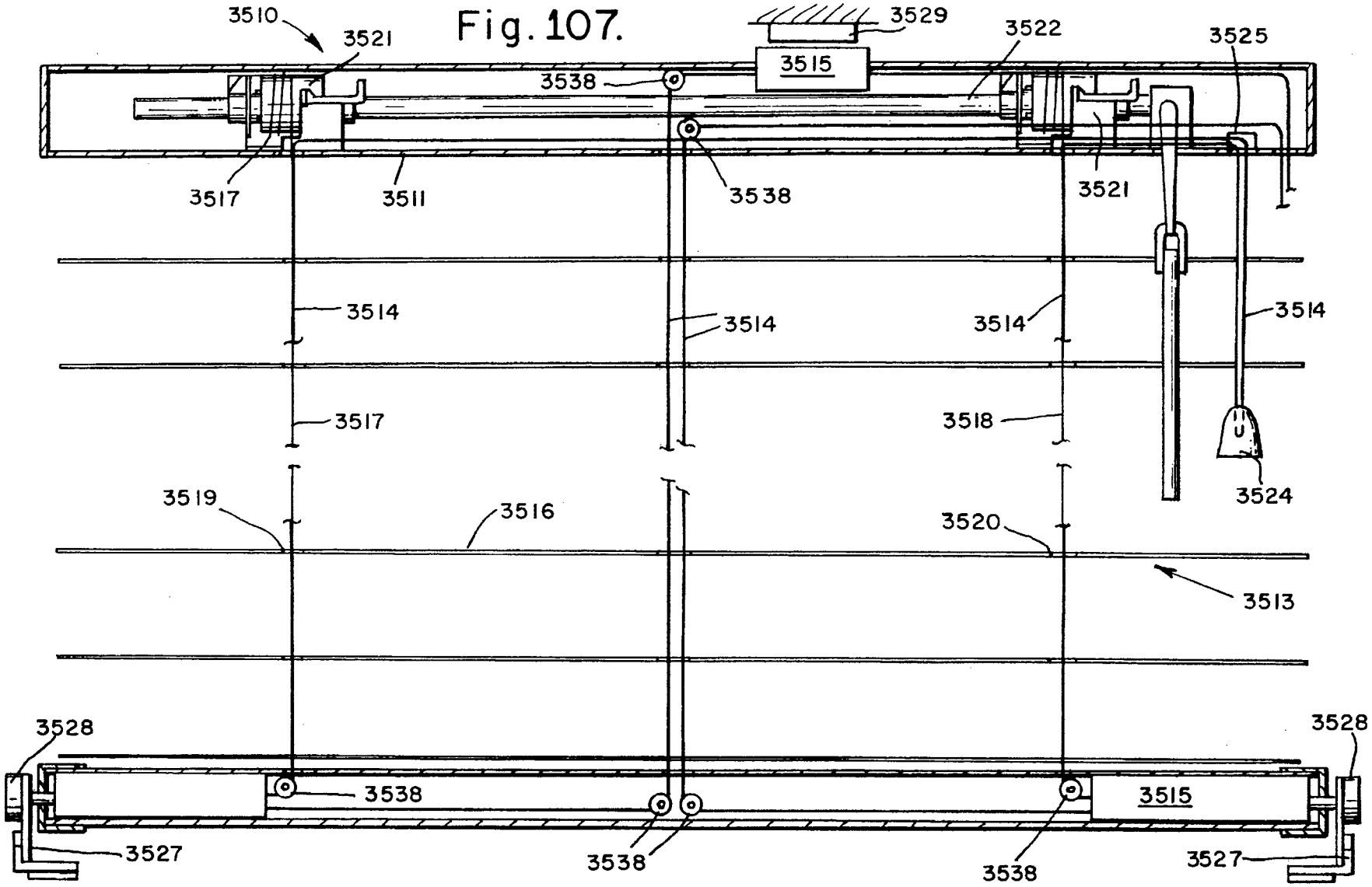
FIG. 107 is an elevational view in cross-section of the combined alarm system and blind assembly of FIG. 106.

Referring to FIG. 106 in conjunction with FIG. 107 a combined alarm system and window covering assembly 3510 includes a top housing 3511, a bottom rail 3512 having two ends, a covering 3513, a conductive wire 3514 and three resiliently biased reed relay switches 3515 one of which is disposed in the top housing 3511. The covering 3513 is mechanically coupled to the top housing 3511 and the bottom rail 3512. The conductive wire 3514 extends from the top housing 3511 down to the bottom rail 3512 and up from the bottom rail 3511 to the top housing 3511. The conductive wire 3514 functions as a pull cord for raising and lowering the bottom rail 3512.

Still referring to FIG. 106 in conjunction with FIG. 107 the covering 3513 includes a plurality of individual slats 3516, a first string ladder support system 3617 and a second string ladder support system 3518. Each slat 3516 has a first slot 3519 and a second slot 3520, which is spaced apart from the first slot 3519. The first string ladder support system 3517 has a front vertical ladder string and a back vertical ladder string with short support strings fastened between the front and back vertical ladder strings. The first string ladder support system 3517 is mechanically coupled to the top housing 3511 and the bottom rail 3512. Each short support string of the first string ladder support system 3517 supports one of the slats 3516 contiguous to the first slot 3519 thereof. The second string ladder support system 3518 has a front vertical ladder string and a back vertical ladder string with short support strings fastened between the front and back vertical ladder strings. The second string ladder support system 3518 is mechanically coupled to the top housing 3511 and the bottom rail 3512. Each short support string of the second string ladder support system 3518 supports one of the slats 3516 contiguous to the second slot 3520 thereof. The conductive wire 3514 extends from the top housing 3511 down through each of the first slots 3519 of the slats 3516 to the bottom rail 3512 and from the bottom rail 3512 through each of the second slots 3520 of the slats 3516 to the top housing 3511. The top housing 3511 has a tilting mechanism 3521, a tilt rod 3522 and a pull string assembly 3523 disposed therein. The tilt rod 3522 is mechanically coupled to the tilting mechanism 3521 and is fixedly coupled to the first and second string ladder support systems 3517 and 3518. The pull string assembly 3523 includes a pull tab 3524, a conductive wire 3514 and a cord lock unit 3525. The conductive wire 3514 is mechanically coupled to the pull tab 3524. The cord lock unit 3525 is disposed in the top housing 3511 and mechanically coupled thereto. An alarm device 3526 has a first input terminal and a second input terminal. The first and second ends of the conductive wire 3514 are electrically coupled to the first and second input terminals, respectively, of the alarm device 3526.

Referring to FIG. 106 in conjunction with FIG. 52, FIG. 53 and FIG. 107 the covering 3513 may be a single honeycomb shade which has a centerline and which is mechanically coupled to the top housing 3511 and the bottom rail 3512. The conductive wire 3514 is disposed along the centerline of the single honeycomb shade.

Referring to FIG. 106 in conjunction with FIG. 21, FIG. 22, FIG. 23, FIG. 31, FIG. 50, FIG. 51 and FIG. 107 the covering 3513 may also be a double honeycomb shade which has a centerline and which is mechanically coupled to the top housing 3511 and the bottom rail 3512. The conductive wire 3514 is disposed along the centerline of the double honeycomb shade.

Referring to FIG. 106 in conjunction with FIG. 31, FIG. 54 and FIG. 107 the covering 3513 may further be a triple honeycomb shade which has a centerline and which is mechanically coupled to the top housing 3511 and the bottom rail 3512. The conductive wire 3514 is disposed along the centerline of the triple honeycomb shade.

Referring to FIG. 106 in conjunction with FIG. 24, FIG. 27, FIG. 48, FIG. 49 and FIG. 107 the covering 3513 may still further be a pleated shade which has a centerline and which is mechanically coupled to the top housing 3511 and the bottom rail 3512. The conductive wire 3514 is disposed along the centerline of the pleated shade.

Figure 108:
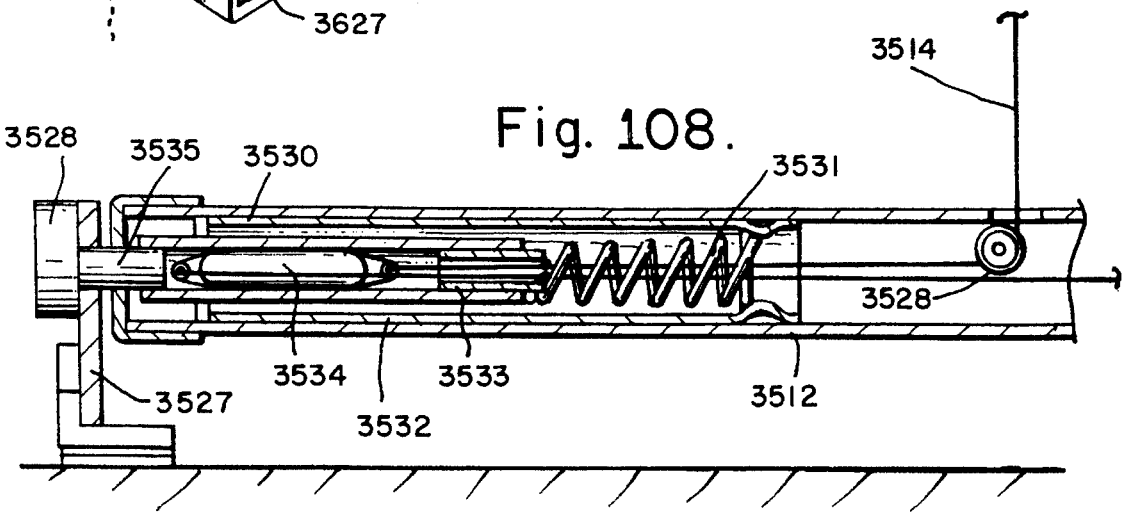
FIG. 108 is an enlarged, partial elevational view in cross-section of the first resiliently biased reed relay switch of FIG. 106.

Referring to FIG. 108 in conjunction with FIG. 106 and FIG. 107 there is a magnet 3529 disposed above the top housing 3511. Each resiliently biased reed relay switch 3515 includes a housing 3530, a spring 3531, a plunger 3532, a spacer 3533, a reed-relay switch 3534 and a removable cap 3535. The reed-relay switch 3534 is disposed in the plunger 3532. The removable cap 3535 covers one of the ends of the plunger 3532. The spring 3531 is coupled to the plunger 3532 by the spacer 3533 at its other end and resiliently couples the plunger 3532 to the housing 3530. The plunger 3532 is slidably coupled to the housing 3530. There are two end pieces 3536 each of which has a hole 3637 and is coupled to one of the ends of the bottom rail 3512. When used in the bottom rail 3512 the removable pin 3535 projects from the hole 3537 in one of the end pieces 3536. When used in the top housing 3511 the removable pin 3535 is removed. The reed-relay switch 3534 is electrically coupled to the conductive wire 3514. There are rollers 3538 disposed through the path of the conductive wire 3538.

Figure 109:
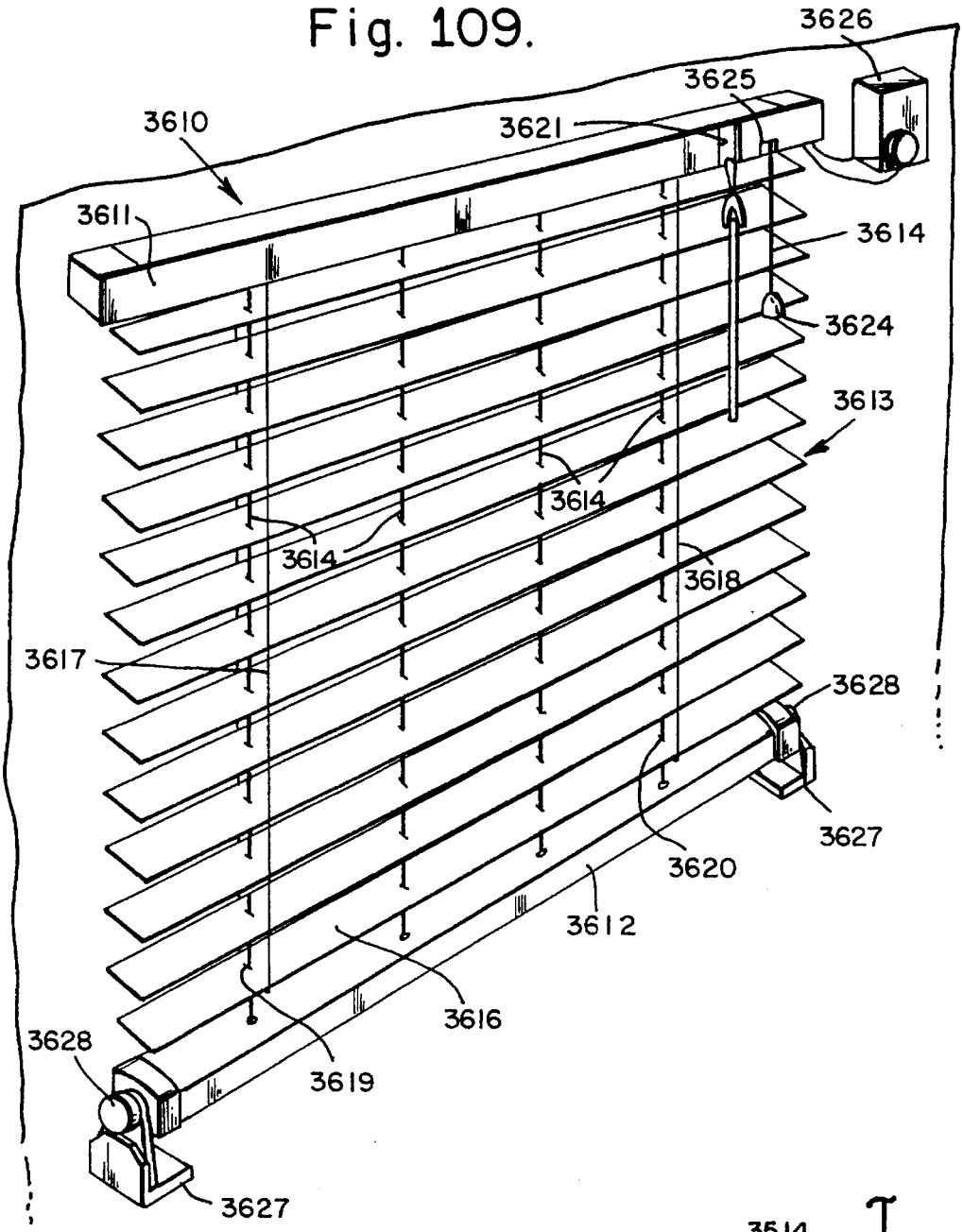
FIG. 109 is a perspective drawing of a combined alarm system and blind assembly which includes a plurality of slats, a top housing assembly including two second resiliently biased alarm switches, a bottom housing rail including two first resiliently biased reed relay switches and a conductive wire in accordance with the second embodiment.
Figure 110:
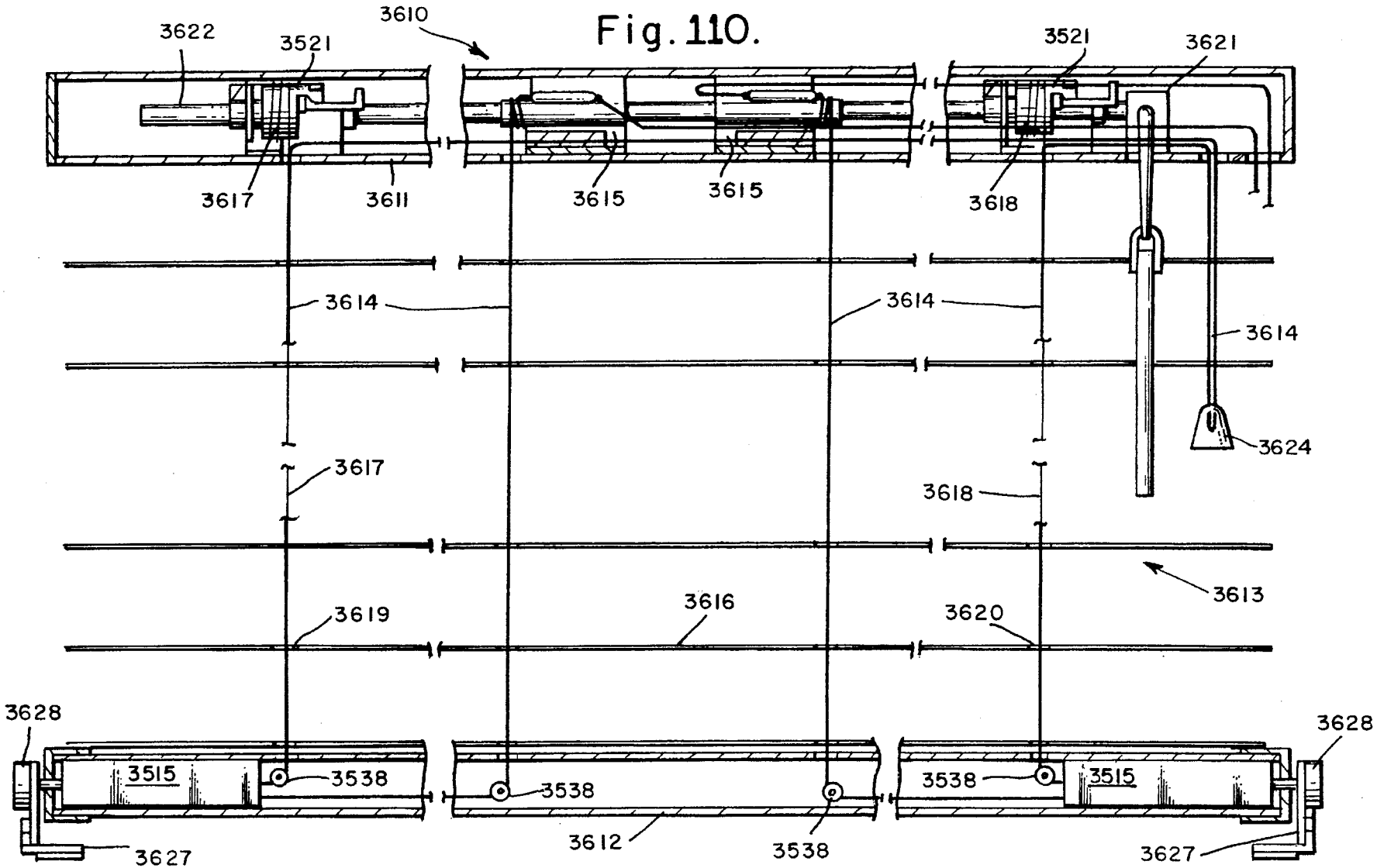
FIG. 110 is an elevational view in cross-section of the combined alarm system and blind assembly of FIG. 109.

Referring to FIG. 109 in conjunction with FIG. 110 a combined alarm system and window covering assembly 3610 includes a top housing 3611, a bottom rail 3612 having two ends, a covering 3613, a conductive wire 3614, two of the resiliently biased reed relay switches 3515 and two rotatable, resiliently biased reed relay switches 3615. The covering 3613 is mechanically coupled to the top housing 3611 and the bottom rail 3612. The conductive wire 3614 extends from the top housing 3611 down to the bottom rail 3612 and up from the bottom rail 3612 to the top housing 3611. The conductive wire 3614 functions as a pull cord for raising and lowering the bottom rail 3612.

Still referring to FIG. 109 in conjunction with FIG. 110 the covering 3613 includes a plurality of individual slats 3616, a first string ladder support system 3617 and a second string ladder support system 3618. Each slat 3616 has a first slot 3619 and a second slot 3620, which is spaced apart from the first slot 3619. The first string ladder support system 3617 has a front vertical ladder string and a back vertical ladder string with short support strings fastened between the front and back vertical ladder strings. The first string ladder support system 3617 is mechanically coupled to the top housing 3611 and the bottom rail 3612. Each short support string of the first string ladder support system 3617 supports one of the slats 3616 contiguous to the first slot 3618 thereof. The second string ladder support system 3618 has a front vertical ladder string and a back vertical ladder string with short support strings fastened between the front and back vertical ladder strings. The second string ladder support system 3618 is mechanically coupled to the top housing 3611 and the bottom rail 3612. Each short support string of the second string ladder support system 3618 supports one of the slats 3616 contiguous to the second slot 3620 thereof. The conductive wire 3614 extends from the top housing 3611 down through each of the first slots 3618 of the slats 3616 to the bottom rail 3612 and from the bottom rail 3612 through each of the second slots 3620 of the slats 3616 to the top housing 3611. The top housing 3611 has a tilting mechanism 3621, a tilt rod 3622 and a pull string assembly 3623 disposed therein. The tilt rod 3622 is mechanically coupled to the tilting mechanism 3121 and is fixedly coupled to the first and second string ladder support systems 3617 and 3618. The pull string assembly 3623 includes a pull tab 3624, a conductive wire 3614 and a cord lock unit 3625. The cord 3614 is mechanically coupled to the pull tab 3624. The cord lock unit 3625 is disposed in the top housing 3611 and mechanically coupled thereto. An alarm device 3626 has a first input terminal and a second input terminal. The first and second ends of the conductive wire 3614 are electrically coupled to the first and second input terminals, respectively, of the alarm device 3626.

Referring to FIG. 109 in conjunction with FIG. 52, FIG. 53 and FIG. 110 the covering 3613 may be a single honeycomb shade which has a centerline and which is mechanically coupled to the top housing 3611 and the bottom rail 3612. The conductive wire 3614 is disposed along the centerline of the single honeycomb shade.

Referring to FIG. 109 in conjunction with FIG. 21, FIG. 22, FIG. 23, FIG. 31, FIG. 50, FIG. 51 and FIG. 110 the covering 3513 may also be is a double honeycomb shade which has a centerline and which is mechanically coupled to the top housing 3611 and the bottom rail 3612. The conductive wire 3614 is disposed along the centerline of the double honeycomb shade.

Referring to FIG. 109 in conjunction with FIG. 31, FIG. 54 and FIG. 110 the covering 3613 may further be a triple honeycomb shade which has a centerline and which is mechanically coupled to the top housing 3611 and the bottom rail 3612. The conductive wire 3614 is disposed along the centerline of the triple honeycomb shade.

Referring to FIG. 109 in conjunction with FIG. 24, FIG. 27, FIG. 48, FIG. 49 and FIG. 110 the covering 3613 may still further be a pleated shade which has a centerline and which is mechanically coupled to the top housing 3611 and the bottom rail 3612. The conductive wire 3614 is disposed along the centerline of the pleated shade.

Referring to FIG. 110 in conjunction with FIG. 108 and FIG. 109 each resiliently biased reed relay switch 3515 is mechanically coupled to one of the two ends of the bottom rail 3612 and electrically coupled to the conductive wire 3614. Two rotatable resiliently biased reed relay switch 3615 are mechanically coupled to the top housing 3611 and electrically coupled to the conductive wire 3614. There are two bottom brackets 3627 each of which has a magnet 3628. Each resiliently biased reed relay switch 3515 is coupled to one of the two bottom brackets 3627 the magnet 3628 of which closes the resiliently biased reed relay switch 3515.

Figure 112:
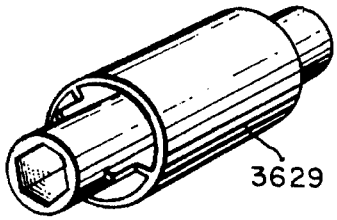
FIG. 112 is a perspective drawing of a boat which is to be adapted for use in the second resiliently biased reed relay switch of FIG. 109.

Referring to FIG. 111 in conjunction with FIG. 112 and FIG. 113 each rotatable, resiliently biased reed relay switch 3615 includes a boat 3629, a boat support 3630, a spring 3631 and a reed relay switch 3632.

Figure 116:
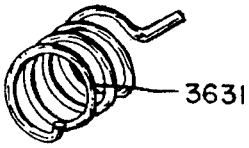
FIG. 116 is a perspective drawing of a spring for use in the second resiliently biased reed relay switch of FIG. 109.

Referring to FIG. 114 in conjunction with FIG. 110, FIG. 115 and FIG. 116 the boat 3629 is adapted for use in the rotatable resiliently biased reed relay switch 3615.

Figure 117:
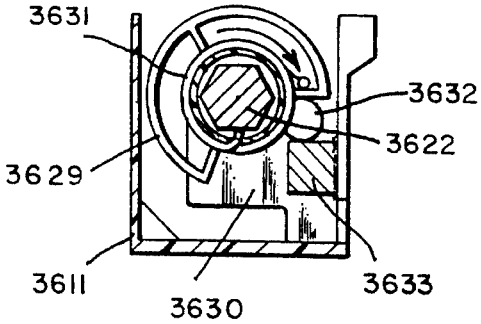
FIG. 117 is an end view in cross-section of the second resiliently biased reed relay switch of FIG. 109 shown in an undisturbed, normally closed position.

Referring to FIG. 117 and FIG. 110 the rotatable, resiliently biased reed relay switch 3615 is in an undisturbed, normally closed position. The conductive wire 3614 is mechanically coupled to the boat 3629 and electrically coupled to the reed relay switch 3632.

Figure 118:
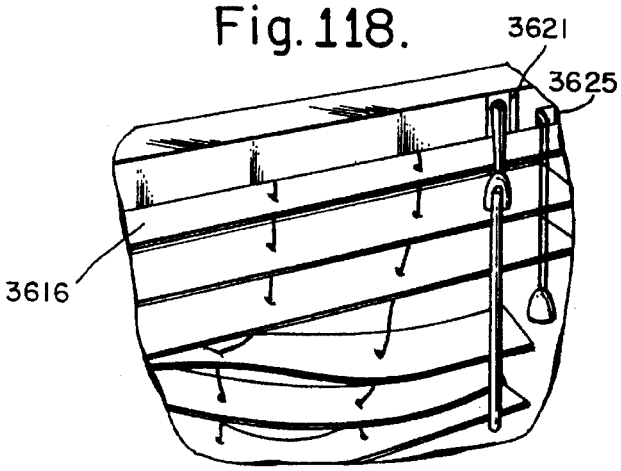
FIG. 118 is a partial perspective drawing of the combined alarm system and blind assembly of FIG. 109 shown as having been disturbed by a would be intruder.
Figure 119:
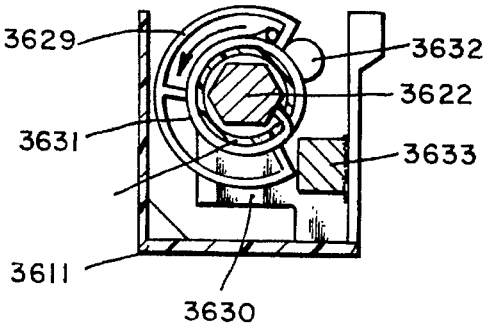
FIG. 119 is an end view in cross-section of the second resiliently biased reed relay switch of FIG. 109 shown in a disturbed, opened position.

Referring to FIG. 118 in conjunction with FIG. 110 and FIG. 119 a would be intruder has disturbed the combined alarm system and blind assembly 3610 causing the resiliently biased reed relay switch 3615 to be in a disturbed, opened position.

Figure 120:
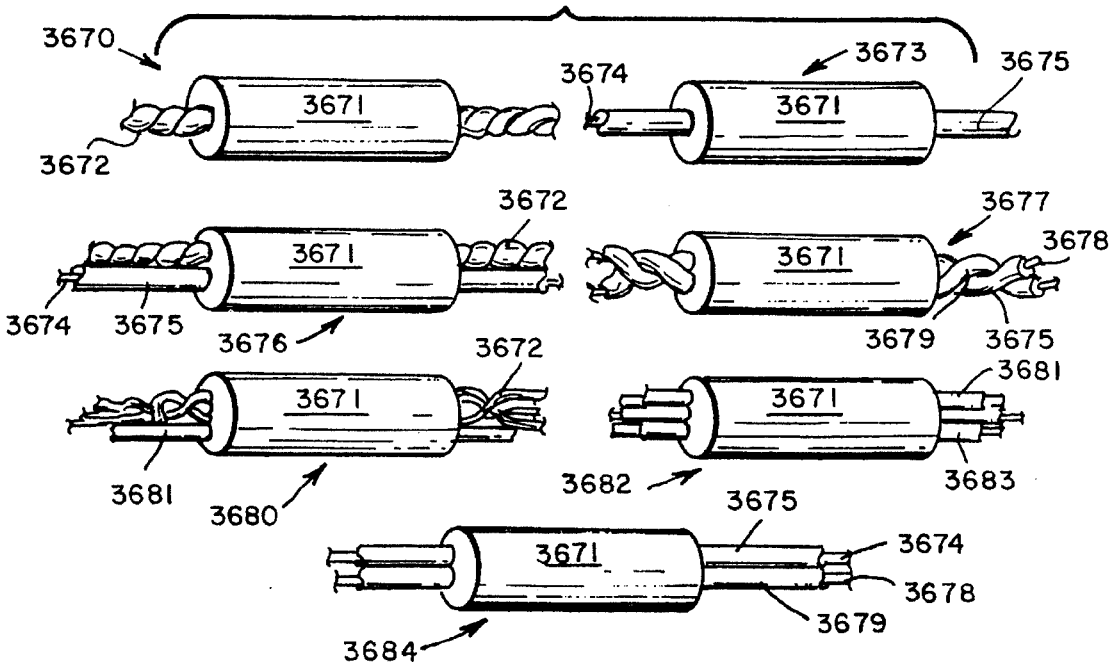

Referring to FIG. 120 a grouping of pull cords with conductive wires for use in the combined alarm system and blind assemblies of FIG. 106 and FIG. 109. The conventional pull cord 3670 includes a sleeve 3671 and a fibrous filament 3672. The first conductive pull cord 3673 includes the sleeve 3671 and a first conductive wire 3674 which has a first insulation layer 3675 and which replaces the fibrous filament 3672. The second conductive pull cord 3676 includes the sleeve 3671, the first conductive wire 3674, the first insulation layer 3675 and the fibrous filament 3672. The third conductive pull cord 3677 includes the sleeve 3671, the first conductive wire 3674, the first insulation layer 3675 and a second conductive wire 3678 which has a second insulation layer 3679 and which replaces the fibrous filament 3672. The first and second conductive wires 3674 and 3678 are twisted. The fourth conductive pull cord 3680 includes the sleeve 3671, an optical fiber 3681 and the fibrous filament 3672. The fifth conductive pull cord 3682 includes the sleeve 3671, the first optical fiber 3681 and a second optical fiber 3683 which replaces the fibrous filament 3672. The sixth conductive pull cord 3684 includes the sleeve 3671, the first conductive wire 3674, the first insulation layer 3675 and a second conductive wire 3678 which has a second insulation layer 3679 and which replaces the fibrous filament 3672. The first and second conductive wires 3674 and 3678 are not twisted.

Figure 121:
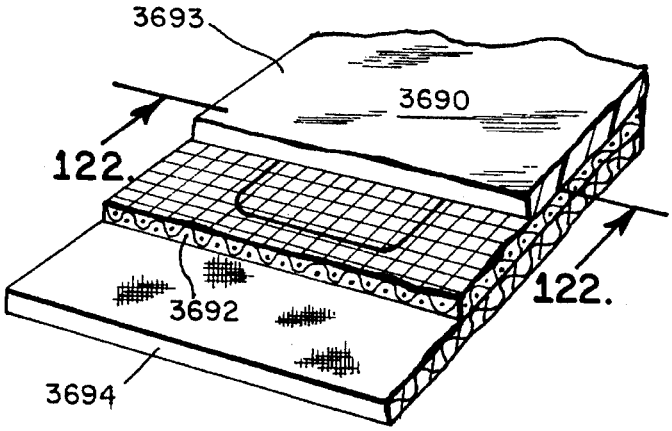
Figure 122:
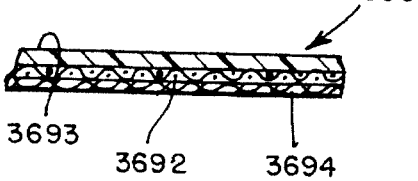

Referring to FIG. 121 in conjunction with FIG. 122 a window covering 3690 for use with an alarm system includes a screen mesh 3691, an alarm circuit 3692, a layer 3693 of vinyl material and a layer 3694 of fabric material. The screen mesh 3691 has a first side and second side. The alarm circuit 3692 is mechanically coupled to the screen mesh 3691. The layer 3693 of vinyl material is mechanically coupled to the first side of the screen mesh. The layer 3694 of fabric material is mechanically coupled to the second side of the screen mesh 3691. The alarm circuit 3692 is either a conductive wire or an optical wire.

Referring to FIG. 123 in conjunction with FIG. 124 a combined alarm system and window covering assembly 3710 includes a top housing 3711, a bottom rail 3712 having two ends, a covering 3713, a conductive wire 3714, two of the resiliently biased reed relay switches 3515, a capstan based system 3715 and a rotatable electrical connector 3716. The roll-up mechanism 3715 is disposed in the top housing 3711. The capstan based system raises and lowers the bottom rail 3712. The rotatable electrical connector 3716 is disposed in the top housing 3711 and electrically coupled to the conductive wire. 3714. U.S. Pat. No. 4,623,012 teaches a capstan based system for by pulling and accumulating the pull-cords used to lift hanging coverings from their bottom rails. U.S. Pat. No. 5,082,448 teaches a rotatable electrical connector 3716. The covering 3713 is mechanically coupled to the top housing 3711 and the bottom rail 3712. The conductive wire 3714 extends from the top housing 3711 down to the bottom rail 3712 and up from the bottom rail 3712 to the top housing 3711. The conductive wire 3714 is coupled to both the bottom rail 3712 and the capstan based system 3715. The conductive wire 3714 functions as a pull cord for raising and lowering the bottom rail 3712.

Referring to FIG. 123 in conjunction with FIG. 52, FIG. 53 and FIG. 124 the covering 3713 is a single honeycomb shade which has a centerline and which is mechanically coupled to the top housing 3711 and the bottom rail 3712. The conductive wire 3714 is disposed along the centerline of the single honeycomb shade.

Referring to FIG. 123 in conjunction with FIG. 109, FIG. 110 and FIG. 124 the covering 3713 may include a plurality of individual slats, a first string ladder support system and a second string ladder support system. Each slat has a first slot and a second slot, which is spaced apart from the first slot. The first string ladder support system has a front vertical ladder string and a back vertical ladder string with short support strings fastened between the front and back vertical ladder strings. The first string ladder support system is mechanically coupled to the top housing 3711 and the bottom rail 3712. Each short support string of the first string ladder support system supports one of the slats contiguous to the first slot thereof. The second string ladder support system has a front vertical ladder string and a back vertical ladder string with short support strings fastened between the front and back vertical ladder strings. The second string ladder support system is mechanically coupled to the top housing 3711 and the bottom rail 3712. Each short support string of the second string ladder support system supports one of the slats contiguous to the second slot thereof. The conductive wire 3714 extends from the top housing 3711 down through each of the first slots of the slats to the bottom rail 3712 and from the bottom rail 3712 through each of the second slots of the slats to the top housing 3711. The top housing 3711 may have a tilting mechanism and a tilt rod disposed therein. The tilt rod is mechanically coupled to the tilting mechanism and is fixedly coupled to the first and second string ladder support systems.

Referring to FIG. 123 in conjunction with FIG. 21, FIG. 22, FIG. 23, FIG. 31, FIG. 50, FIG. 51 and FIG. 124 the covering 3713 may also be a double honeycomb shade which has a centerline and which is mechanically coupled to the top housing 3711 and the bottom rail 3712. The conductive wire 3714 is disposed along the centerline of the double honeycomb shade.

Referring to FIG. 123 in conjunction with FIG. 31, FIG. 54 and FIG. 124 the covering 3713 may further be a triple honeycomb shade which has a centerline and which is mechanically coupled to the top housing 3711 and the bottom rail 3712. The conductive wire 3714 is disposed along the centerline of the triple honeycomb shade.

Referring to FIG. 123 in conjunction with FIG. 24, FIG. 27, FIG. 48, FIG. 49 and FIG. 124 the covering 3713 may still further be a pleated shade which has a centerline and which is mechanically coupled to the top housing 3711 and the bottom rail 3712. The conductive wire 3714 is disposed along the centerline of the pleated shade.

Referring to FIG. 124 in conjunction with FIG. 108 and FIG. 123 each resiliently biased reed relay switch 3515 is mechanically coupled to one of the two ends of the bottom rail 3712 and electrically coupled to the conductive wire 3714. There are two bottom brackets 3735 each of which has a magnet 3736. Each resiliently biased reed relay switch 3715 is coupled to one of the two bottom brackets 3735 the magnet 3736 of which closes the resiliently biased reed relay switch 3715.

Referring to FIG. 125 in conjunction with FIG. 126 a combined alarm system and window covering assembly 3810 includes a top housing 3811, a bottom rail 3812 having two ends, a covering 3813, an optical fiber 3814, two resiliently biased optical reed relay switches 3815 and an optical switching assembly 3816. The covering 3813 is mechanically coupled to the top housing 3811 and the bottom rail 3812. The optical fiber 3814 extends from the top housing 3811 down to the bottom rail 3812 and up from the bottom rail 3812 to the top housing 3811. The optical fiber 3814 is coupled to both the bottom rail 3812. The optical fiber 3814 functions as a pull cord for raising and lowering the bottom rail 3812.

Referring to FIG. 126 in conjunction with FIG. 45, FIG. 46, FIG. 47 and FIG. 125 the optical switching assembly 3816 includes a housing 3817, a light bulb 3818 and an optical relay switch 3819 and is optically coupled to the optical fiber 3814. The light bulb 3818 and the optical relay switch 3819 are disposed in the housing 3817. The optical switching assembly 3816 is similar to the optical relay system 1116 which includes a battery 1117 and a light 1118 and an optical relay switch 1119.

Still referring to FIG. 125 in conjunction with FIG. 109 and FIG. 110 the covering 3813 includes a plurality of individual slats, a first string ladder support system and a second string ladder support system. Each slat has a first slot and a second slot, which is spaced apart from the first slot. The first string ladder support system has a front vertical ladder string and a back vertical ladder string with short support strings fastened between the front and back vertical ladder strings. The first string ladder support system is mechanically coupled to the top housing 3811 and the bottom rail 3812. Each short support string of the first string ladder support system supports one of the slats contiguous to the first slot thereof. The second string ladder support system has a front vertical ladder string and a back vertical ladder string with short support strings fastened between the front and back vertical ladder strings. The second string ladder support system is mechanically coupled to the top housing 3811 and the bottom rail 3812. Each short support string of the second string ladder support system supports one of the slats contiguous to the second slot thereof. The optical fiber 3814 extends from the top housing 3811 down through each of the first slots of the slats to the bottom rail 3812 and from the bottom rail 3812 through each of the second slots of the slats to the top housing 3811. The top housing 3811 may have a tilting mechanism and a tilt rod disposed therein. The tilt rod is mechanically coupled to the tilting mechanism and is fixedly coupled to the first and second string ladder support systems.

Referring to FIG. 125 in conjunction with FIG. 52 and FIG. 53 the covering 3813 may be a single honeycomb shade which has a centerline and which is mechanically coupled to the top housing and the bottom rail. The optical fiber 3814 is disposed along the centerline of the single honeycomb shade.

Referring to FIG. 125 in conjunction with FIG. 21, FIG. 22, FIG. 23, FIG. 31, FIG. 50 and FIG. 51 the covering 3813 may also be a double honeycomb shade which has a centerline and which is mechanically coupled to the top housing 3811 and the bottom rail 3812. The optical fiber 3814 is disposed along the centerline of the double honeycomb shade.

Referring to FIG. 125 in conjunction with FIG. 31 and FIG. 54 the covering 3813 may further be a triple honeycomb shade which has a centerline and which is mechanically coupled to the top housing 3811 and the bottom rail 3812. The optical fiber 3814 is disposed along the centerline of the triple honeycomb shade.

Referring to FIG. 125 in conjunction with FIG. 24, FIG. 27, FIG. 48 and FIG. 49 the covering 3813 may still further be a pleated shade which has a centerline and which is mechanically coupled to the top housing 3811 and the bottom rail 3812. The optical fiber 3814 is disposed along the centerline of the pleated shade.

Referring to FIG. 127 in conjunction with FIG. 125 there are two resiliently biased optical reed relay switches 3815. Each resiliently biased optical reed relay switch 3815 includes a housing 3821, a spring 3822 with a first arm 3823 and a second arm 3824, a first rubber grommet 3825 disposed on the first arm 3823 and two second rubber grommets 3826 disposed on the second arm 3824 and is mechanically coupled to one of the two ends of the bottom rail 3812 and electrically coupled to the optical fiber 3814. There are two bottom brackets 3827. Each resiliently biased reed relay switch 3815 is coupled to one of the two bottom brackets 3827. A magnet 3828 closes each resiliently biased optical reed relay switch 3815.

Referring to FIG. 128 in conjunction with FIG. 129 a combined alarm system and window covering assembly 3910 includes a top housing 3911, a bottom rail 3912 having two ends, a covering 3913, an optical fiber 3914, a capstan based system 3915 with a shaft 3916, a rotatable electrical connector 3917 having a rotatable base 3918 and an optical switching assembly 3919. The covering 3913 is mechanically coupled to the top housing 3911 and the bottom rail 3912. The optical fiber 3914 extends from the top housing 3911 down to the bottom rail 3912 and up from the bottom rail 3912 to the top housing 3911. The optical fiber 3914 is coupled to both the bottom rail 3912 and the shaft 3916 of the capstan based system 3915. The optical fiber 3914 functions as a pull cord for raising and lowering the bottom rail 3912.

Referring to FIG. 129 in conjunction with FIG. 45, FIG. 46, FIG. 47 and FIG. 128 the optical switching assembly 3819 includes a housing 3920, a light bulb 3921 and an optical relay switch 3922 and is optically coupled to the optical fiber 3914. The housing 3920 is fixedly coupled to the shaft 3916 of the capstan based system 3915 so that the optical switching assembly 3819 rotates with the shaft 3916. The optical switching assembly 3919 is similar to the optical relay system 1116 which includes a battery 1117 and a light 1118 and an optical relay switch 1119. The capstan based system 3915 is disposed in the top housing 3911. The capstan based system 3915 raises and lowers the bottom rail 3912. The rotatable electrical connector 3916 is disposed in the top housing 3911 and electrically coupled to the optical fiber 3914. The rotatable base 3918 of the rotatable electrical connector 3917 is fixedly coupled to the shaft 3916 of the capstan based system 3915 so that the rotatable base 3918 rotates with the shaft 3916. U.S. Pat. No. 4,623,012 teaches a capstan based system 3915 which has shaft 3916 is used to lift hanging coverings from their bottom rails by pulling and accumulating the pull-cords. U.S. Pat. No. 5,082,448 teaches a rotatable electrical connector 3917 with a rotatable base 3918.

Still referring to FIG. 128 in conjunction with FIG. 109 and FIG. 110 the covering 3913 includes a plurality of individual slats, a first string ladder support system and a second string ladder support system. Each slat has a first slot and a second slot, which is spaced apart from the first slot. The first string ladder support system has a front vertical ladder string and a back vertical ladder string with short support strings fastened between the front and back vertical ladder strings. The first string ladder support system is mechanically coupled to the top housing 3911 and the bottom rail 3912. Each short support string of the first string ladder support system supports one of the slats contiguous to the first slot thereof. The second string ladder support system has a front vertical ladder string and a back vertical ladder string with short support strings fastened between the front and back vertical ladder strings. The second string ladder support system is mechanically coupled to the top housing 3911 and the bottom rail 3912. Each short support string of the second string ladder support system supports one of the slats contiguous to the second slot thereof. The optical fiber 3914 extends from the top housing 3911 down through each of the first slots of the slats to the bottom rail 3912 and from the bottom rail 3912 through each of the second slots of the slats to the top housing 3911. The top housing 3911 may have a tilting mechanism and a tilt rod disposed therein. The tilt rod is mechanically coupled to the tilting mechanism and is fixedly coupled to the first and second string ladder support systems.

Referring to FIG. 128 in conjunction with FIG. 52 and FIG. 53 the covering 3913 may be a single honeycomb shade which has a centerline and which is mechanically coupled to the top housing and the bottom rail. The optical fiber 3914 is disposed along the centerline of the single honeycomb shade.

Referring to FIG. 128 in conjunction with FIG. 21, FIG. 22, FIG. 23, FIG. 31, FIG. 50 and FIG. 51 the covering 3913 may also be a double honeycomb shade which has a centerline and which is mechanically coupled to the top housing 3911 and the bottom rail 3912. The optical fiber 3914 is disposed along the centerline of the double honeycomb shade.

Referring to FIG. 128 in conjunction with FIG. 31 and FIG. 54 the covering 3913 may further be a triple honeycomb shade which has a centerline and which is mechanically coupled to the top housing 3911 and the bottom rail 3912. The optical fiber 3914 is disposed along the centerline of the triple honeycomb shade.

Referring to FIG. 128 in conjunction with FIG. 24, FIG. 27, FIG. 48 and FIG. 49 the covering 3913 may still further be a pleated shade which has a centerline and which is mechanically coupled to the top housing 3911 and the bottom rail 3912. The optical fiber 3914 is disposed along the centerline of the pleated shade.

Referring to FIG. 128 in conjunction with FIG. 127 each resiliently biased reed optical relay switch 3815 is mechanically coupled to one of the two ends of the bottom rail 3912 and electrically coupled to the optical fiber 3914. There are two bottom brackets 3927 each of which has a magnet 3928. Each resiliently biased reed relay switch 3815 is coupled to one of the two bottom brackets 3927 the magnet 3928 of which closes the resiliently biased reed relay switch 3815.

Referring to FIG. 130 in conjunction with FIG. 131, FIG. 132 and FIG. 133 a wooden bottom rail 4012 is a rectangular wooden member 4013 having a pair of first bores 4014 and a pair of second bores 4015, a slot 4016 on its rear edge and a cover strip 4017 which covers the slot 4016. Either the resiliently biased reed relay switch 3515 or the resiliently biased optical reed relay switch 3815 may be placed into one of the first bores 4014. Either the conductive wire 3514 or the optical fiber 3814 may be placed into one of the second bores 4015. The wooden bottom rail 4012 is for use with all of the coverings.

Throughout the coverings include pleated shades, single honeycomb shades, double honeycomb shades, triple honeycomb shades and blinds with slats formed out of metals, woods, fabrics and plastics. The alarm circuits have been formed out of either conductive wires or optical fibers.

The alarm circuit, either a conductive wire or an optical fiber, functions as a pull cord. A would be intruder can not easily determine that the pull cord is an alarm circuit. When the alarm circuit and the two resiliently biased reed relay switches are used in conjunction with each other they function as a release for the bottom rail. The rollers are used with the alarm circuit, either a conductive wire or an optical fiber, to protect it from damage due to excessive bending thereof.

From the foregoing it can be seen that a combined alarm system and window covering assembly has been described. It should be noted that the drawings are not drawn to scale and that distances between the figures and their relative sizes are not to be considered significant.

It is intended that the foregoing descriptions and showings made in the drawings shall be considered only as an illustration of the principles of the present invention and may be embodied in a variety of forms by one skilled in the art.

What is claimed is:

1. A combined alarm system and window covering assembly comprising:

a. a top housing;

b. a bottom rail having two ends;

c. a covering mechanically coupled to said top housing and said bottom rail;

d. an alarm element extending from said top housing down to said bottom rail and up from said bottom rail to said top housing whereby said alarm element functions as a pull cord for raising and lowering said bottom rail; and e. two resiliently biased reed relay switches each of which is mechanically coupled to one of said two ends of said bottom rail and coupled to said alarm element.

2. A combined alarm system and window covering assembly according to claim 1 wherein said alarm element is a conductive wire.

3. A combined alarm system and window covering assembly according to claim 2 wherein said covering includes:

a. a plurality of slats each of which has a first slot and a second slot, which is spaced apart from said first slot;

b. a first string ladder support system which has a front vertical ladder string and a back vertical ladder string with short support strings fastened between said front and back vertical ladder strings and which is mechanically coupled to said top housing and said bottom rail, each of said short support strings of said first string ladder support system supporting one of said slats contiguous to said first slot thereof; and c. a second string ladder support system which has a front vertical ladder string and a back vertical ladder string with short support strings fastened between said front and back vertical ladder strings and which is mechanically coupled to said top housing and said bottom rail, each of said short support strings of said second string ladder support system supporting one of said slats contiguous to said second slot thereof wherein said conductive wire extends from said top housing down through each of said first slots of said slats to said bottom rail and from said bottom rail through each of said second slots of said slats to said top housing.

4. A combined alarm system and window covering assembly according to claim 2 wherein said covering is a single honeycomb shade which has a centerline and which is mechanically coupled to said top housing and said bottom rail wherein said alarm conductive wire is disposed along said centerline of said single honeycomb shade.

5. A combined alarm system and window covering assembly according to claim 2 wherein said covering is a double honeycomb shade which has a centerline and which is mechanically coupled to said top housing and said bottom rail wherein said conductive wire is disposed along said centerline of said double honeycomb shade.

6. A combined alarm system and window covering assembly according to claim 2 wherein said covering is a triple honeycomb shade which has a centerline and which is mechanically coupled to said top housing and said bottom rail wherein said conductive wire is disposed along said centerline of said triple honeycomb shade.

7. A combined alarm system and window covering assembly according to claim 2 wherein said covering is a pleated shade which has a centerline and which is mechanically coupled to said top housing and said bottom rail wherein said conductive wire is disposed along said centerline of said pleated shade.

8. A combined alarm system and window covering assembly according to claim 2, wherein said combined alarm system and window covering assembly includes:

a. a roll-up mechanism disposed in said top housing, said roll-up mechanism raises and lowers said bottom rail; and b. a rotatable electrical connector disposed in said top housing and electrically coupled to said conductive wire.

9. A combined alarm system and window covering assembly according to claim 1 wherein said alarm element is an optical fiber.

10. A combined alarm system and window covering assembly according to claim 9 wherein said window covering includes:

a. a plurality of slats each of which has a first slot and a second slot, which is spaced apart from said first slot;

b. a first string ladder support system which has a front vertical ladder string and a back vertical ladder string with short support strings fastened between said front and back vertical ladder strings and which is mechanically coupled to said top housing and said bottom rail, each of said short support strings of said first string ladder support system supporting one of said slats contiguous to said first slot thereof; and c. a second string ladder support system which has a front vertical ladder string and a back vertical ladder string with short support strings fastened between said front and back vertical ladder strings and which is mechanically coupled to said top housing and said bottom rail, each of said short support strings of said second string ladder support system supporting one of said slats contiguous to said second slot thereof wherein said conductive wire extends from said top housing down through each of said first slots of said slats to said bottom rail and from said bottom rail through each of said second slots of said slats to said top housing.

11. A combined alarm system and window covering assembly according to claim 9 wherein said covering is a single honeycomb shade which has a centerline and which is mechanically coupled to said top housing and said bottom rail wherein said optical fiber is disposed along said centerline of said single honeycomb shade.

12. A combined alarm system and window covering assembly according to claim 9 wherein said covering is a double honeycomb shade which has a centerline and which is mechanically coupled to said top housing and said bottom rail wherein said optical fiber is disposed along said centerline of said double honeycomb shade.

13. A combined alarm system and window covering assembly according to claim 9 wherein said covering is a triple honeycomb shade which has a centerline and which is mechanically coupled to said top housing and said bottom rail wherein said optical fiber is disposed along said centerline of said triple honeycomb shade.

14. A combined alarm system and window covering assembly according to claim 9 wherein said covering is a pleated shade which has a centerline and which is mechanically coupled to said top housing and said bottom rail wherein said optical fiber is disposed along said centerline of said pleated shade.

15. A combined alarm system and window covering assembly according to claim 9, wherein said combined alarm system and window covering assembly includes:

a. a roll-up mechanism disposed in said top housing, said roll-up mechanism raises and lowers said covering and said bottom rail; and b. a rotatable electrical connector disposed in said top housing and optically coupled to said optical switching assembly.

16. A window covering for use with an alarm system comprising:

a. a screen mesh having a first side and second side;

b. an alarm element mechanically coupled to said screen mesh;

c. a layer of vinyl material mechanically coupled to said first side of said screen mesh; and d. a layer of fabric material mechanically coupled to said second side of said screen mesh.

17. A combined alarm system and window covering assembly according to claim 16 wherein said alarm element is a conductive wire.

18. A combined alarm system and window covering assembly according to claim 16 wherein said alarm element is an optical fiber.

19. A combined alarm system and window covering assembly, said combined alarm system and window covering assembly comprising:

a. a top housing;

b. a bottom rail;

c. a covering mechanically coupled to said top housing and said bottom rail;

d. a roll-up mechanism for raising and lowering said bottom rail and said covering;

e. an alarm element extending from said top housing down to said bottom rail and up from said bottom rail to said top housing; and f. a rotatable electrical connector having a first input terminal, a second input terminal, a first output terminal and a second output terminal and being disposed in said top housing, said alarm element being electrically coupled to said first and second input terminals of said rotatable electrical connector.

20. A combined alarm system and window covering assembly according to claim 19 wherein said alarm element is a conductive wire which has a first end and a second end and which extends from said top housing down to said bottom rail and up from said bottom rail to said top housing.

* * * * *